US011272751B2

(12) United States Patent
Popejoy et al.

(10) Patent No.: US 11,272,751 B2
(45) Date of Patent: Mar. 15, 2022

(54) PROTECTIVE HEADGEAR, IMPACT DIFFUSING SYSTEMS AND METHODS

(71) Applicant: Nicholas Popejoy, Newport Beach, CA (US)

(72) Inventors: William Popejoy, Newport Beach, CA (US); Nick Cecchi, Anaheim, CA (US); Theophil Oros, Villa Park, CA (US); Justin Ringhofer, Twin Peaks, CA (US)

( * ) Notice: Subject to any disclaimer, the term of this patent is extended or adjusted under 35 U.S.C. 154(b) by 246 days.

(21) Appl. No.: 16/681,245

(22) Filed: Nov. 12, 2019

(65) Prior Publication Data

US 2020/0154812 A1 May 21, 2020

Related U.S. Application Data

(63) Continuation-in-part of application No. 16/384,477, filed on Apr. 15, 2019, now Pat. No. 10,555,575, (Continued)

(51) Int. Cl.
*A42B 3/04* (2006.01)
*A41D 13/05* (2006.01)
(Continued)

(52) U.S. Cl.
CPC ..... *A42B 3/0473* (2013.01); *A41D 13/0512* (2013.01); *A42B 3/064* (2013.01);
(Continued)

(58) Field of Classification Search
CPC .... A42B 3/047; A41D 13/0512; A63B 71/081
See application file for complete search history.

(56) References Cited

U.S. PATENT DOCUMENTS 3,134,106 A 5/1964 Shaffer et al.
3,818,509 A 6/1974 Romo et al.
(Continued)

OTHER PUBLICATIONS

International Search Report and Written Opinion, application No. PCT/US19/31107, dated Aug. 5, 2019.
(Continued)

*Primary Examiner* — Katherine M Moran
(74) *Attorney, Agent, or Firm* — Carlos A. Fisher; Stout, Uxa & Buyan, LLP

(57) ABSTRACT

An impact diffusing system for protecting a user's head includes a headpiece cage coupled to a thoracic framework. In one aspect, the headpiece cage includes at least two support bars, a plurality of rigid bars surrounding at least a portion of the forehead, top, and sides of the head, and a face mask that encloses at least a portion the user's face. The thoracic framework covers at least a portion of a chest, upper back, and shoulders of the user, and the thoracic framework is attached to the support bars of the headpiece cage in a manner that prevents movement of the headpiece cage relative to the thoracic framework. In another aspect, the system includes a helmet component (formed of e.g., carbon fiber) coupled to a thoracic cage, wherein the helmet component is a solid, unitary piece that surrounds the top, back, and sides of the user's head.

24 Claims, 38 Drawing Sheets

Related U.S. Application Data which is a continuation of application No. 16/031,451, filed on Jul. 10, 2018, now Pat. No. 10,258,097, application No. 16/681,245, which is a continuation-in-part of application No. 15/975,971, filed on May 10, 2018, now abandoned, said application No. 16/031,451 is a continuation of application No. 15/262,946, filed on Sep. 12, 2016, now Pat. No. 10,016,006, which is a continuation of application No. 15/057,938, filed on Mar. 1, 2016, now Pat. No. 9,462,841.

(60) Provisional application No. 62/872,331, filed on Jul. 10, 2019, provisional application No. 62/843,045, filed on May 3, 2019.

(51) Int. Cl.

| | |
|---|---|
| ***A42B 3/20*** | (2006.01) |
| ***A42B 3/06*** | (2006.01) |
| ***A63B 71/08*** | (2006.01) |
| ***A42B 3/08*** | (2006.01) |
| ***A42B 3/12*** | (2006.01) |

(52) U.S. Cl.

CPC ..... *A42B 3/08* (2013.01); *A42B 3/121* (2013.01); *A42B 3/20* (2013.01); *A63B 71/081* (2013.01)

(56) References Cited

U.S. PATENT DOCUMENTS

| | | | | |
|---|---|---|---|---|
| 4,825,476 | A | 5/1989 | Andrews | |
| 4,999,855 | A * | 3/1991 | Brown | A42B 3/0473 2/421 |
| 5,123,408 | A | 6/1992 | Gaines | |
| 5,517,699 | A | 5/1996 | Abraham, II | |
| 5,715,541 | A | 2/1998 | Landau | |
| 5,930,843 | A | 8/1999 | Kelly | |
| 6,052,835 | A | 4/2000 | O'Shea | |
| 6,079,056 | A | 6/2000 | Fogelberg | |
| 6,385,781 | B1 | 5/2002 | Rose et al. | |
| 6,591,430 | B1 | 7/2003 | Slegde | |
| 6,968,576 | B2 | 11/2005 | McNeil et al. | |
| 7,115,747 | B2 | 10/2006 | Reeder et al. | |
| 8,613,114 | B1 | 12/2013 | Olivares Velasco | |
| 8,918,918 | B2 | 12/2014 | Jackson | |
| 9,027,163 | B1 | 5/2015 | Schmidt | |
| 9,205,320 | B2 | 12/2015 | Mason | |
| 9,462,841 | B1 | 10/2016 | Popejoy | |
| 10,016,006 | B2 | 7/2018 | Popejoy | |
| 2001/0011388 | A1 | 8/2001 | Nelson | |
| 2006/0096010 | A1 | 5/2006 | Glaser | |
| 2007/0245468 | A1 | 10/2007 | Butler | |
| 2011/0011388 | A1 | 1/2011 | Johnston | |
| 2011/0214224 | A1 | 9/2011 | Maddux et al. | |
| 2011/0277225 | A1 | 11/2011 | Salkind et al. | |
| 2013/0031706 | A1 | 2/2013 | Cooksey | |
| 2014/0020157 | A1 | 1/2014 | Barr | |
| 2014/0237707 | A1 | 8/2014 | Lane | |
| 2014/0259319 | A1 | 9/2014 | Ross et al. | |
| 2015/0135413 | A1 | 5/2015 | Mayerovitch | |
| 2015/0157080 | A1 | 6/2015 | Camarillo et al. | |
| 2015/0208750 | A1 | 7/2015 | White | |
| 2015/0223542 | A1 | 8/2015 | Fischell et al. | |
| 2016/0095361 | A1 | 4/2016 | Carmack | |
| 2016/0157543 | A1 | 6/2016 | Huang | |
| 2017/0367427 | A1 | 12/2017 | Meade | |
| 2018/0092423 | A1 | 4/2018 | Grinneback et al. | |
| 2019/0082769 | A1 * | 3/2019 | Barr | A63B 71/12 |

OTHER PUBLICATIONS

U.S. Office Action U.S. Appl. No. 14/718,583, dated Sep. 21, 2015.
U.S. Office U.S. Appl. No. 14/718,583, dated Jan. 17, 2015.

* cited by examiner

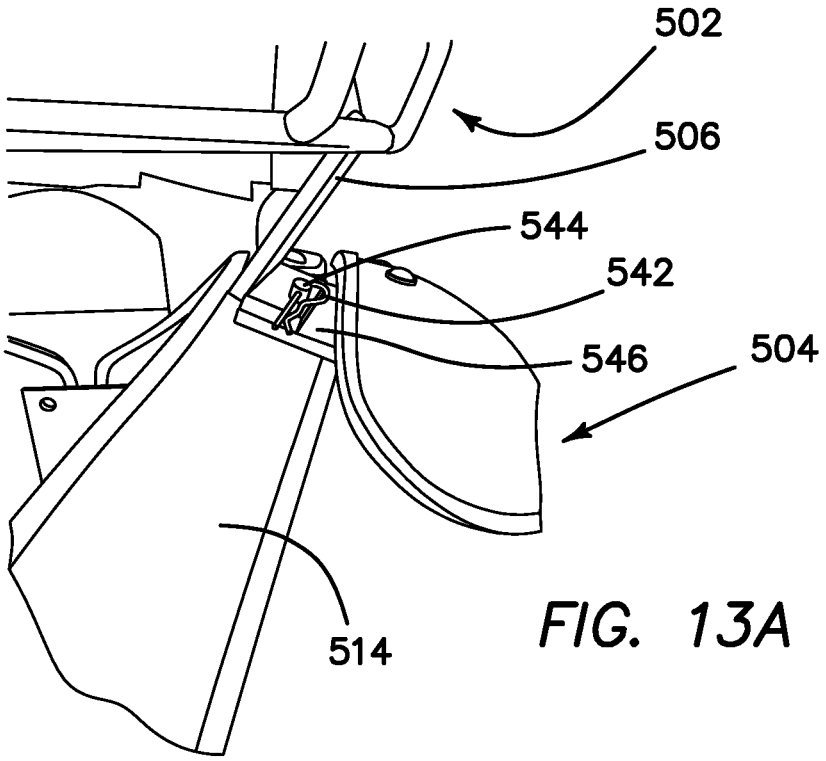
FIG. 13A
FIG. 13B
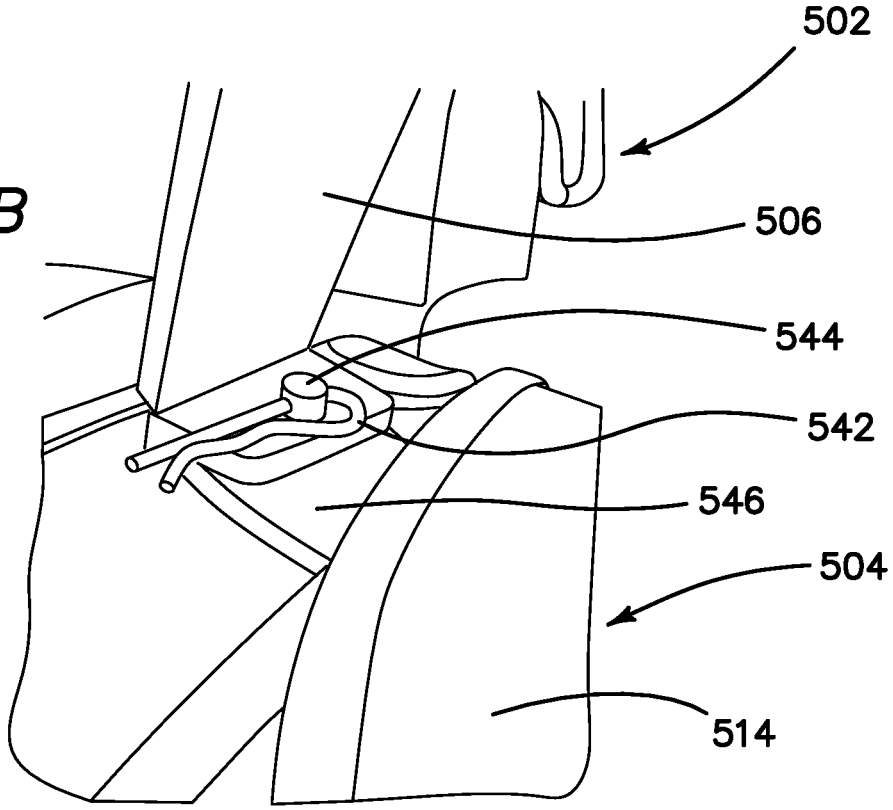

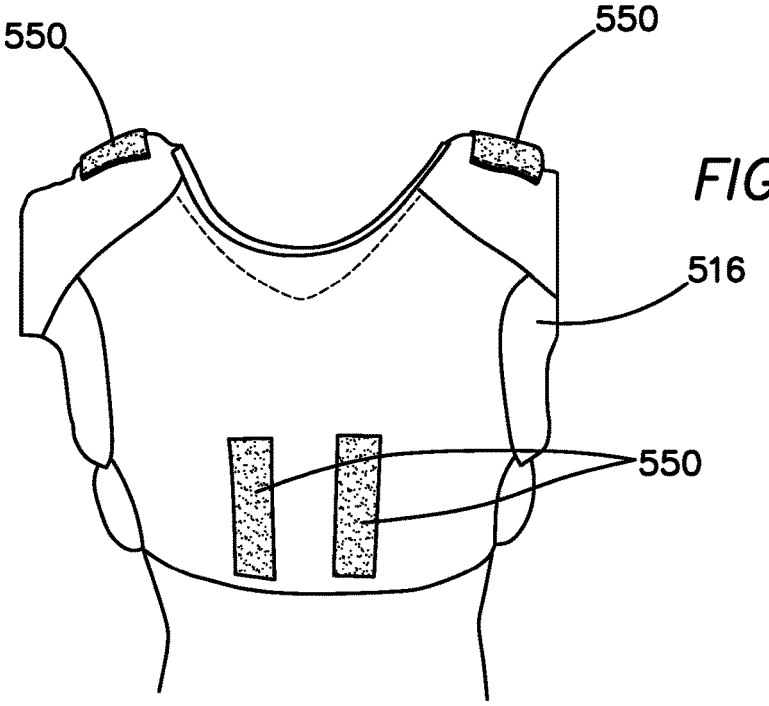
FIG. 14A
FIG. 14B
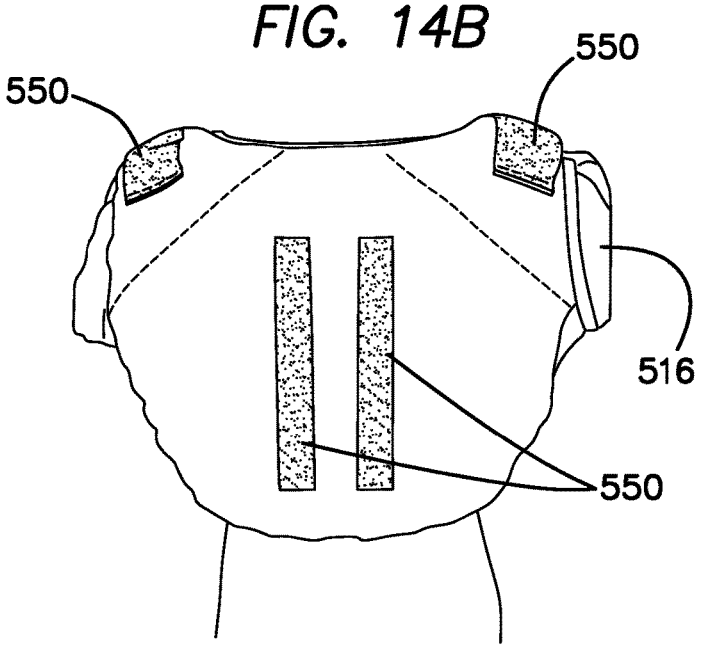
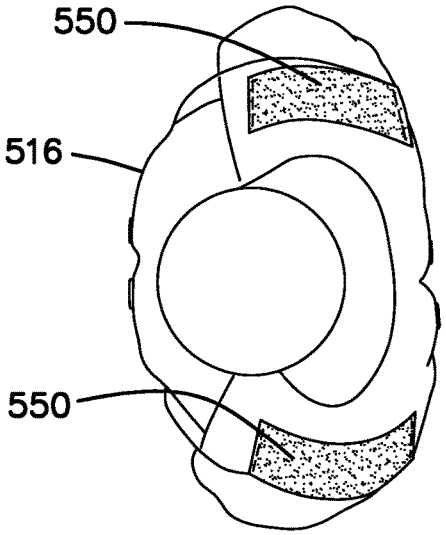
FIG. 14C

PROTECTIVE HEADGEAR, IMPACT DIFFUSING SYSTEMS AND METHODS

CROSS-REFERENCE TO RELATED APPLICATIONS

The present application claims the benefit of U.S. Provisional Applications No. 62/843,045, filed May 3, 2019 and 62/872,331, filed Jul. 10, 2019; and is a continuation-in-part of U.S. patent application Ser. No. 16/384,477, filed Apr. 15, 2019, which was a continuation of U.S. patent application Ser. No. 16/031,451, filed Jul. 10, 2018 (now U.S. Pat. No. 10,258,097), which was a continuation of U.S. patent application Ser. No. 15/262,946, filed Sep. 12, 2016 (now U.S. Pat. No. 10,016,006), which was a continuation of U.S. patent application Ser. No. 15/057,938, filed Mar. 1, 2016 (now U.S. Pat. No. 9,462,841); and is a continuation-in-part of U.S. patent application Ser. No. 15/975,971, filed May 10, 2018; each of which prior-filed applications is hereby incorporated by reference herein in its entirety.

FIELD OF THE INVENTION

The present invention generally relates to an impact diffusing system for protecting the head of a user of the system. More specifically, the present invention relates to an impact diffusing system that includes a helmet portion attached to a thoracic portion in a manner that prevents the helmet portion from moving relative to the thoracic portion.

BACKGROUND

The present invention is useful in sports, such as, without limitation, football (i.e., American, Australian and Canadian football), soccer, rugby, field and ice hockey, lacrosse, boxing and automotive and motorcycle racing. Additionally, the invention may find application in non-sporting activities such as military and spacecraft activities, in which bodily contact is common or the risk of collision or accident is high.

In such activities there may be a high risk of head injuries such as traumatic brain injury (TBI), as well as injuries to the neck, back, and spine. TBI is defined as damage to the brain resulting from external mechanical force, such as rapid acceleration or deceleration, impact, blast waves, or penetration by a projectile, that disrupts the normal function of the brain. TBI can result when the head suddenly and violently hits an object, or when an object pierces the skull and enters brain tissue. Immediate symptoms of a TBI can be mild, moderate or severe, depending on the extent of damage to the brain. Mild cases (mild traumatic brain injury, or mTBI) may result in a brief change in mental state or consciousness, while severe cases may result in extended periods of unconsciousness, coma or even death.

The American Society of Test and Materials (ASTM) recommends that protective headgear be worn 100% of the time to reduce the risk of TBI in most high risk activities such as those mentioned above. While various attempts have been made to make improved protective helmets, there remains a need for effective and improved protective headgear for use by various recreational, military and professional users, including both children and adults. Such headgear should be capable of substantially lessening the risk of TBI and neck, spine and back injury caused by a blow or force applied to the head, and the incidence of TBI (e.g., expressed as a percentage in a population of users) as compared to previously used helmets and protective headgear.

SUMMARY

In a broad example, the present invention is directed to methods and apparatus for preventing or reducing the severity of traumatic brain injury (1BI), neck, spine and/or back injury, through the use of protective headgear which is not supported, or is structured not to be substantially supported, by the wearer's head. Thus, in a particular example, the present invention is drawn to a protective headpiece comprising a helmet portion having an interior surface, an exterior surface and preferably a face mask component. The exterior surface of the helmet portion preferably comprises an outer protective shell, such as one including a durable material such as a resilient, impact-resistant polymer. By "resilient", "resilience" or like words is meant capable of withstanding shock without permanent deformation or rupture. Such materials, which are preferably strong and lightweight, may include any suitable polymer such as, without limitation, a polycarbonate, a carbon fiber material, a polyester or a mixture of one or more of these materials. The majority of football helmets are made using a polycarbonate component.

In other examples, the exterior surface of the helmet portion may comprise a "soft" shell, such as a viscoelastic polymer component covering a hard shell component underneath, to reduce the force experienced by the wearer. Such viscoelastic polymers may include "memory foams" such as low-resilience polyurethane foam. If present, the soft shell component may in some cases be designed as an outer covering which can be affixed in place to a harder, resilient shell using a hook and loop type fastener, such as a VELCRO® fastener.

In one example, the helmet portion of the present invention is structured so that the inner surface thereof makes no direct contact, or minimal direct contact, with the wearer's head during use. In preferred embodiments, the inside surface of the helmet portion lacks any retaining stop, protrusion, projection, item of padding or other feature that is structured or effective to substantially restrict rotational, vertical, or horizontal movement of the wearer's head within the helmet component during use. In this way, the wearer may move the head within the helmet portion without the helmet portion itself moving. By "head" is meant the cranium and/or the cranium and the facial bones, but is not meant the mandible alone. The minimization or absence of direct contact between the helmet portion and the wearer's head lessens the likelihood, particularly when used in conjunction with the mechanism transferring impact force to a thoracic portion of the system (to be described below), that an impact received by the outer shell of the helmet portion will be directly transmitted to the head or brain of the wearer without attenuation. For instance, in some examples, the helmet portion is adapted to leave sufficient space between the inner surface of the helmet portion and the outer surface of inner headgear (described below) to permit the wearer to move his or her head substantially freely up and down and side to side within an angular range. The space between the inner surface of the helmet portion and the outer surface of the inner headgear may average, for example, about 0.5 mm, or about 0.75 mm, or about 1 mm, or about 1.5 mm, or about 2 mm, or about 0.5 cm, or about 1 cm, or about 1.5 cm, or about 2 cm, or about 2.5 cm, or about 3 cm, or more. The vertical angular range of head movement is defined herein with respect to a horizontal plane parallel to the ground and including a line passing through the eyes when the user is looking straight ahead. Such freedom of head movement (i.e. up and down) may be up to about 75 degrees, or about 70 degrees, or about 65 degrees, or about 60 degrees, or about 55 degrees, or about 50 degrees, or about 45 degrees, or about 40 degrees, or about 35 degrees, or about 30 degrees, or about 25 degrees, or about 20 degrees, or about 15 degrees. Vertical angular ranges of head movement may be independently determined and different for head movement in the "up" direction and head movement in the "down" direction.

The horizontal angular range of head movement is defined herein with respect to the sagittal plane of the body. Such head movement (i.e. left and right of center) may be up to about 90 degrees, or about 85 degrees, or about 80 degrees, or about 75 degrees, or about 70 degrees, or about 65 degrees or about 60 degrees, or about 55 degrees, or about 50 degrees, or about 45 degrees, or about 40 degrees, or about 35 degrees, or about 30 degrees, or about 25 degrees, or about 20 degrees, or about 15 degrees. Horizontal angular ranges of head movement are generally substantially identical, but may be independently determined and different for head movement in the "left" direction and head movement in the "right" direction.

In the present application unless otherwise indicated, each and every range of values (including degrees, angles, distances and the like) stated in this specification, including the claims, are intended to specifically include every point and subrange within the entire expressly specified range and not just the endpoint(s). For example, a range stated to be from 0 to 10 is intended to disclose all whole numbers between 0 and 10 such as, for example 1, 2, 3, 4, etc.; all fractional numbers between 0 and 10 to two significant figures, for example 1.5, 2.3, etc.; and the endpoints 0 and 10, as well as all subranges having these numbers as endpoints (such as the subranges "3 to 5" and "2.3 to 7.1"). Similarly, ranges expressed as "up to", "at least", "greater than" (or less than) a given value means the range of values extending between that value and, depending upon the context, the highest value possible or lowest value possible such as 100% (or 0%) when expressed as a percentage, or 360 or 0 when expressed as an angle. Such subranges also include all whole and fractional numbers to two significant figures between the given value and the highest (or lowest) possible value, as appropriate.

In preferred examples of the present invention, the system of the present invention comprises separate inner headgear, which may be a "soft", preferably padded, hat component, closely fitting the wearer's head. The inner headgear is lightweight and may be comprised of, for example, a polymeric material having a cushioning property. In some examples the inner headgear may be firmly secured to the wearer's head using, for example, one or more preferably well-padded chin straps. The inner headgear may include padding comprising a forehead component to prevent injury to the forehead resulting from a blow that would otherwise force the face against the facemask of the helmet portion. The inner headgear is structured and designed to function together with the helmet portion so as to allow a range of motion for the wearer, thereby permitting wearers to move the head and inner headgear independently of the outer helmet portion to adjust their view within a range of vision while wearing the protective headgear apparatus of the present invention. Thus, in preferred embodiments, the outer surface of inner headgear lacks any retaining stop, protrusion, projection, item of padding or other feature that is structured or effective to substantially restrict rotational, vertical, or horizontal, or other movement of the wearer's head within the helmet component during use.

In some preferred examples, at least a portion of the outer surface of the inner headgear is substantially smooth and may be at least partially coated with a material having low friction, such as a material comprising polytetrafluoroethylene (PTFE), sold under the trade name TEFLON®. In some of these preferred examples, at least a portion the interior surface of the helmet portion may also similarly be at least partially coated with a material having low friction (e.g., PTFE). When the wearer experiences a blow to the helmet portion, the head and inner headgear may move independently of the outer helmet portion with lower friction and thus greater ease than if one or both surfaces were not coated with the low friction material. In some examples, the inner surface of the helmet portion may be at least partially covered with a "skin" that may be substantially smooth, thereby permitting the inner headgear to slide relative to the interior part of the helmet portion when a blow is experienced.

As described above, in important examples, the helmet portion and the inner headgear are structured and fitted in a manner such that a narrow space or gap is maintained between the inside of the helmet portion and at least a substantial part of the outer surface of the inner headgear during normal circumstances. This space may average, for example, about 0.5 mm, or about 0.75 mm, or about 1 mm, or about 1.5 mm, or about 2 mm, or about 0.5 cm, or about 1 cm, or about 1.5 cm, or about 2 cm, or about 2.5 cm, or about 3 cm, or more. Very preferably the average value of the space or gap is the smallest necessary to permit the wearer to be able to move the head and inner headgear independently and freely within the helmet portion without undue effort, while at the same time preventing the head from "rattling" against the inner walls of the helmet portion when the helmet portion receives a blow.

Preferably, the helmet portion has a wider, and optionally higher, face opening than a conventional football helmet. Since the helmet portion makes little or no direct contact, or only minimal direct contact, with the inner headgear, and is preferably sized to maintain a gap between the inner headgear and the helmet portion, the helmet portion may be larger than a conventional football helmet in some examples. For e.g., sports applications the helmet portion may preferably comprise a face mask component, such as, without limitation, a metal or polymer-coated metal "birdcage" type face mask component similar to those in current use. Preferably, the face mask component will be larger than conventional faceplates to accommodate the helmet portion's larger face opening in some examples of the present invention.

Preferably the helmet component is structured to provide ventilation to the head; particularly to the back of the head and/or neck between the collar of the thoracic portion and the lower margin of the helmet outer shell. In these embodiments the helmet portion itself may have a plurality of voids or vents defined in the back and/or sides of helmet outer shell, preferably penetrating through the inner surface of the helmet portion. These voids or vents permit fresh air to cool the head and also provide sweat and water vapor to escape entrapment on the inner surface of the helmet portion. Also, when the helmet portion and thoracic portion are joined, a gap may preferably be defined between the lower margins of the helmet component and the collar of the thoracic portion also permitting heat and sweat to escape from the head under the posterior sections of the helmet.

In important examples of the present invention, the helmet portion is either permanently or (preferably) removably affixed to a thoracic portion. Unless indicated otherwise expressly, it will be understood that the term "thoracic portion" refers to a protective piece of equipment comprising a shock absorbing pad material with a hard outer covering, such as a hard polymeric covering. As used in this specification, the protective equipment denoted the "thoracic portion" substantially covers the top portion of each of the two shoulder joints. As used herein, the shoulder joint comprises the part of the body where the humerus attaches to the scapula, the head sitting in the glenoid cavity, and is synonymous with the glenohumeral joint. The term "shoulder" or "shoulder(s)", as used herein, means the shoulder joint and nearby structures, but excludes the neck, the portion of the clavicle that makes contact with the spine, or any portion of the spine. The thoracic portion of the present invention is thus adapted to cover at least the top portion of the wearer's shoulders. Additionally, the thoracic portion comprises a rigid framework to which the helmet portion is attached.

As discussed above, the helmet portion is made to function as a strong unitary engineered assembly with the thoracic portion, thereby transferring impact force applied to the helmet portion to the shoulders and/or body rather than the head, neck and/or spine. As indicated below, in certain embodiments the helmet portion may comprise a headpiece cage skeleton comprising a plurality of support bars which may be incorporated as part of a helmet, attached to a conventional helmet, or to which an outer shell comprising a durable material, such as a hard polymer covering at least a portion of an outer surface of the headpiece cage, is fixedly attached. Thus, in preferred examples, the helmet portion is fabricated to contain a plurality of integral support bars or "pillars" that connect the helmet portion to the thoracic portion and support the helmet during use. The term "pillars" as used herein refers to a vertical structure that extends between, and is coupled to, the helmet portion and the thoracic portion. It will be understood that, a "support bar" may act as a pillar when it connects the helmet portion of headpiece cage to the thoracic portion. The pillars may be narrow, or elongated, or any width in between, and may extend along any width of the space between the helmet portion and the thoracic portion. The pillars may be located at the back, sides and/or front of the helmet. For example, there may be four pillars, with one located in the front, one in the back, and one on each side of the helmet portion. In some examples there may be three pillars; preferably in such examples either a front pillar or a back pillar is positioned substantially on the sagittal plane, and side pillars are located on the sides above the shoulders and near (or slightly anterior to or posterior to) the coronal plane. In other examples there may be more or less than four pillars.

In certain embodiments of the invention a pillar may not be located at the front of helmet portion. For example, one embodiment of the invention comprises two lateral pillars, extending downward from the helmet portion to the thoracic portion approximately along the coronal plane, with one lateral pillar positioned on each of opposing sides of the wearer's head when in use. The invention may comprise one or more pillar positioned posterior to the lateral pillars, for example, in a preferred embodiment two posterior pillars are positioned posterior to the lateral pillars, and are connected to the helmet portion at a position to the right and to the left, respectively, of the medial plan of the wearer's head when the invention is in use. These posterior pillars extend from the helmet component in a direction simultaneously downward, laterally and posteriorly to connection points on the rear shoulders or upper back of the thoracic portion.

The pillars are strong enough to absorb at least a portion of the force transmitted by a direct impact to the helmet portion. The pillars may be manufactured using, for example, a suitably strong and lightweight material, such as one or more of titanium, a titanium alloy, a non-titanium metal, a nanostructured ceramic, a nanostructured metal or metal alloy, a thermopolymer, or a carbon polymer. In some instances, but not invariably, the pillars are wholly or partially coated with a polymeric coating. Preferably the pillars are integrated into the helmet portion as part of the structure of the helmet (e.g., during the manufacturing process), such as through an engineered network connecting the pillars within the helmet portion to help diffuse and distribute impact forces throughout the helmet portion into each of the pillars and thereby evenly transfer the force to the thoracic portion.

In some examples (for example, ones in which the pillars are non-removable from the thoracic portion) the pillars may be integrated into the thoracic portion so as to make the helmet portion and the thoracic portion a single structure. In these examples, the pillars may be integrated into the thoracic portion in a manner similar to their connection to the helmet portion, such as through an engineered network connecting the pillars within the thoracic portion (which may contain a rigid framework, as described above) to help better diffuse impact forces along the shoulders and/or to the chest.

In these examples, therefore, the helmet portion and the thoracic portion together comprise a single unitary engineered assembly which can be used by placing the thoracic portion over the head, and then lowering the assembly so that the helmet portion fits onto the wearer's head. However, in other examples, the pillars are connectable to and removable from the thoracic portion, and are not permanently integrated therein. In such cases a single unitary engineered assembly is created when the pillars are connected to the thoracic portion.

In some examples the thoracic portion may generally consist of or comprise a hard polymeric (e.g., a thermopolymer or carbon polymer) shell with foam and/or fluid filled padding underneath. The pads fit over the shoulders and the chest and rib area, and may be secured with various snaps and/or buckles, for example, at the front of the chest or near the bottom of the thoracic portion. Very preferably, although not invariably, the thoracic portion comprises a rigid inner framework.

In the present invention, the pillars are preferably integrated within, or joined to, the thoracic portion so as to distribute impact forces experienced by the helmet portion to the thoracic portion and thence throughout the thoracic portion by way of the rigid framework within the thoracic portion. In this way, the concussive force applied to the head is deflected from the head and brain to the shoulders and chest by a unitary engineered assembly or network.

In preferred examples, the helmet portion may be structured to be removable from the thoracic portion. For example, the pillars may comprise one or more quick-release mechanisms to permit the helmet portion to be removed quickly in the event of an injury. These quick-release mechanisms should be capable of activation both by the wearer or by another person (such as a medical technician or doctor), but should be structured in a manner that prevents unintentional activation of the quick-release mechanism during play or other activity, or malicious removal by an opposing player.

Examples of suitable quick-release mechanisms are well known to those of ordinary skill in the art, and may comprise any suitable quick release mechanism. Thus, such a quick release mechanism may comprise (without limitation) quick-release pins, which can be pulled to separate the pillars from the helmet portion or thoracic portion, gimbaled latch mechanisms similar to those disclosed in U.S. Patent Publication No. US 2014/0259319, loops and clasps, carabiners and the like. Thus, the quick release mechanism may comprise pillar connectors located at the downward end of each pillar.

Additionally or alternatively, certain of the examples of the present invention may include one or more quick-release mechanisms for the face mask of the helmet portion, permitting it to be removed or opened when the player is injured, or on the sidelines or bench, thus permitting the wearer to eat or drink, or for emergency medical aid to be provided when and as necessary without the need to remove the helmet. A particular example of a quick release mechanism for the face mask may comprise one or more hinges or pivot mounts that allow the face mask to be lifted up (similar to a face guard on a helmet for a suit of armor), or to the side.

In some examples, the present invention may be structured for the helmet portion to be placed on the head after the thoracic portion has been put on and fitted, in a manner similar to how the helmet of a deep sea diving suit is placed on the head and secured to the suit after the diver has put the remainder of the suit on. In such examples, the pillars of the helmet portion may terminate in a fixture that can then be firmly and strongly mated with or joined to a corresponding thoracic portion fixture (such as, without limitation, a force-diffusing component), preferably using quick-release fasteners.

In other examples, the helmet portion may comprise a plurality of pillars extending generally downward therefrom with pillar connectors at or near the lower portion of one or more pillars. Preferably, at least three pillars, or at least four pillars, have connectors located at or near their lowest point. Each connector may be structured to fit and lock to a corresponding connector receptacle located on or in the thoracic portion. Each connector of the helmet portion pillars may fit into, and lock within its corresponding receptacle. In such cases the connector receptacle is preferably an element of the rigid framework of the thoracic portion.

In one embodiment of the present invention, an impact diffusing system for protecting a head of a user of the system is provided. The system includes a headpiece cage having at least two support bars that extend from a top of the cage to a bottom of the cage, such that the support bars extend from an upper position above a top of the user's head to a lower position below a jaw line of the user. The support bars of the headpiece cage may be connected to each other at the top of the headpiece cage, above the top of the user's head. The headpiece cage may be structured to attach to a conventional helmet, such as to the outside surface of the conventional helmet. Alternatively, the impact diffusing system may further include an outer shell comprising a hard and durable material, such as a hard polymer, covering at least a portion of an outer surface of the headpiece cage and fixedly attached thereto.

In one example, the cage may include a first support bar along the coronal plane and a second support bar along the sagittal plane posterior to the head. The first support bar may extend from one side of the head adjacent to one shoulder, around the top of the head, to the other side of the head adjacent to the other shoulder. In another example, the cage may include two support bars, each of which extends from the upper position above the top of the user's head, along a plane that is between the coronal and sagittal planes, to the lower position that is near a respective trapezius area of the user posterior to the head.

The headpiece cage may further include a plurality of rigid bars that are sized and structured to surround at least a portion of a forehead, a top, and sides of the head, wherein the plurality of rigid bars are coupled to the support bars. Still further, the headpiece cage preferably includes a face mask structured to enclose at least a front portion of a face of the user. The face mask is coupled to at least one of the support bars. The face mask may protrude anterior to the coronal plane and may include a post extending from the face mask downward from a central area of the face mask. The face mask post may extend from a center of the face mask along the sagittal plane. Alternatively, the face mask post may extend from a position to one side of a center of the face mask, and the face mask may further include a second post that extends downward from the face mask at a second position to the other side of the center of the face mask. In still other examples, the face mask may entirely lack a post or pillar extending downward therefrom to an connection point on the thoracic portion.

The impact diffusing system further includes a thoracic framework structured to cover at least a portion of a chest, upper back, and shoulders of the user, wherein the thoracic framework is attached to, or capable of being attached to, the at least two support bars of the headpiece cage in a manner that prevents movement of the headpiece cage relative to the thoracic framework. The thoracic framework may also be attached to the post extending downward from the face mask. The system may further include inner thoracic padding and an outer thoracic shell, and the thoracic framework may be disposed between the inner thoracic padding and the outer thoracic shell. Alternatively, the thoracic framework may be structured to attach to conventional shoulder pads. The thoracic framework may include structurally reinforcing bars forming polygonal shapes that surround the at least a portion of the chest, upper back, and shoulders of the user. The thoracic framework may be formed of a rigid, inflexible material, such as titanium, steel, or another metal or metal alloy, carbon fiber, or a suitably strong polymer.

In one aspect of the invention, the thoracic framework may include rigid portions and flexible portions. The flexible portions may be formed by hinges, reduced thickness portions, or slots or openings formed within selected regions of the framework.

The thoracic framework may be permanently attached to the headpiece cage. For example, the thoracic framework and the headpiece cage may be manufactured as a unitary piece. The headpiece cage and the thoracic framework may comprise, without limitation, stainless steel, titanium and/or carbon fiber.

Alternatively, the thoracic framework may be removably attached to the headpiece cage. In this embodiment, the thoracic framework may include at least three connector receptacles and the headpiece cage may include at least three connectors each configured to removably attach to a respective one of the thoracic framework connector receptacles. The support bars of the headpiece cage may include a first support bar that extends along the coronal plane from one side of the head adjacent to one shoulder, around the top of the head, to the other side of the head adjacent to the other shoulder, and a second support bar partially along the sagittal plane posterior to the head. A first connector may be disposed at a first end of the first support bar, a second connector may be disposed at a second end of the first support bar, and a third connector may be disposed at an end of the second support bar.

In another aspect, the cage may include two support bars, each of which extends from the upper position above the top of the user's head, along a plane that is between the coronal and sagittal planes, to the lower position that is near a respective trapezius area of the user posterior to the head. In this aspect, the headpiece cage may include three connectors, wherein one of the three connectors is at an end of a post extending from the face mask, and the other two connectors are at respective lower ends of the two support bars. Thus, the impact diffusing system of this embodiment may include at least three connection points between the thoracic framework and the headpiece cage. The term "connection point" as used herein refers to a location at which the headpiece cage and the thoracic framework are joined together in a manner that limits or prevents movement of the headpiece cage relative to the thoracic framework.

In yet another aspect, the headpiece cage may include four connectors, wherein none of the four connectors is at an end of a post extending from the face mask. In this aspect, a first support bar may extend along the coronal plane from one side of the head adjacent to one shoulder, around the top of the head, to the other side of the head adjacent to the other shoulder, with a connector at each end of this support bar. The headpiece cage may comprise a second support bar along the sagittal plane posterior to the head, connecting to the first support bar at a position approximately at the crown of the head. A third support bar may extend laterally around the back of the head and connecting at each end to the first support bar at a position approximately below the ears of the wearer, and at its midpoint to the lower end of the second support bar. Two posterior pillars are connected to the third support bar at a position to the right and to the left, respectively, of the medial plan of the wearer's head when the invention is in use. The posterior pillars extend from the third support bar in a direction simultaneously downward, laterally and posteriorly to connection points on the rear shoulders of the thoracic portion. Connectors may be disposed at each end of the first support bar and at the end of each of the two posterior pillars, and connector receptacles are disposed at appropriate connection points on the thoracic portion. In other embodiments, the headpiece cage and the thoracic portion may be made as a single unit, wherein the headpiece portion is not detachable from the thoracic portion.

The impact diffusing system may include inner headgear structured and sized to conform to the user's head and to fit inside the headpiece cage. The inner headgear may be sized and structured to be moveable relative to the headpiece cage. The inner headgear may include a friction-reducing outer coating that reduces friction when the inner headgear moves relative to the headpiece cage. Similarly, the headpiece cage may include a friction-reducing inner coating that reduces friction when the inner headgear moves relative to the headpiece cage. The inner headgear may include impact absorbing padding. The padding may be inflatable padding and/or smart material padding. Preferably the outer surface of the inner headgear does not contain any retaining stop, protrusion, projection, item of padding or other feature that is structured or effective to interact with a retaining stop, protrusion, projection, item of padding or other feature on the inside surface of the helmet portion worn by the wearer of the inner headgear to substantially restrict movement of the wearer's head within the helmet component during use.

In preferred embodiments a shell comprising an impact resistant material, such as, without limitation, a thermopolymer or carbon polymer may be firmly attached to the headpiece cage so as to cover at least the posterior portion of the wearer's head and a portion of the neck during use. Very preferably, preferably the shell is structured to provide ventilation to the head—particularly to the back of the head and/or neck between the collar of the thoracic portion and the lower margin of the helmet outer shell. For example, the shell may comprise a plurality of voids or vents defined in the back and/or sides thereof, preferably penetrating through the inner surface of the shell portion and any padding comprised on the inner surface of the headpiece cage. These voids or vents permit fresh air to cool the head and also provide sweat and water vapor to escape entrapment on the inner surface of the headpiece cage. Also, when the headpiece cage and thoracic portion are joined, a gap may preferably be defined between the lower margins of the shell and the collar of the thoracic portion, exposing the back of the upper neck to fresh air. In one embodiment the shell may be affixed to the headpiece portion with a lower margin thereof extending approximately along the axis defined by the third support bar; laterally around the back of the head. This arrangement permits heat and sweat to escape from the head under the posterior sections of the shell.

Another embodiment of the present invention is directed to an impact diffusing system for protecting a head of a user of the system, wherein the system includes a helmet component comprising a solid, rigid unitary piece structured to surround a top, a back, and sides of the user's head, such that ears of the user and at least a portion of a neck of the user are enclosed within the helmet component. The system further includes a rigid thoracic cage structured to cover at least a portion of a chest, upper back, and shoulders of the user, wherein the thoracic cage is attached to the helmet component in a manner that prevents movement of the helmet component relative to the thoracic cage. The thoracic cage may be attached to the helmet component via at least four connection points, which may include two front connection points that are anterior to a coronal plane, and two rear connection points that are posterior to the coronal plane. Embodiments having at least three connection points may include a connection point located at the front or the back of the user's body and positioned substantially on the sagittal plane, and two side connection points located on the sides of the user's body above the shoulders and near (or slightly anterior to or posterior to) the coronal plane. The connection points may be permanent connectors and the thoracic cage may be fixedly attached to the helmet component. Alternatively, the connection points may comprise quick-release connectors and the thoracic cage may be removably attached to the helmet component.

The thoracic cage and the helmet component may be made of substantially inflexible material. For example, the thoracic cage and the helmet component may be made of carbon fiber.

The system of this embodiment may also include inner headgear structured and sized to conform to the user's head, fit within the helmet component, move with the user's head, and move relative to the helmet component.

The system of this embodiment may also include inner thoracic padding and an outer thoracic shell, and the thoracic cage may be disposed between the inner thoracic padding and the outer thoracic shell. Alternatively, the thoracic cage may be structured to attach to conventional shoulder pads.

In accordance with another embodiment, the present invention is directed to an impact diffusing system for protecting a head of a user of the system, wherein the system includes a rigid thoracic framework structured to cover at least a portion of a chest, upper back, and shoulders of the user. The system further includes a headpiece cage structured to surround a top, sides, and back of the head. The cage includes at least two support bars extending from a top of the cage to a bottom of the cage, wherein top ends of the support bars are attached to each other, and bottom ends of the support bars are attached to the rigid thoracic framework in a manner that prevents movement of the headpiece cage relative to the thoracic framework. The cage further includes a plurality of rigid bars that are sized and structured to surround at least a portion of a forehead, a top, and sides of the head, wherein the plurality of rigid bars are coupled to the at least two support bars. Still further, the cage includes a face mask structured to enclose at least a portion of a face of the user, wherein the face mask is coupled to at least one of the support bars. The face mask may protrude anterior to a coronal plane and comprise a post extending downward from a bottom of the face mask from a central area of the face mask, such that the post is positioned anterior to a throat of the user. The post may be attached to the rigid thoracic framework, such that the headpiece cage and the thoracic framework are attached to each other at least at three attachment points. In other embodiments, the face mask may lack a post extending downward from a bottom portion thereof to the thoracic framework.

Other and further aspects and features of the invention will be evident from reading the following detailed description of the preferred embodiments, which are intended to illustrate, not limit, the invention.

BRIEF DESCRIPTION OF THE DRAWINGS

The foregoing and other aspects of embodiments are described in further detail with reference to the accompanying drawings, wherein like reference numerals refer to like elements and the description for like elements shall be applicable for all described embodiments wherever relevant:

FIGS. 13A and 13B are, respectively, front and close-up views of a connector for connecting a helmet portion to a thoracic portion of an impact diffusing system;

FIGS. 14A-14C are, respectively, front, back, and top-down views of a padded vest that is part of an impact diffusing system;

DETAILED DESCRIPTION

Figure 1A:
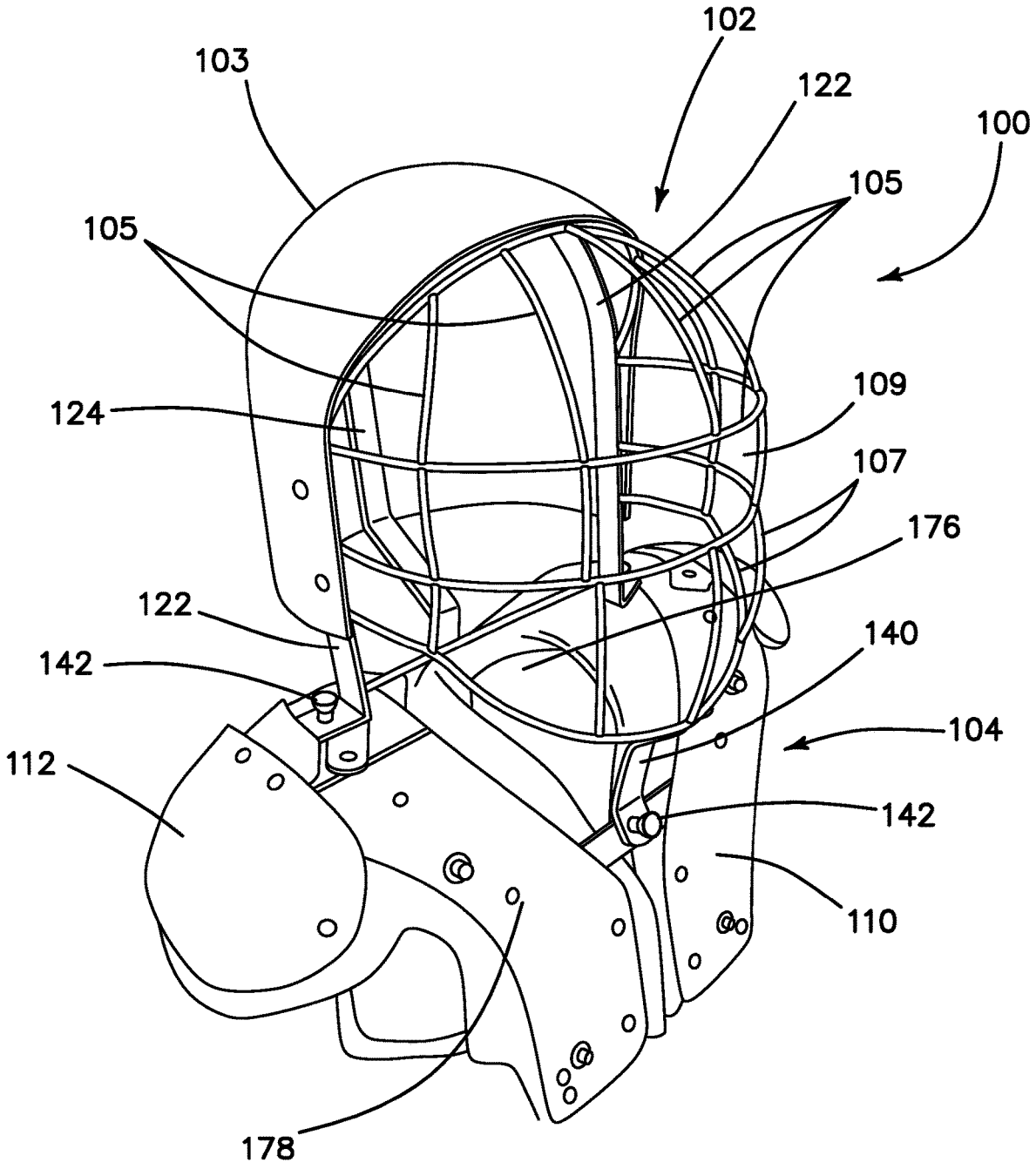
FIGS. 1A-1D are, respectively, perspective, side, front, and rear views of an impact diffusing system in accordance with one aspect of the present invention.

Disclosed herein is an impact diffusing system for protecting the head of a user of the system. Conventional helmets distribute impact forces throughout the helmet. With the system of the present invention, impact force is more evenly distributed throughout the system instead of being concentrated at the point of impact or distributed throughout just the helmet.

In one example, as shown in FIGS. 1A-1D, the system 100 includes a helmet portion 102 coupled to a thoracic portion 104. The helmet portion 102 surrounds, or encloses, the head of the user, and the thoracic portion 104 encloses a portion of the thoracic region of the user. The thoracic region is the part of the body that lies between the neck and the abdomen, and includes the breastbone, heart, lungs, ribs, thoracic vertebrae, chest, and shoulder girdle (i.e., the clavicle and scapula). In the embodiment shown in FIGS. 1A-1D, the thoracic portion 104 of the system 100 includes a chest portion 110 for covering part of the chest of the user, including the sternum and at least a portion of the pectoral area. The thoracic portion 104 further includes a shoulder portion 112 that surrounds a front, top, and back of the shoulders of the user, including the upper tip of the humerus, the shoulder girdle, and the front upper shoulders. A back portion 114 of the thoracic portion 104 covers a portion of the upper back of the user, including the rhomboid muscles and an upper part of the trapezius muscles.

The helmet portion 102 of the system 100 is attached to the thoracic portion 104 such that the helmet portion 102 is stationary and fixed relative to the thoracic portion 104. Lateral, posterior, and anterior movement of the helmet portion 102 relative to the thoracic portion 104 is at least limited, if not eliminated. In this manner, rather than resting on the user's head, like a conventional helmet, the helmet portion 102 of the system 100 rests upon the thoracic portion 104 so that all, or substantially all, of the weight of the system 100 is applied to the user's thoracic region. There is space between the inner surface of the helmet portion 102 and the user's head so that the user's head may move relative to the helmet potion 102. The user's head may rotate side to side as well as up and down within the helmet portion 102. Preferably, the user's head is able to turn up to about 90 degrees to the left and to the right, relative to center. Preferably, the user's head is able to bend towards the chest up to about 60 degrees relative to neutral head position, and to tilt back up to about 70 degrees relative to neutral head position.

The helmet portion 102 of this example comprises a resilient shell 103 substantially surrounding the back and sides of the wearer's head. The outer shell 103 provides hard, resilient outer protection and shock absorption and may be made of a durable polymer, such as polycarbonate. The inner framework of the helmet portion 102 includes main support bars 122 and 124, and the outer shell 103 is fixedly attached (e.g., by screws, bolts, a strong adhesive, or other such fasteners) to the outside surfaces of the main support bars 122, 124. Thus, the force of impacts to the outer shell 103 is deflected to support bars 122, 124. In some examples, the user's field of view may be partially obstructed above and below the eyes by rigid bars of the face mask portion of the helmet portion 102, but not by the outer shell 103. That is, the outer shell 103 is disposed outside of the user's peripheral vision when the user is looking straight ahead. The outer shell 103 surrounds a face opening that is wider, and optionally higher, than that of a conventional football helmet. In some, currently less preferred examples, at least a portion of the outer surface of the helmet portion 102 may comprise a soft padding overlying a hard shell, as described above.

Figure 2A:
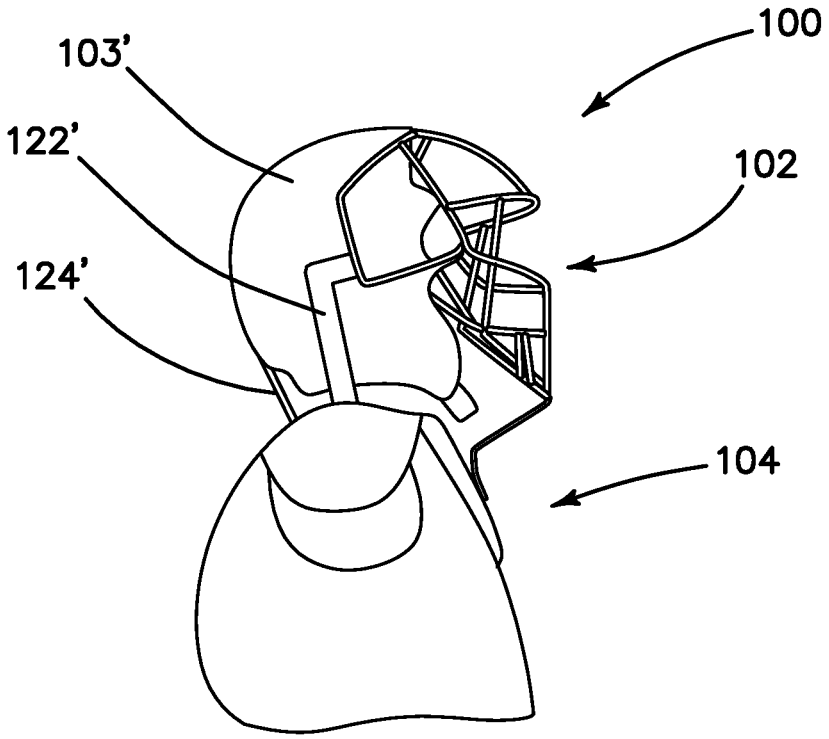
FIGS. 2A and 2B are, respectively, side and front views of an impact diffusing system in accordance with another aspect of the present invention.
Figure 2B:
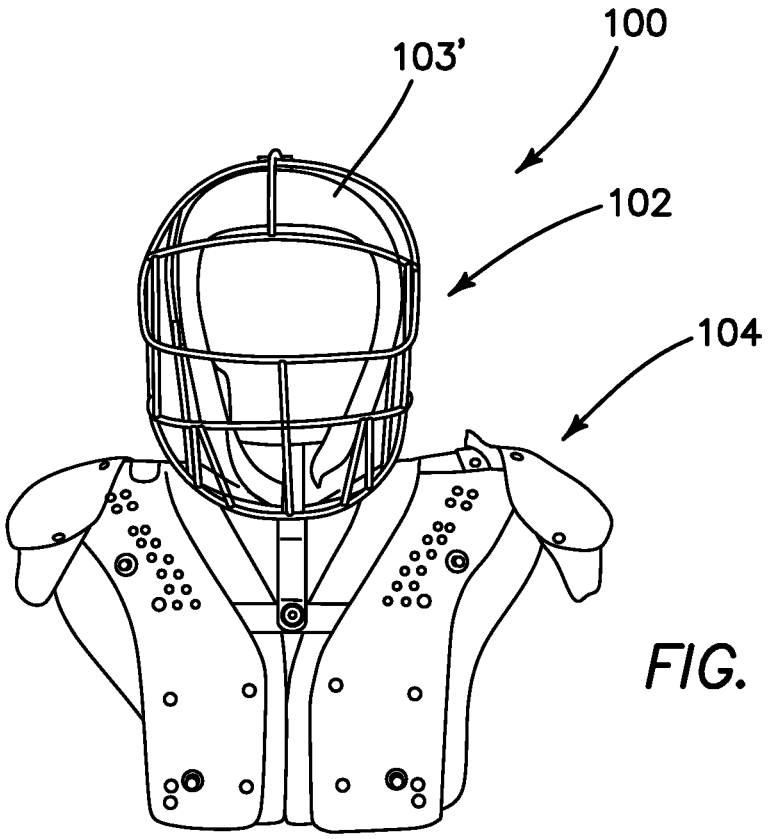

In yet another example, rather than having a hard shell applied to the outer surface of the helmet portion 102, the framework of the helmet portion 102 may be sized and structured to be attached to a conventional helmet. For example, as shown in FIGS. 2A and 2B, the framework of the helmet portion 102 is sized and structured to attach to the outside of a conventional football helmet that has been modified to fit within the system 100. In the example shown in FIGS. 2A and 2B the main support bars 122', 124' are coupled to the outside of a conventional football helmet shell 103'. A face mask 107' and a plurality of rigid bars 105' surround the user's face and are attached to the main support bars 122', 124' and to the helmet shell 103'.

Referring back to FIGS. 1A-1D, the front of the helmet portion 102 may comprise, for example, a "birdcage-style" face mask 107 covering a portion of the face opening. The face mask 107 is structured and designed in a manner similar to standard football face masks (except preferably larger), or face masks containing any suitable number of bars in any other shape sufficient to provide protection to the wearer's face. The face mask 107 encloses at least the lower portion of the face of the user, and protrudes anterior to the front of the user's face. The bars of the face mask 107 may be comprised of any sufficiently rigid material, such as metal and/or hard plastic. For example, the bars of the face mask 107 may be made of plastic- and/or elastomer-covered metal, stainless steel, titanium, carbon fiber, or any combination thereof. The face mask 107 is strongly affixed to the support bars 122, 124. In an alternate embodiment, the face mask 107 may be joined to the support bars 122, 124 with one or more hinges or pivot mounts, such that the face mask 107 may be lifted upwards, similar to a face guard on a suit of armor helmet, or opened sideways, like a birdcage door, upon the disconnection of a strong latch preventing unintentional opening of the face mask 107. Other face masks, such as transparent face masks, may be used in other examples of the present invention, such as in racing or military applications, in which routine risk of blows directly to the face are not as common as in football. The face mask 107 prevents the user's face from sustaining a direct blow. Rather, the force of an impact sustained by the face mask 107 will be transferred to the support bars 122, 124 and to the thoracic portion 104 of the system 100.

Figure 1B:
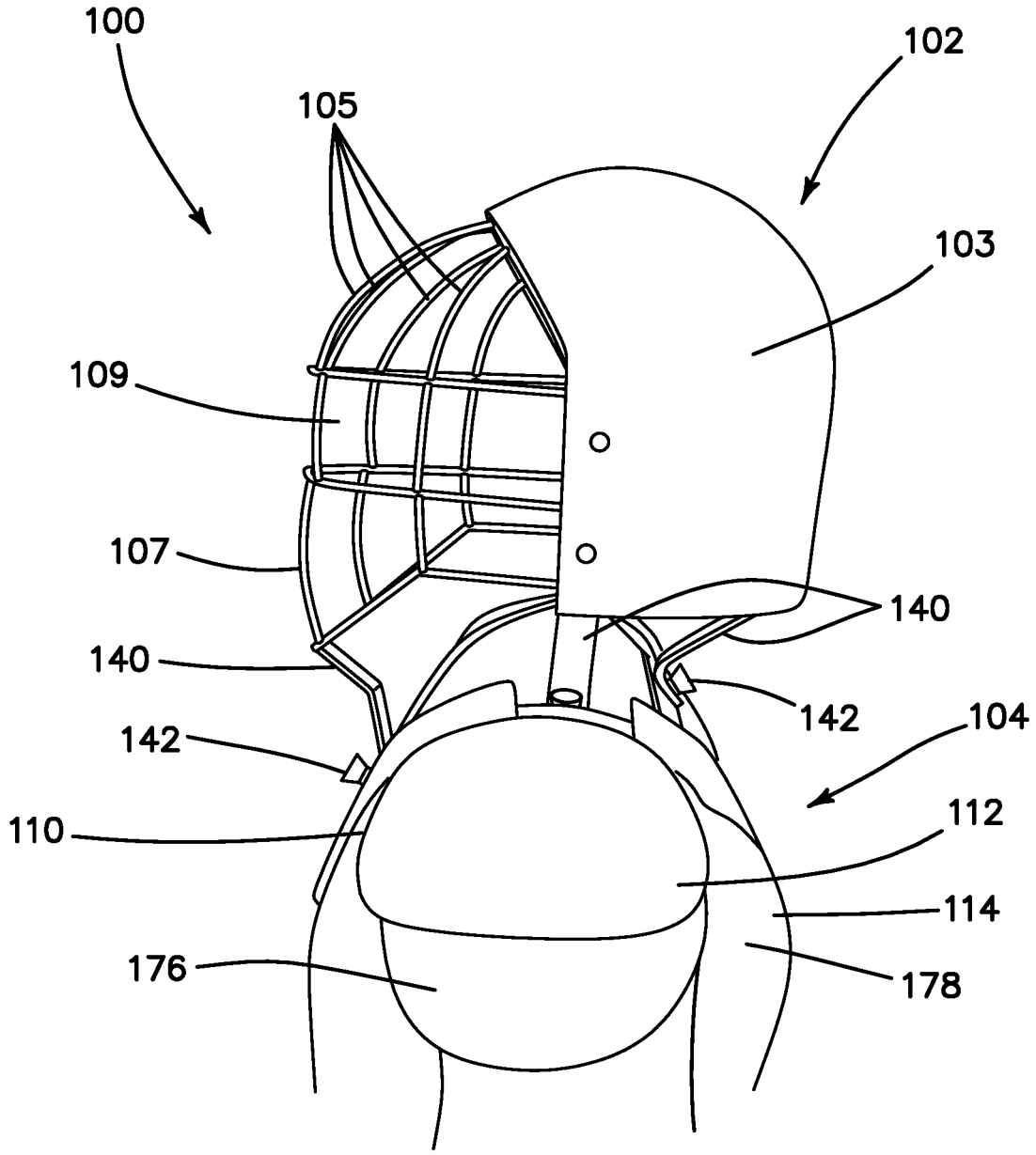
Figure 1C:
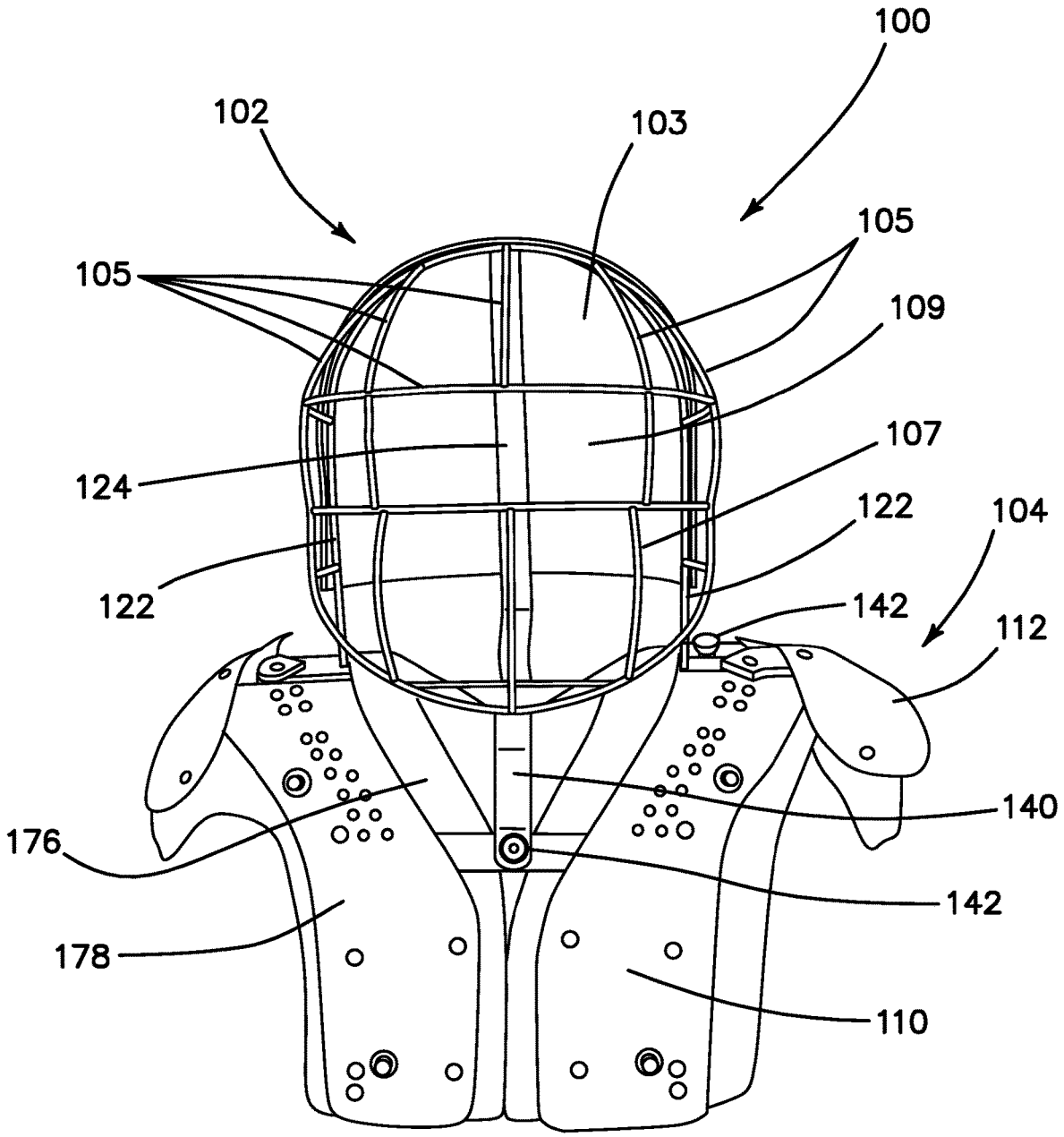
Figure 1D:
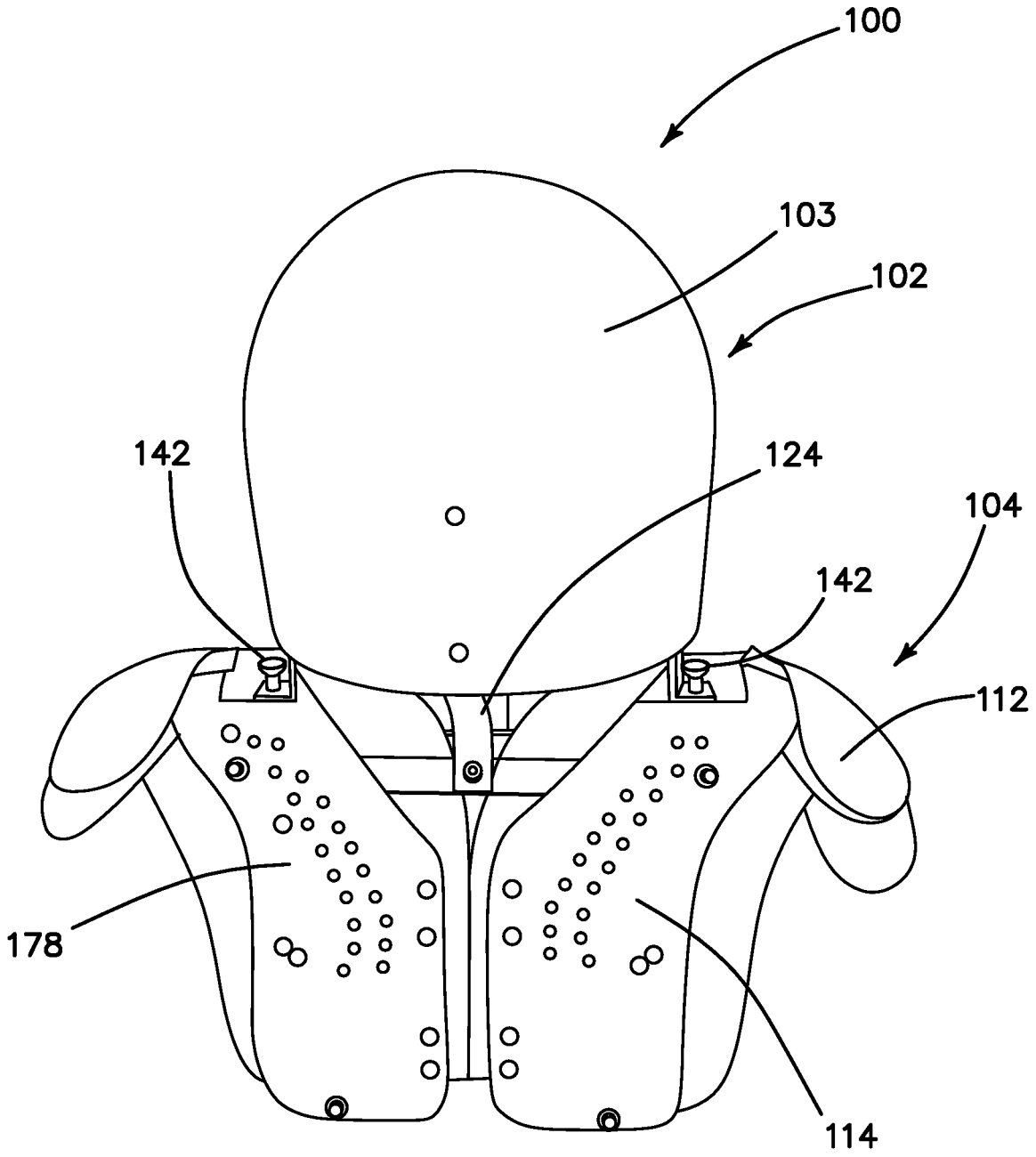

As shown in e.g., FIG. 1B, face mask 107 includes a face mask pillar 140 that extends downward from the bottom of the face mask 107 and terminates in a connector 142 for connecting the pillar 140 to the thoracic portion 104. The connector 142 at the bottom of the face mask pillar 140 is positioned such that the connection between the pillar 140 and the thoracic portion 104 will be near the user's sternum. The face mask pillar 140 is in about the center of the face mask 107 and is positioned anterior to the user's throat.

Figure 3:
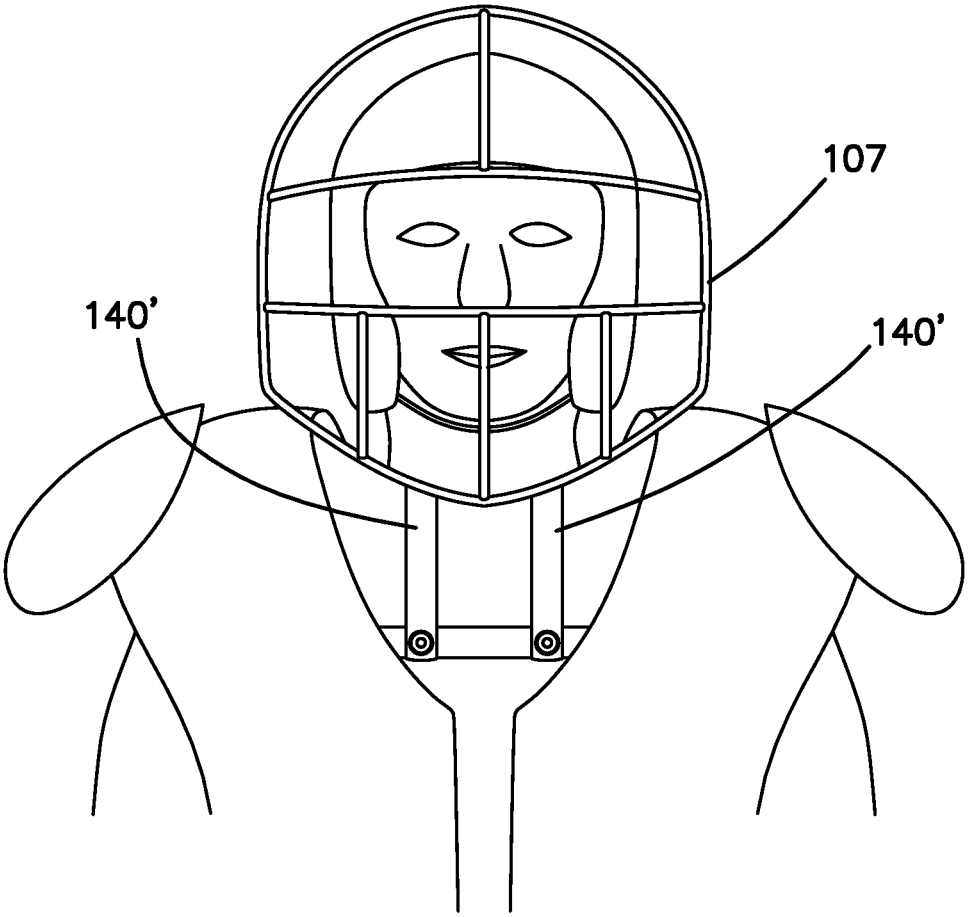
FIG. 3 is a front view of an impact diffusing system in accordance with yet another aspect of the present invention.
Figure 4A:
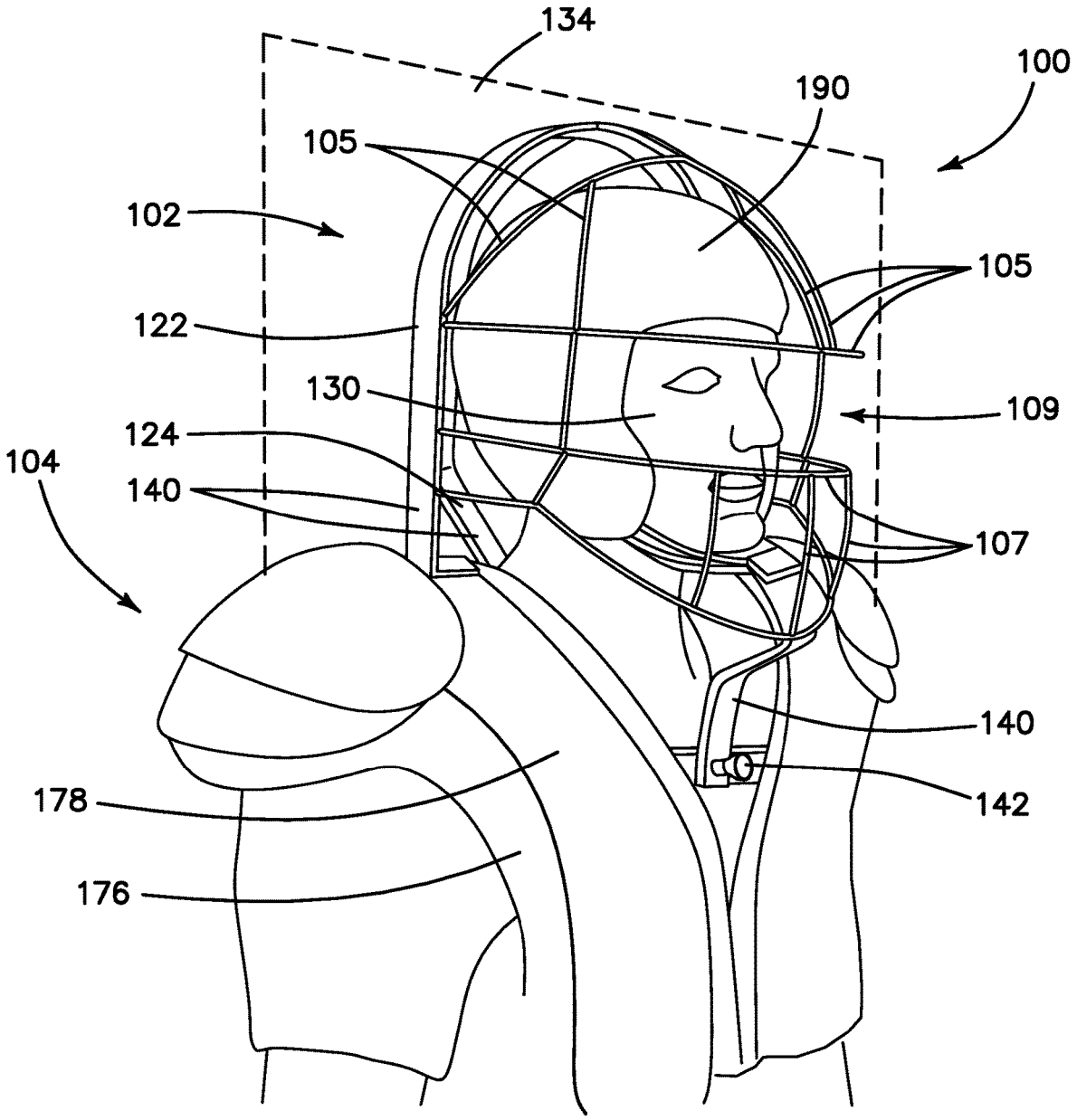
FIGS. 4A-4D are, respectively, perspective, side, front, and rear views of the impact diffusing system depicted in FIGS. 1A-1D with the outer shell removed.
Figure 4B:
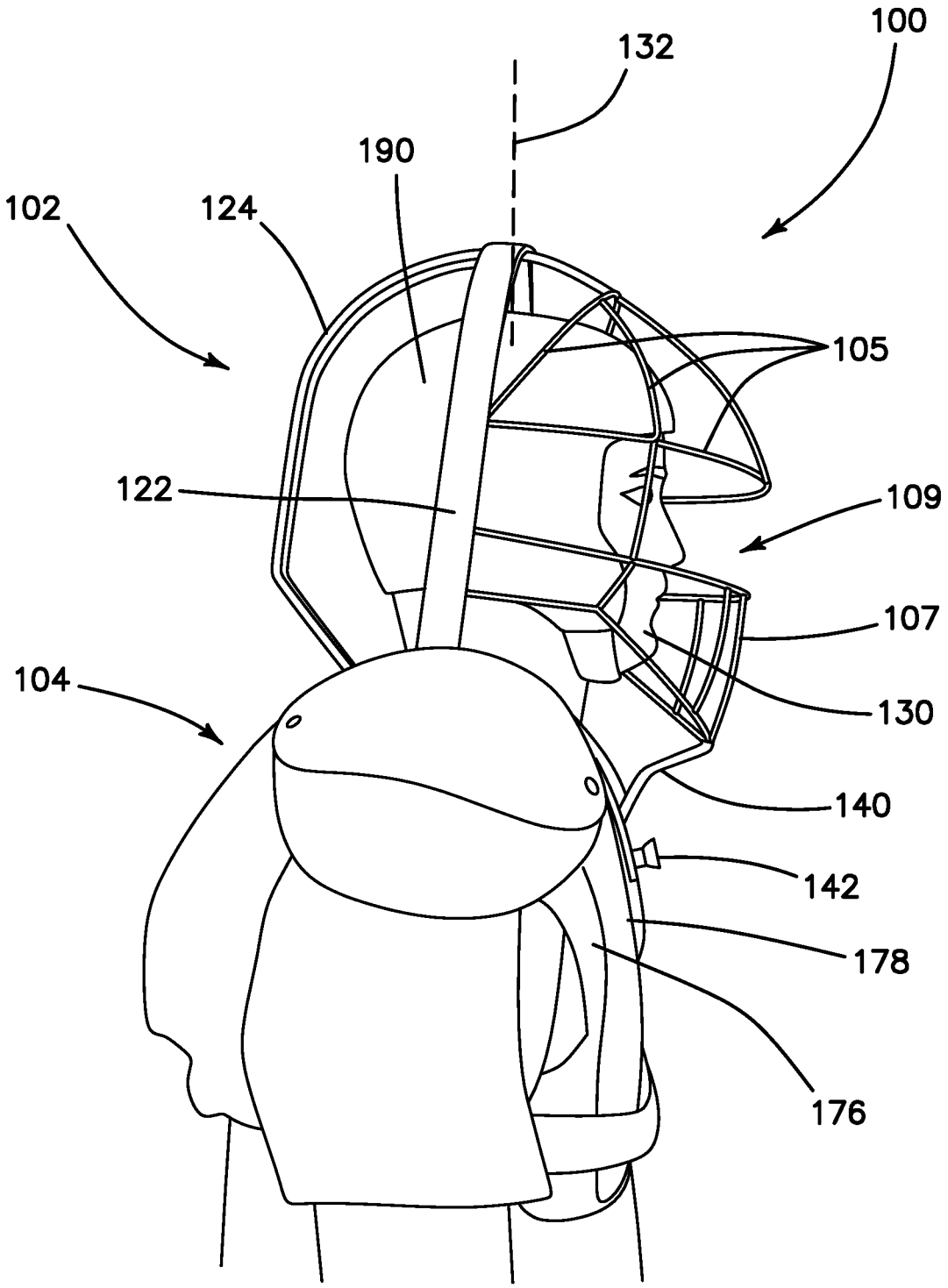
Figure 4C:
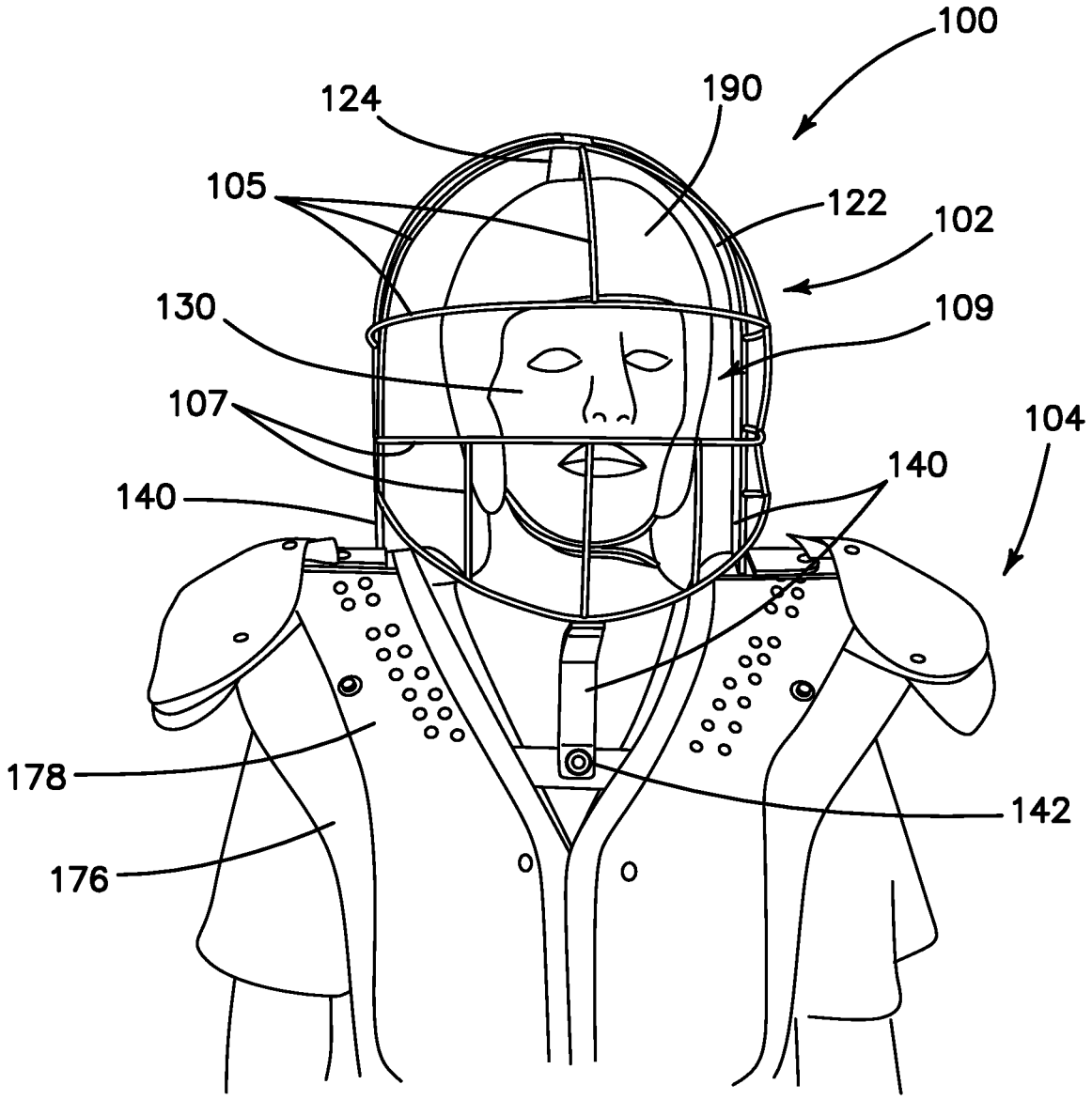
Figure 4D:
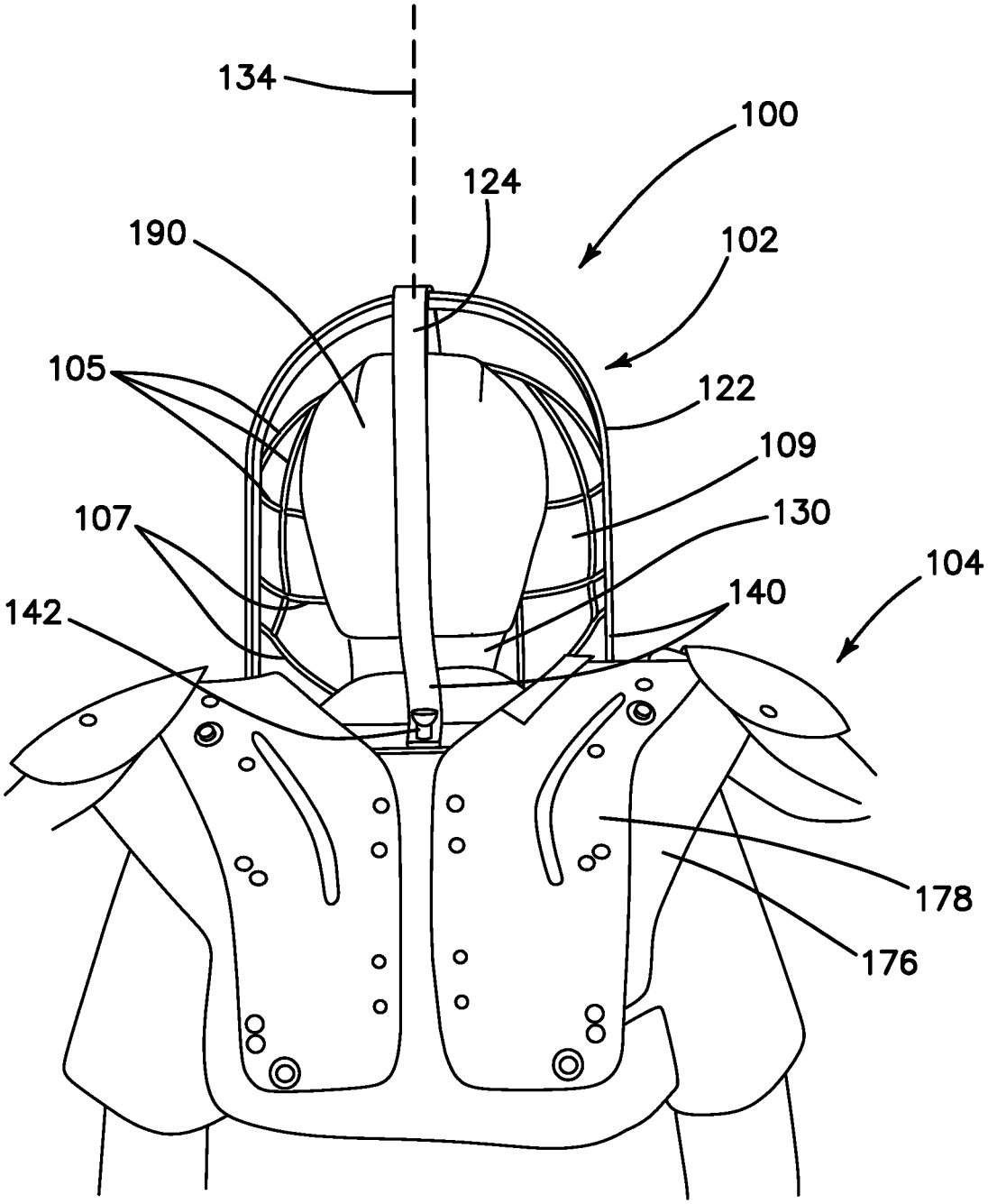

In alternate embodiments, the face mask 107 may include more than one face mask pillar. For example, the embodiment shown in FIG. 3 is similar to that shown in FIGS. 1A-1D, except that the face mask 107 includes two face mask pillars 140'. Each of the face mask pillars 140' extends downward from the bottom of the face mask 107 and is positioned in the central area on either side of the center of the face mask 107, anterior to the user's throat. Those of ordinary skill in the art will recognize that the face mask 107 may include any suitable number and configuration of face mask pillars 140 extending downwardly from the bottom of the face mask 107. Those of ordinary skill in the art will also recognize that the face mask 107 may not include a face mask pillar at all, as discussed in more detail below with reference to FIGS. 6A and 6B.

Referring back to FIGS. 1A-1D, the helmet portion 102 of the system 100 surrounds most of the head, with the exception of a front window (in this case rectangular in shape) 109 that provides the user with a visual field. The front window 109 does not include any bars. The front window 109 may be similar to that of a conventional helmet. However, the size (particularly, but not necessarily exclusively, the width) of the face mask 107, and the corresponding front window 109 of the helmet portion 102 are each preferably larger and/or wider than traditional football helmets, since the wearer's head is preferably not restricted from moving substantially within the interior of the helmet portion 102. The helmet portion 102 may optionally include a visor (not shown) for covering the window 109 and protecting the eyes of the user.

The helmet portion 102 further includes a plurality of rigid bars 105 near the user's forehead. These bars 105 form a cage-like structure for protecting the front of the user's head, including the forehead, the forward portion of the top of the head, and the upper portion of the sides of the head. The plurality of rigid bars 105 surrounding the forehead are attached to the support bars 122, 124 in order to deflect the force of impacts near the front of the head to the support bars 122, 124 and to maintain the structural integrity of the helmet portion 102. In this manner, the plurality of bars 105 prevents the forehead from sustaining a direct blow.

Referring now to FIGS. 4A-4D, the system 100 is depicted with the outer shell 103 removed in order to more clearly show the headpiece cage in the helmet portion 102. The cage of the helmet portion 102 includes the two support bars 122, 124 surrounding the back and sides of the user's head, the plurality of rigid bars 105 enclosing the forehead, top and sides of the user's head, and the face mask 107 for protecting the face of the user 130. The support bars 122, 124 are rigid and function as the main struts and as major structural elements of the helmet portion 102. The support bars 122, 124 are wider than the other bars 105, 107 of the helmet portion 102. Most of the force of an impact to the helmet portion 102 will be transferred to the support bars 122, 124, which will then transfer the force of the blow to the thoracic portion 104 of the system 100, thereby avoiding injury or unattenuated impact to the user's head.

As shown in FIGS. 4A-4D, the two support bars 122, 124 include a first support bar 122 along the coronal plane 132 and a second support bar 124 along the sagittal plane 134. The coronal plane 132 is a vertical plane that is perpendicular to the ground and that divides the human body into ventral and dorsal (or belly and back) sides (see FIG. 4B). The sagittal plane 134 is a vertical plane that is perpendicular to the ground and to the coronal plane 132 and that divides the human body evenly into left and right sides (shown in FIGS. 4A and 4D). The first support bar 122 has an arch shape, or an inverted "U" shape. The ends of the first support bar 122 form pillars 140 that protrude from the bottom of the helmet portion 102 to a lower position below the jaw line of the user. The pillars 140 are coupled to the thoracic portion 104 in a location adjacent to the tops of the user's shoulders. For example, these side connection points between the helmet portion 102 and the thoracic portion 104 are near the upper tip of the humerus of the user, and are on the same horizontal plane as each other. The first support bar 122 curves over the top of the user's head, with the top of the first support bar 122 being positioned above the top of the user's head.

The second support bar 124 is shaped like half of an arch or half of an inverted "U." The bottom end of the second support bar 124 forms a rear pillar 140 that protrudes from the bottom of the helmet portion 102 and that connects to the thoracic portion 104 near the upper back or bottom neck region of the user 130. For example, this rear connection point between the helmet portion 102 and the thoracic portion 104 is near the vertebrae of the user 130 at approximately the bottom of the cervical vertebrae or the top of the thoracic vertebrae. Thus, the rear connection point is elevated relative to the front connection point between the face mask 107 and the thoracic portion 104, as can be seen clearly in FIGS. 1B and 4B. The connection points between the helmet portion 102 and the thoracic portion 104 are positioned below the user's line of sight, and preferably below the jaw line of the user. The support bars 122, 124 are coupled to each other above the top of the user's head in order to reinforce each other and more evenly distribute impact forces.

The plurality of pillars 140 are integrated as part of the helmet portion 102 itself. For example, the pillars 140 are formed as an integral part of the helmet portion 102. The headpiece cage, including the bars 105, the face mask 107, the support bars 122, 124, and the pillars 140, comprises a suitably strong and lightweight material, such as, without limitation, one or more of titanium, a titanium alloy, a non-titanium metal, a nanostructured ceramic, a nanostructured metal or metal alloy, a thermopolymer, or a carbon polymer. In the present invention, the pillars 140 are preferably anchored below neck level to the chest, shoulders and upper back (over the scapulae). By attaching the pillars 140 in this location, a sliding horizontal blow is concentrated on the upper body rather than the neck, and the force is distributed over a larger surface than the neck and collarbone.

Figure 5A:
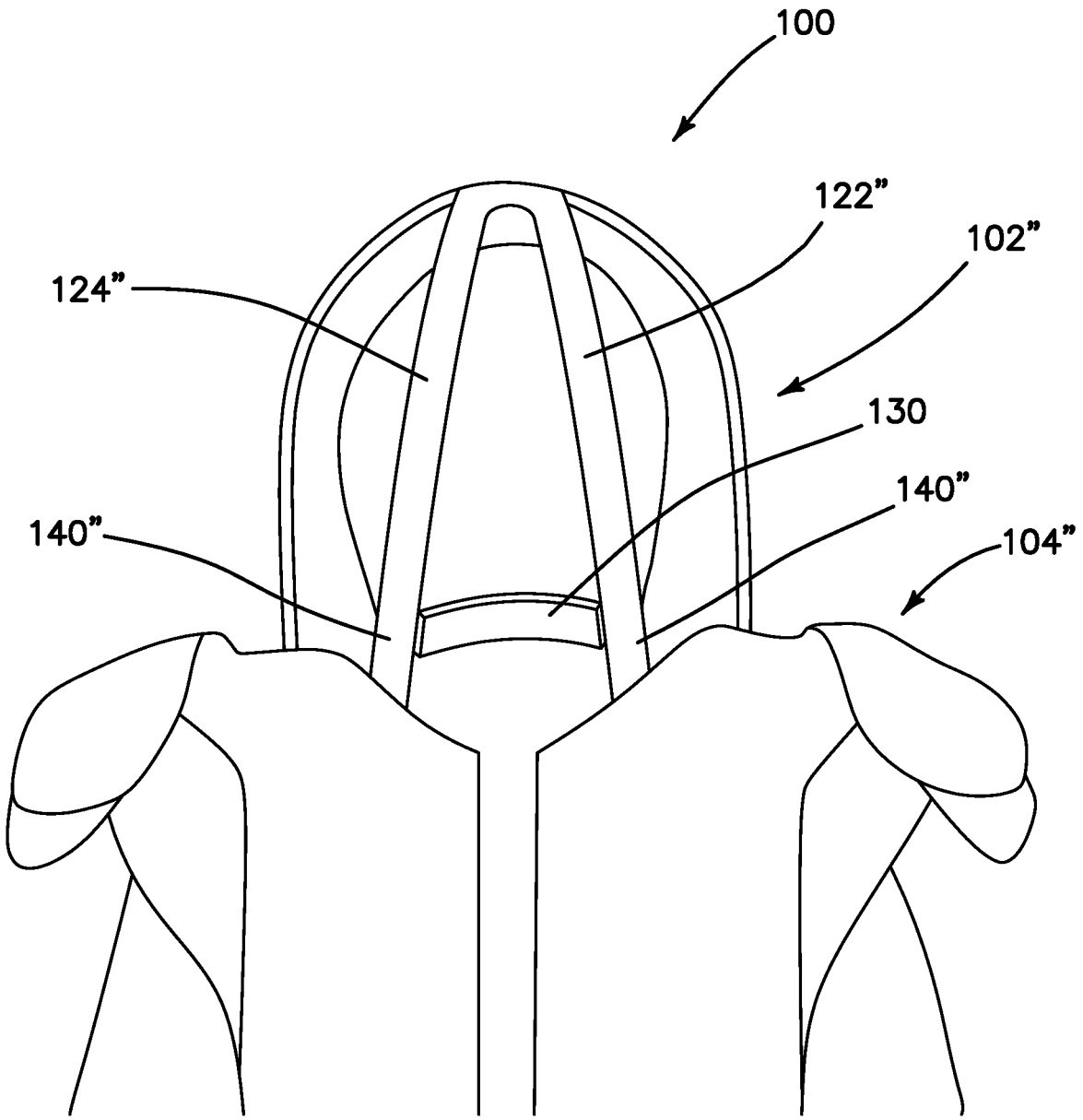
FIGS. 5A and 5B are, respectively, rear and side views of an impact diffusing system in accordance with still another aspect of the present invention.
Figure 5B:
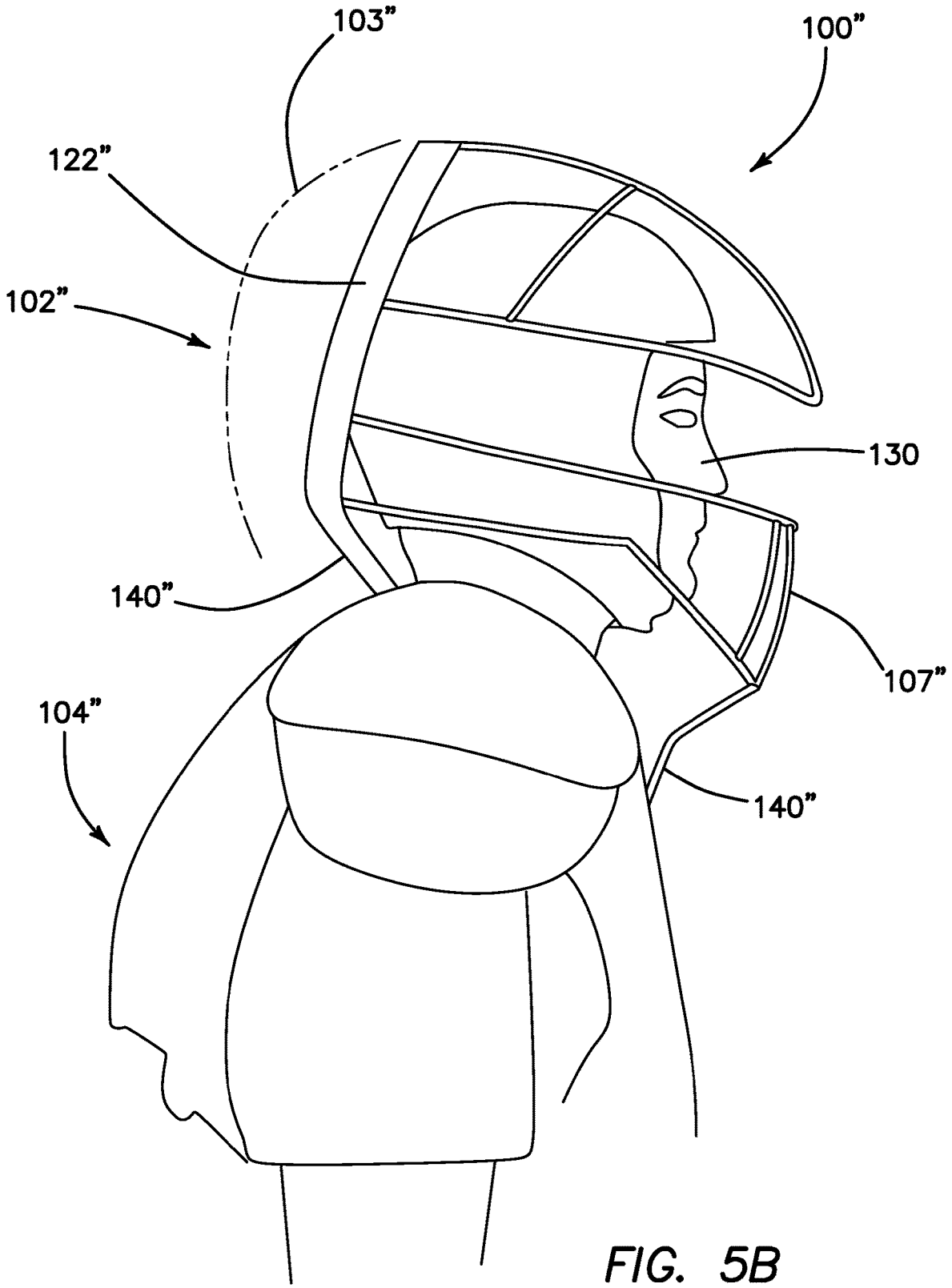

In an alternate embodiment, shown in FIGS. 5A and 5B, the system 100" is substantially similar to the system 100 shown in FIGS. 1A-1D and FIGS. 4A-4D, except that the support bars 122", 124" in the helmet portion 102" are disposed between the coronal and sagittal planes 132, 134. That is, the support bars 122", 124" extend from a position above the top of the user's head and terminate at a lower position that is posterior to the head and near the trapezius muscle or the scapula of the user 130. As shown in FIG. 5B, the outer shell 103" (shown in phantom) of the helmet portion 102" extends posterior to the support bars 122", 124". In this embodiment, the helmet portion 102" includes only three pillars 140" that are coupled to the thoracic portion 104" of the system 100". One of the pillars 140" protrudes from the bottom of the face mask 107", and the other two pillars 140" are at the ends of the support bars 122", 124".

Figure 6A:
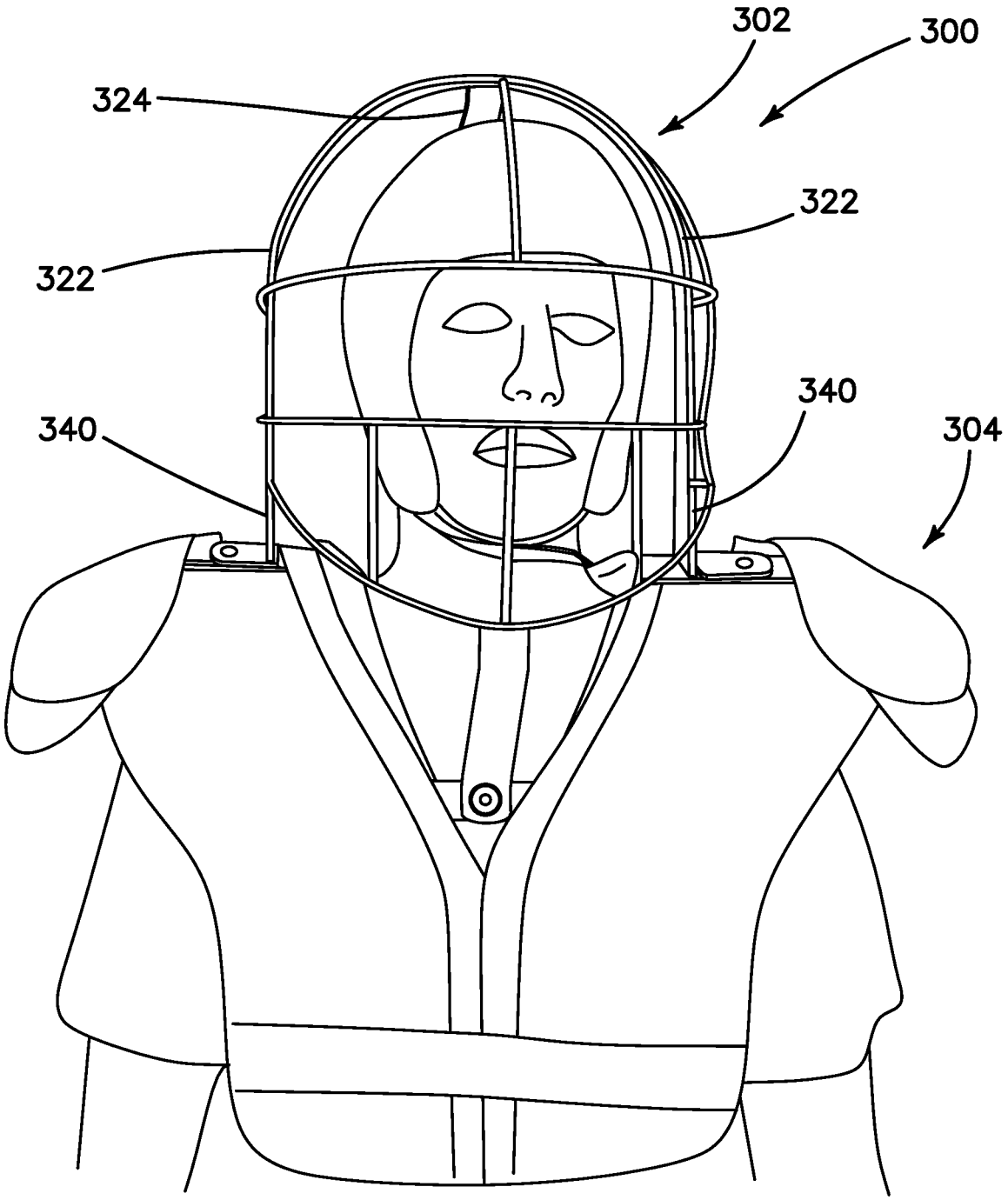
FIGS. 6A and 6B are, respectively, front and side views of an impact diffusing system in accordance with still another aspect of the present invention.
Figure 6B:
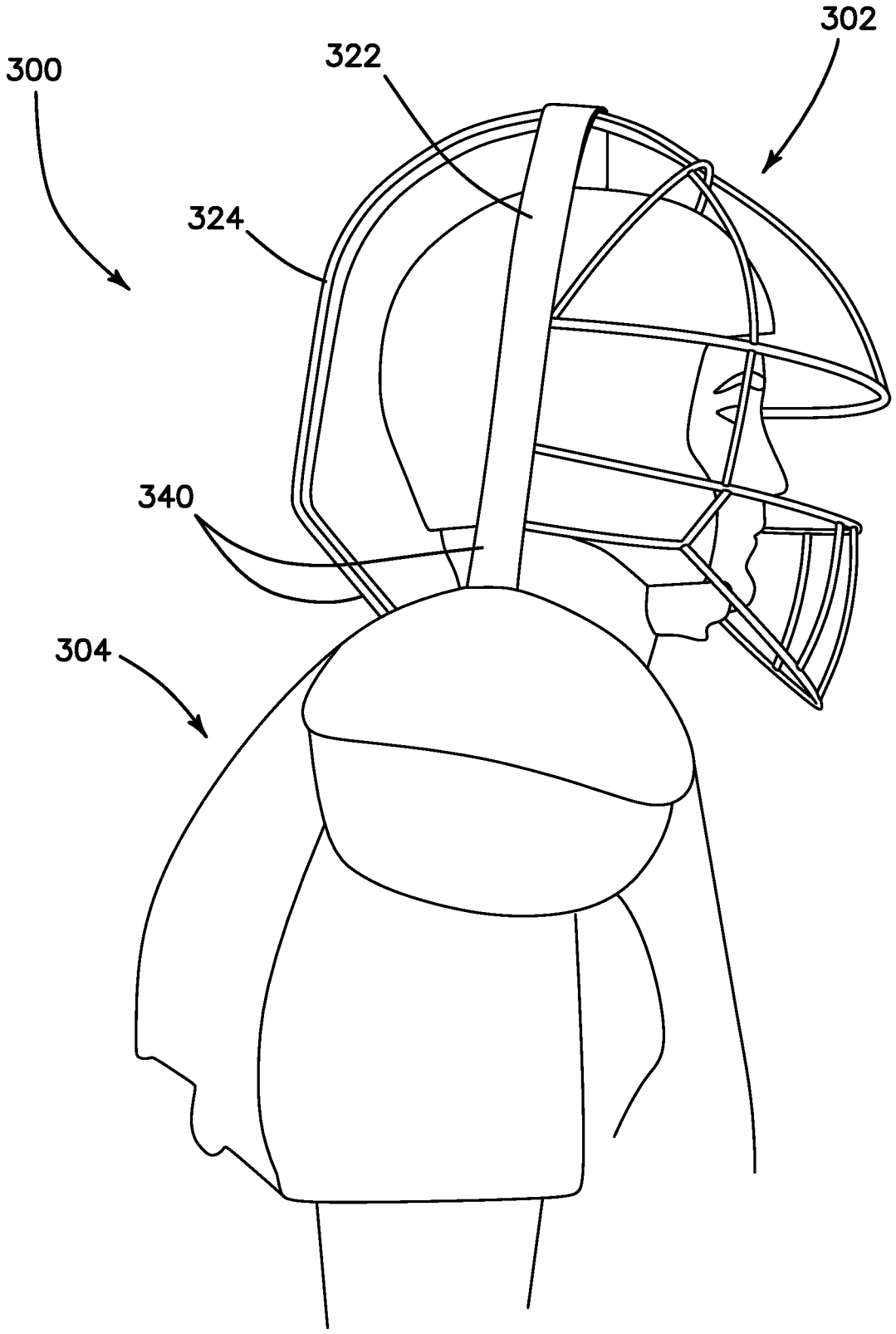

In another alternate embodiment, shown in FIGS. 6A and 6B, the system 300 is substantially similar to the system 100 shown in FIGS. 1A-1D and FIGS. 4A-4D, except that the face mask pillar is removed. Thus, the helmet portion 302 is coupled to the thoracic portion 304 through pillars 340 at the ends of the support bars 322, 324. That is, there are only three connection points between the helmet portion 302 and the thoracic portion 304. However, the embodiments shown in FIGS. 1A-6B are not intended to limit the scope of the invention, and one of ordinary skill in the art will recognize that there may be any number of pillars and support bars that may be arranged in many different configurations in order to couple the helmet portion to the thoracic portion in a manner that prevents movement of the helmet portion relative to the thoracic portion.

Referring back to the system 100 in FIGS. 1A-1D and FIGS. 4A-4D, the helmet portion 102 is coupled to the thoracic portion 104 in a manner that restricts or eliminates lateral, anterior, and posterior movement of the helmet portion 102 relative to the thoracic portion 104. As discussed above, the helmet portion 102 of the example shown in FIGS. 1A-1D and 4A-4D has four pillars 140 joining the helmet portion 102 to the thoracic portion 104 and extending substantially downward from the helmet portion 102. In particular, the helmet portion 102 of this example includes one pillar extending from the bottom of the central area of the face mask 107, one pillar positioned behind the user's head, and one pillar positioned adjacent to the tops of each of the user's shoulders. In other examples, as discussed above, the number of pillars may vary. The pillars 140 are preferably strong and may be substantially inflexible. By "substantially inflexible" or "substantially rigid" is meant that elements of the system are strong and resilient enough to withstand the forces expected to be encountered in the sport or activity during which the system is used without breaking or flexing more than about 0.25 inches, or about 0.5 inches or about 1 inch. The pillars 140 are connected within the helmet portion 102 in such a manner so as to distribute the force of a blow to any portion of the helmet portion 102 among the plurality of pillars 140. The lower portion of each of the pillars 140 preferably comprises a connector component 142 structured to join securely and firmly within a corresponding connector receptacle of the thoracic portion 104. The connector receptacle of the thoracic portion 104 is attached to, or integrated as part of, the framework of the thoracic portion 104. Alternatively, the connector receptacle may be part of the helmet component 102, and the connector component 142 may be part of the thoracic portion 104. Very preferably, the connector component 142 and the connector receptacle of the thoracic portion 104 are structured to be rapidly releasable, thereby permitting the helmet portion 102 to be quickly detached from the thoracic portion 104 and removed by the player or by a doctor, coach, or medical technician, if desired. This may be advantageous in the event of an injury to the user of the system 100.

Figure 7A:
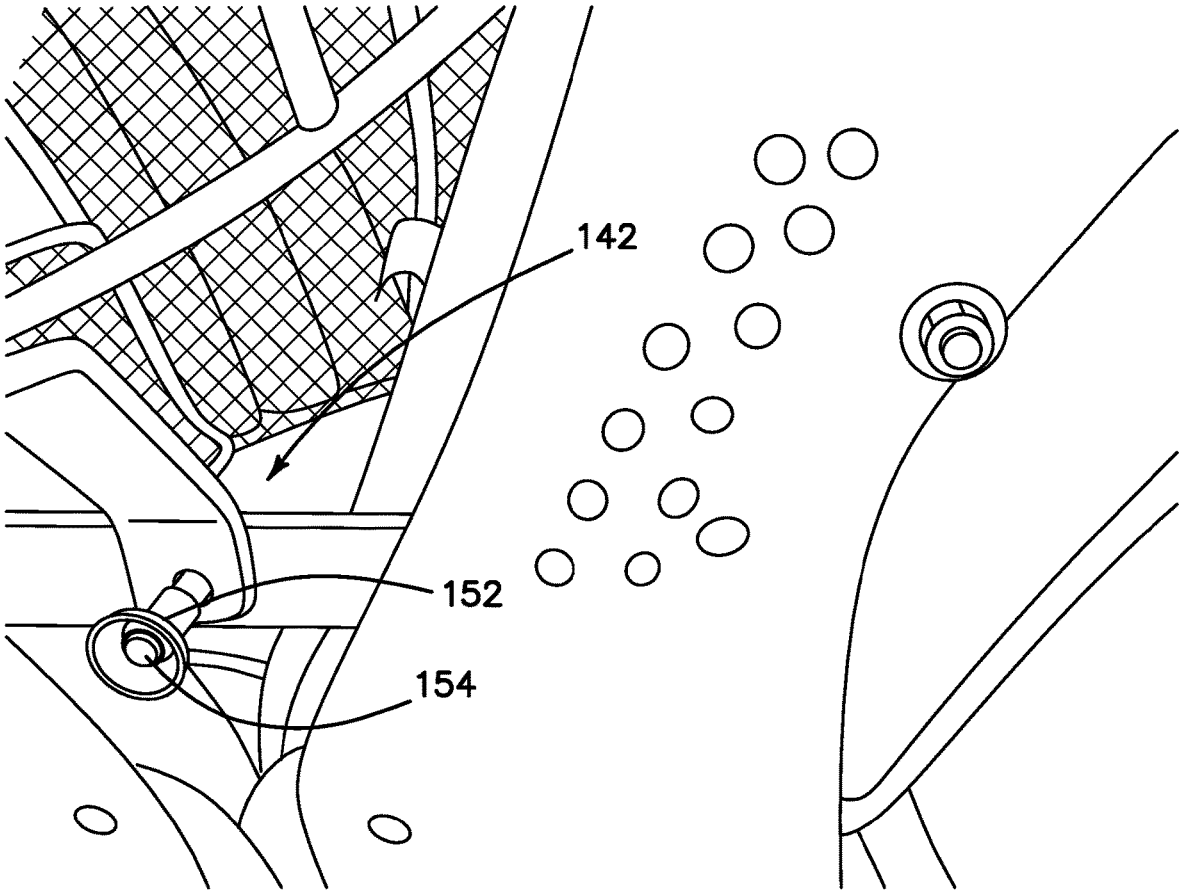
FIGS. 7A and 7B are, respectively, front perspective and side perspective views of an exemplary connector for use in the impact diffusing system.
Figure 7B:
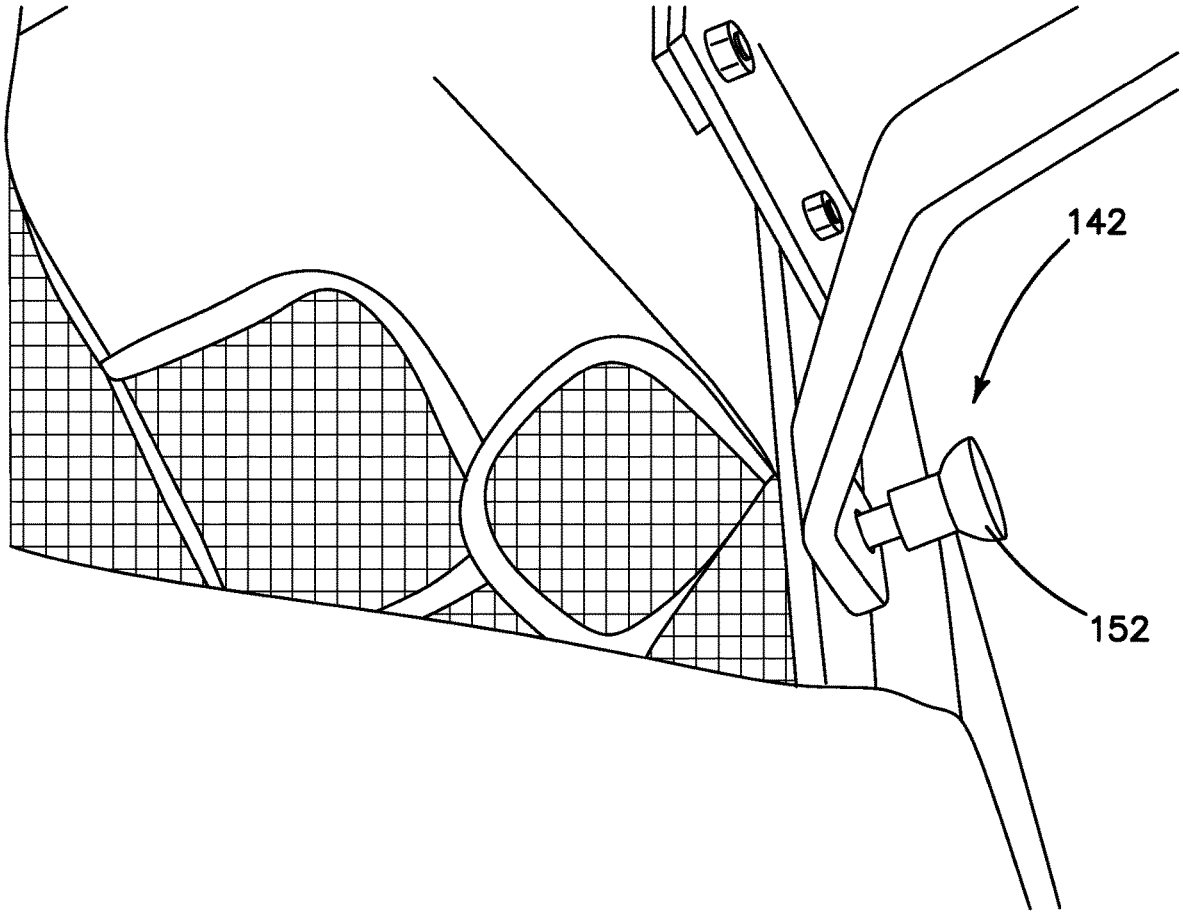

Although those of ordinary skill in the art will recognize that any type of connector may be used to couple the helmet portion 102 to the thoracic portion 104, an exemplary "pin-type" quick release mechanism is depicted in FIGS. 7A and 7B. In this example, the connectors 142 include an annular finger grip 152 and a central push button 154. When the annular finger grip 152 is grasped with the fingers and the push button 154 is depressed with the thumb of the same hand, the connector 142 disengages from the connector receptacle on the thoracic portion 104. When the push button 154 is released, the connector 142 engages. As such, using such a connector 142, the helmet portion 102 and the thoracic portion 104 can quickly be separated by depressing the push button 154 relative to the finger grip 152 and pulling the connector 142 away from the connector receptacle, so that it disengages from the connector receptacle of the thoracic portion 104 of the system 100.

Figure 8A:
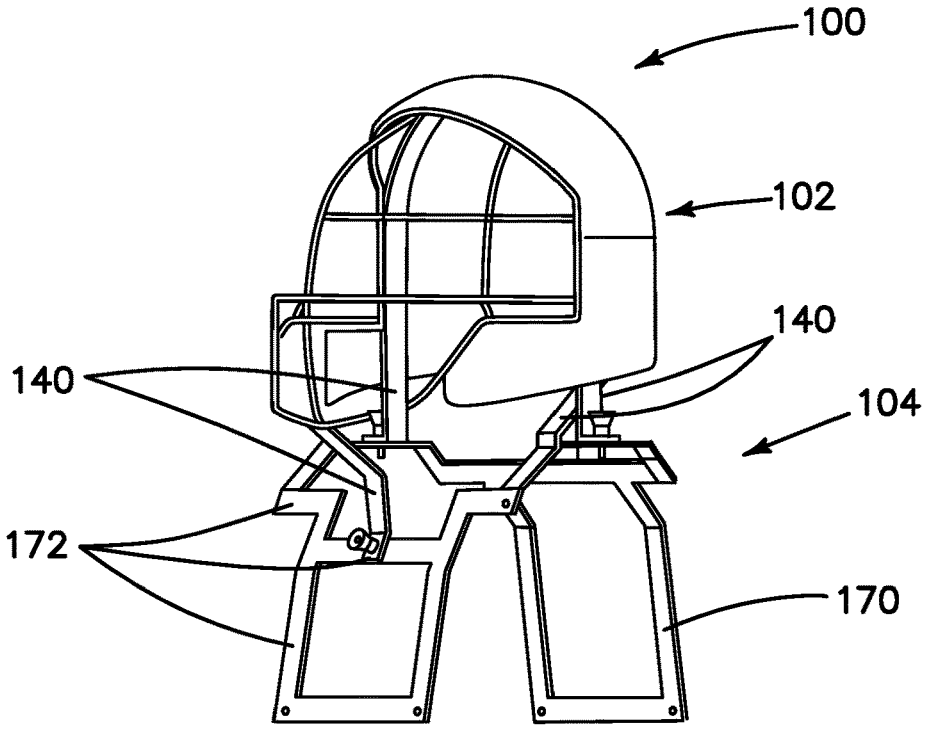
FIGS. 8A and 8B are, respectively, perspective and side views of on example of a thoracic framework of the impact diffusing system.
Figure 8B:
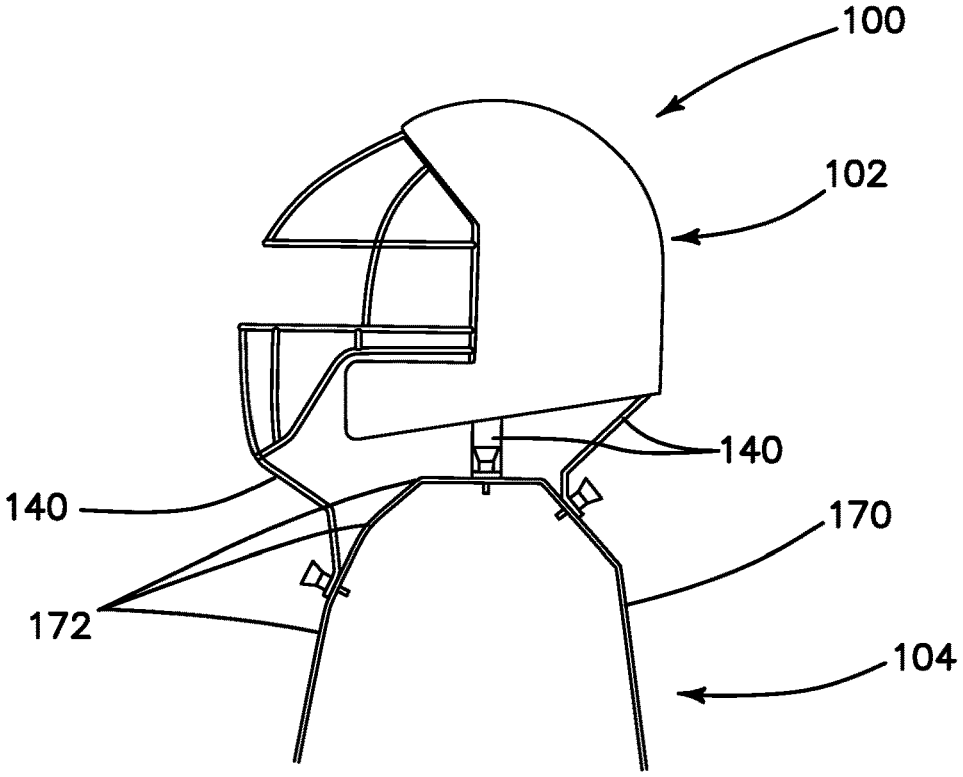
Figure 9A:
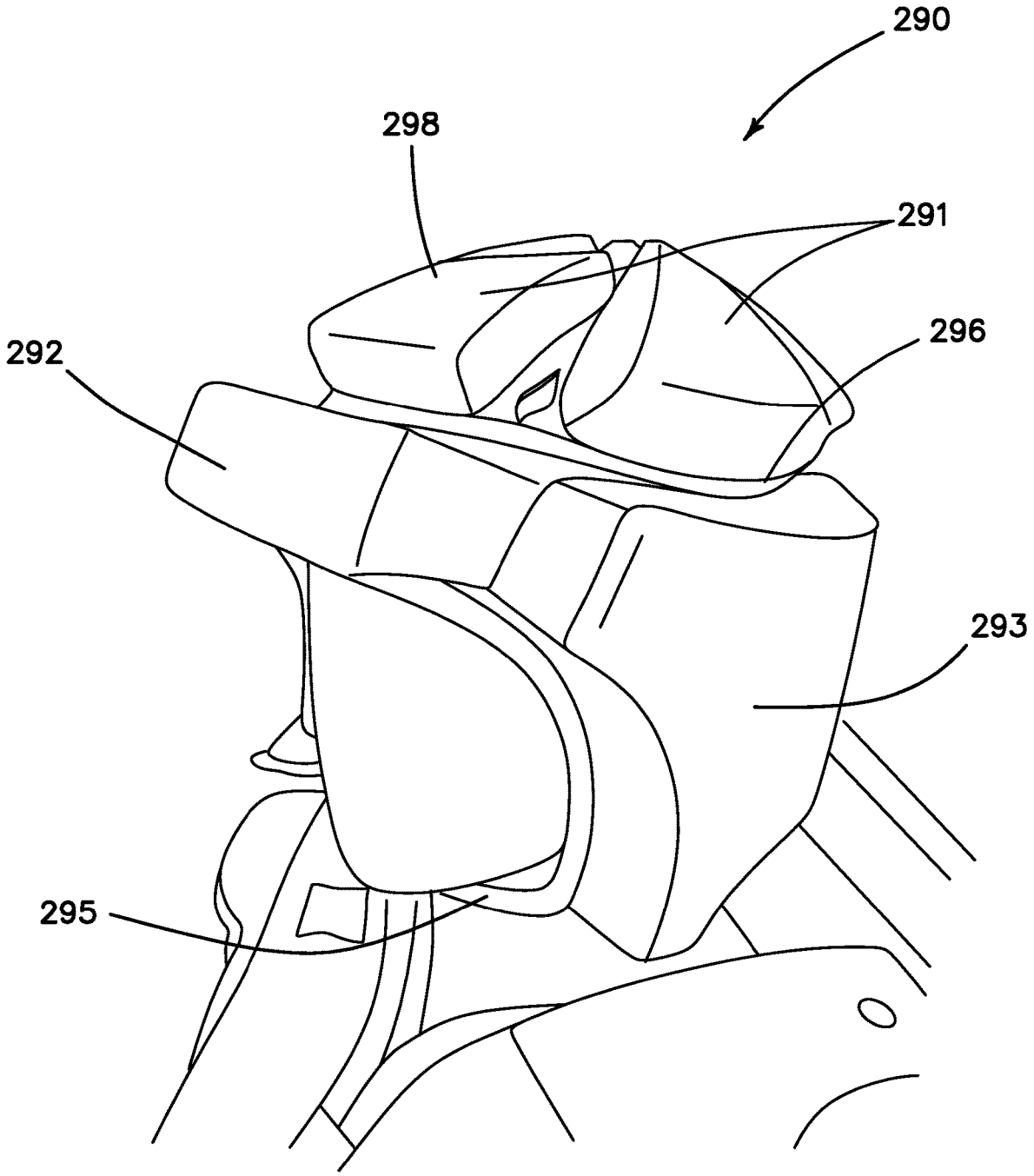
FIGS. 9A-9E are, respectively, perspective, front, side, rear, and top views of one example of inner headgear for use with the impact diffusing system.
Figure 9B:
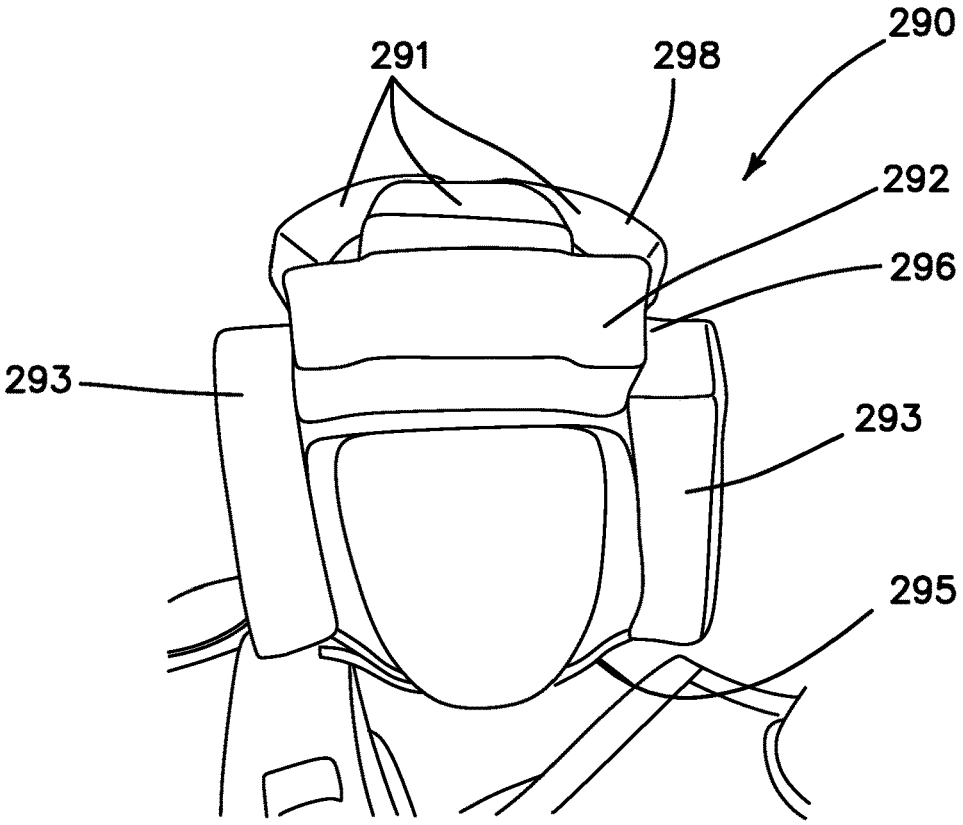
Figure 9C:
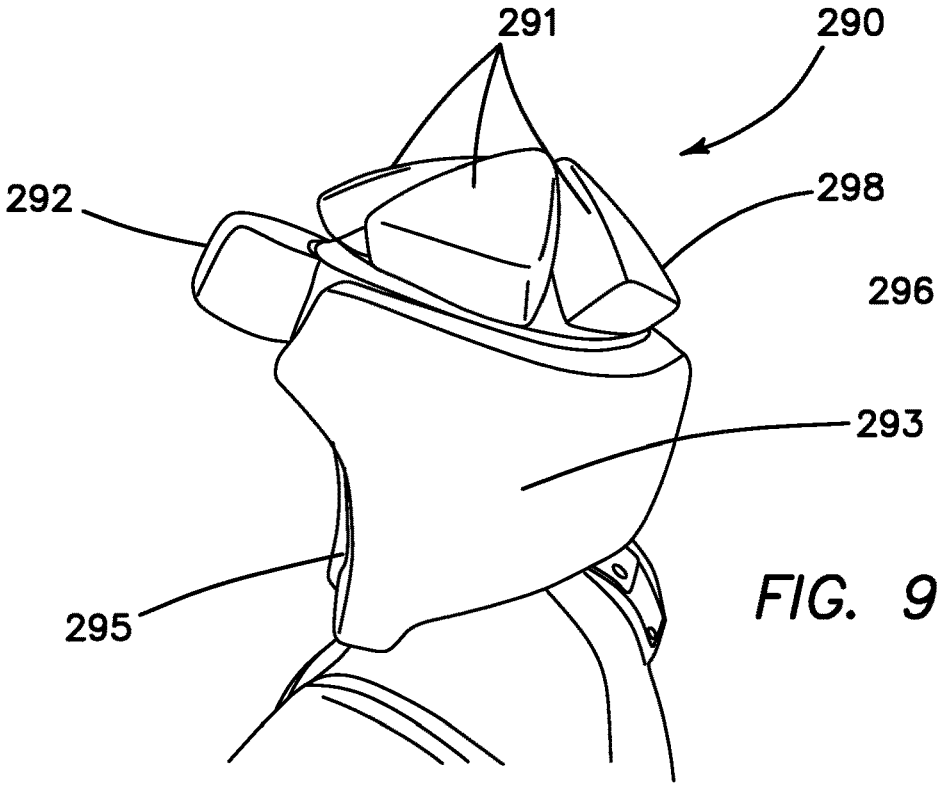
Figure 9D:
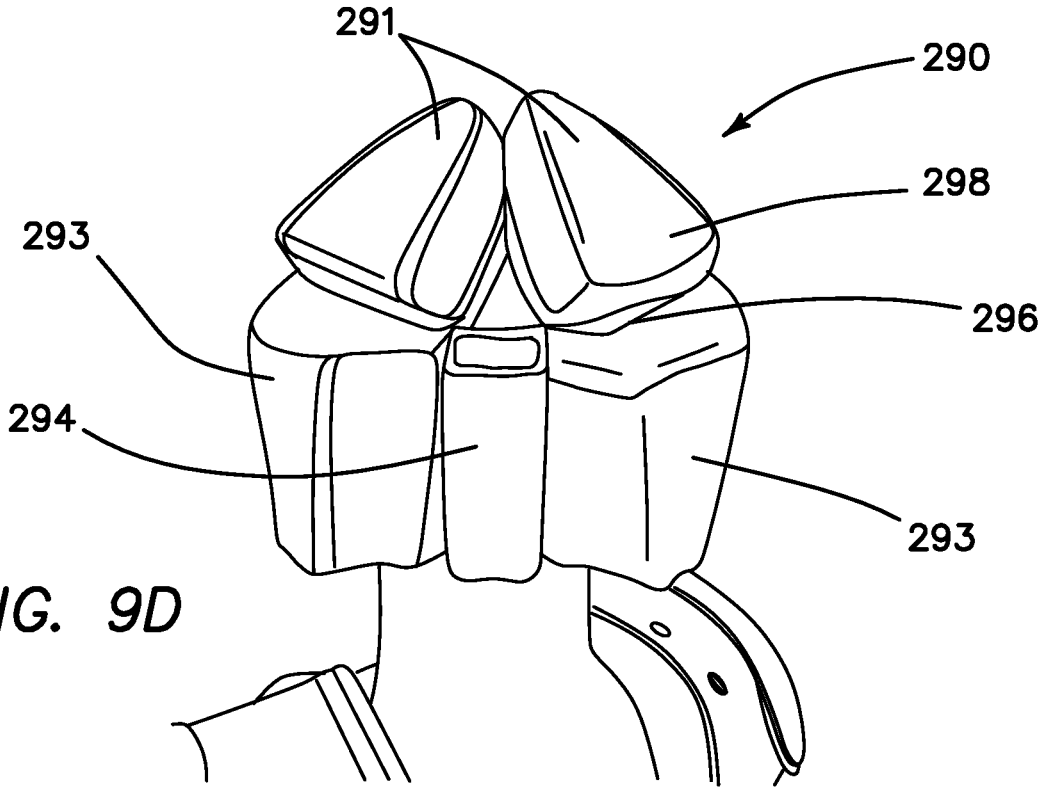
Figure 9E:
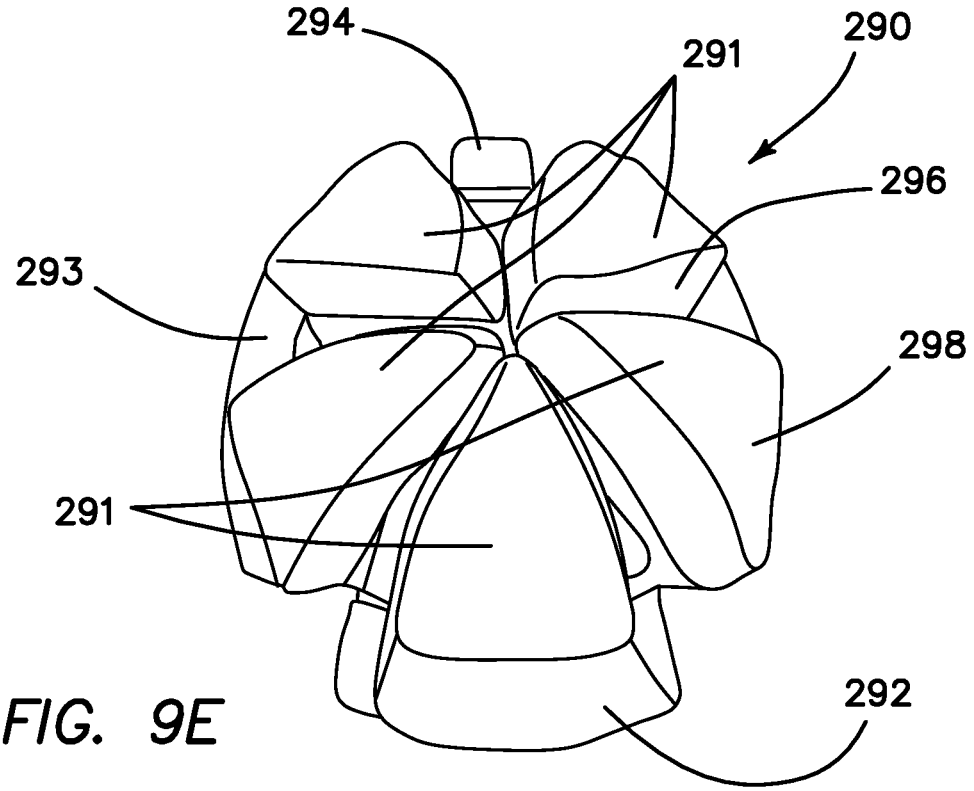

Referring back to FIGS. 1A-1D and 4A-4D, the thoracic portion 104 comprises inner padding 176 and an outer shell 178. The outer shell 178 is formed of a hard plastic and provides impact resistance and protection to the user. The outer shell 178 may include shoulder plates, arm plates and body plates. The polymeric outer shell 178 overlies the inner padding 176, which may be a polymeric foam. The inner padding 176 may in other examples be a fluid-filled padding. The thoracic portion 104 is shown with a belt or cinch to secure the thoracic portion 104 around the thoracic region of the user. A rigid framework is disposed between the inner padding 176 and the outer shell 178. In this manner, the inner padding 176 is in direct contact with the user's thoracic region and provides cushioning between the user and the framework so that the thoracic portion 104 is comfortable to wear. As shown in FIGS. 8A and 8B, the rigid framework 170 comprises a plurality of substantially rigid bars 172. The bars 172 may be comprised of a rigid, substantially inflexible material, such as metal or hard plastic. For example, the bars 172 may be stainless steel, titanium, carbon fiber, or any combination thereof. The rigid bars 172 of the thoracic portion 104 are substantially vertical or substantially horizontal, and may form polygonal shapes, thus distributing forces like a geodesic dome, in which triangular elements of the dome are structurally rigid and distribute structural stress throughout the structure.

With reference to FIGS. 8A and 8B, the pillars 140 extending from the bottom of the helmet portion 102 are attached to the bars 172 of the framework 170. In particular, the pillars 140 are coupled to substantially horizontal portions of the framework 170. In this manner, impact forces sustained by the helmet portion 102 are transferred to the rigid framework 170 of the thoracic portion 104, thereby protecting the head of the user. In other words, the framework 170 receives force from a blow or shock to the helmet portion 102 through the pillars 140 and distributes the force of the blow or shock through the framework 170 of the thoracic portion 104, thus lessening the severity of this force at any one point, and distributing the force through the shoulders, chest, and musculature of the back.

In an alternative embodiment, the framework 170 may be structured to be attached to a conventional shoulder pad apparatus, such as the shoulder pads worn by football players. As shown, the framework 170 is arranged along the chest, back and along the shoulders so as to diffuse the force of a blow to the helmet portion 102 transmitted through the pillars 140 and then throughout the thoracic portion 104 to the shoulders and upper body and away from the head. The framework 170 is rigid enough to absorb and direct a force received from the helmet portion 102 to the shoulders and back in preference to the neck or spine.

The thoracic framework 170 may preferably be fabricated as part of the thoracic portion 104, with connector receptacle components built therein. Less preferably, but still within the scope of this invention, the framework 170 may be fabricated as a separate element to be secured to an existing shoulder pad, for example, with nylon webbing and buckles, or another similar suitably strong connector. In either case, the thoracic portion 104 very preferably comprises a rigid framework 170 that distributes the force of the transmitted blow through the shoulders, chest, and musculature of the back.

In one embodiment (not shown), the rigid framework 170 includes rigid portions and flexible portions. Flexibility in certain areas of the framework 170 may be necessary in order to facilitate the range of motion required by the user, depending on the user's activities or player position. Such flexible portions in the framework 170 may be formed by hinges, reduced thickness portions, or slots or openings formed within selected regions of the framework 170.

In an alternative embodiment, the thoracic framework 170 and the headpiece cage are manufactured as a single, unitary piece. In such an embodiment, the helmet portion and the thoracic portion cannot be disconnected, and the connectors are eliminated.

The system 100 further includes inner headgear 190 that is attached to, and in direct contact with, the head of the user 130, as depicted in FIGS. 4A-4D. The inner headgear 190 surrounds the back, sides, and top of the user's head, as well as the user's forehead. The inner headgear 190 is fixed relative to the user's head, and thus moves with the user's head and moves relative to the helmet portion 102 of the system 100. The inner headgear 190 may be comprised of polymeric material and is preferably lightweight. The inner headgear 190 includes padding for protecting the user's head from the force of a collision with the inner surfaces of the helmet portion 102. Any padded headgear that can be fixed to the user's head may be used with the system 100, and is not limited to the one-piece padded headgear 190 shown in FIGS. 4A-4D.

In one embodiment, shown in FIGS. 9A-9E, the inner headgear 290 includes padding that underlies a skin comprising a smooth, low friction material such as a TEFLON® lubricant surface. The padding includes wedge-shaped pads 291 at the top of the user's head, a forehead pad 292, side pads 293 surrounding each one of the sides the user's head (including the ears), and a rear pad 294 (see FIGS. 9D and 9E) at the back of the user's head between the side pads 293. Each of the pads 291-294 may be made of impact absorbing padding, such as inflatable padding, fluid-filled padding, foam padding, smart material padding (e.g., PORON® XRD®, D30®, or the like), or any combination thereof. Smart material padding is formed of an elastic polymer that stiffens upon impact. The inner headgear 290 also includes a chin strap 295 for securing the headgear 290 to the user's head. Each of the pads 291-294 is connected to the other pads 291-294 through a layer of material 296. In this manner, the pads 291-294 are able to move and flex relative to each other. The inner headgear 290 and the helmet portion 102 are constructed so that there is a space between the outer surface 298 of the inner headgear 290 and the inner surface of the helmet portion 102 so that the user's head may turn side to side, as well at tilt forward and back, relative to the helmet portion 102 without interference or friction from the helmet portion 102. The outer surface of the inner headgear 290 may be untextured and substantially smooth.

Alternatively or additionally, the outer surface 298 of the inner headgear 290 and the inner surface of the helmet portion 102 may be coated with a friction-reducing material, such as polytetrafluoroethylene, in order to facilitate movement of the inner headgear 290 relative to the helmet portion 102. Alternatively or additionally, the helmet portion 102 may include inner padding attached thereto, including a floating top plate that is rotatable relative to the outer shell 103 of the helmet portion 102, such as those disclosed in FIGS. 4-6 of U.S. Pat. No. 9,462,841, which is hereby incorporated herein by reference in its entirety. The inner padding of the helmet portion 102 may be in contact with, or spaced apart slightly from, the inner headgear 290.

In this manner, during use, the wearer will have the benefit of the protection of the protective headpiece cage, while the inner headgear 190, 290 and the space within the helmet portion 102 will allow the wearer to move the head relatively freely within the helmet portion 102 in order to be able to scan the playing field and/or outside environment without requiring the shoulders or body to move.

Figure 10A:
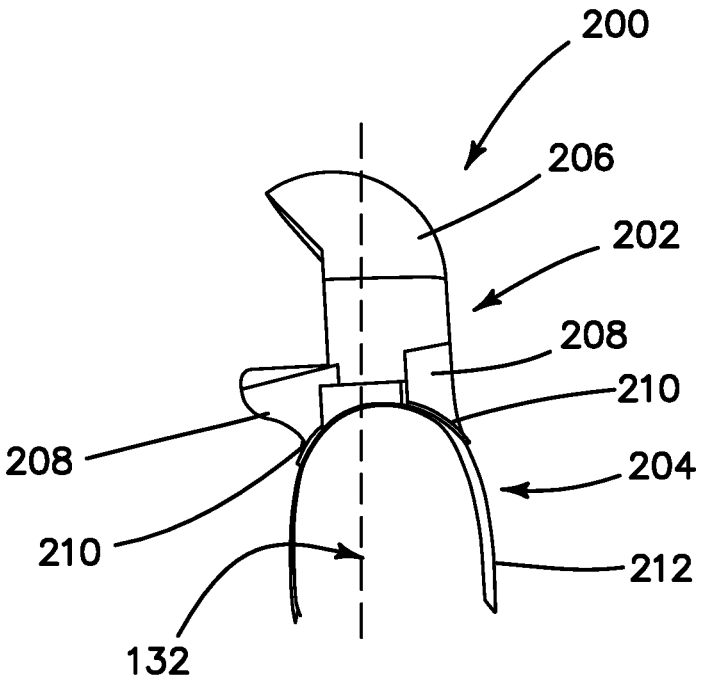
FIGS. 10A and 10B are, respectively, side and perspective views of an impact diffusing system in accordance with another embodiment of the present invention.
Figure 10B:
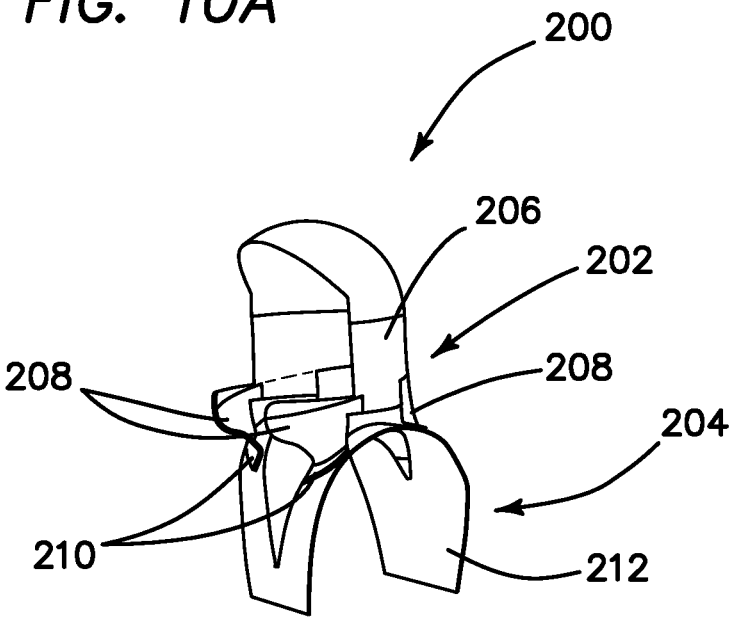
Figure 11B:
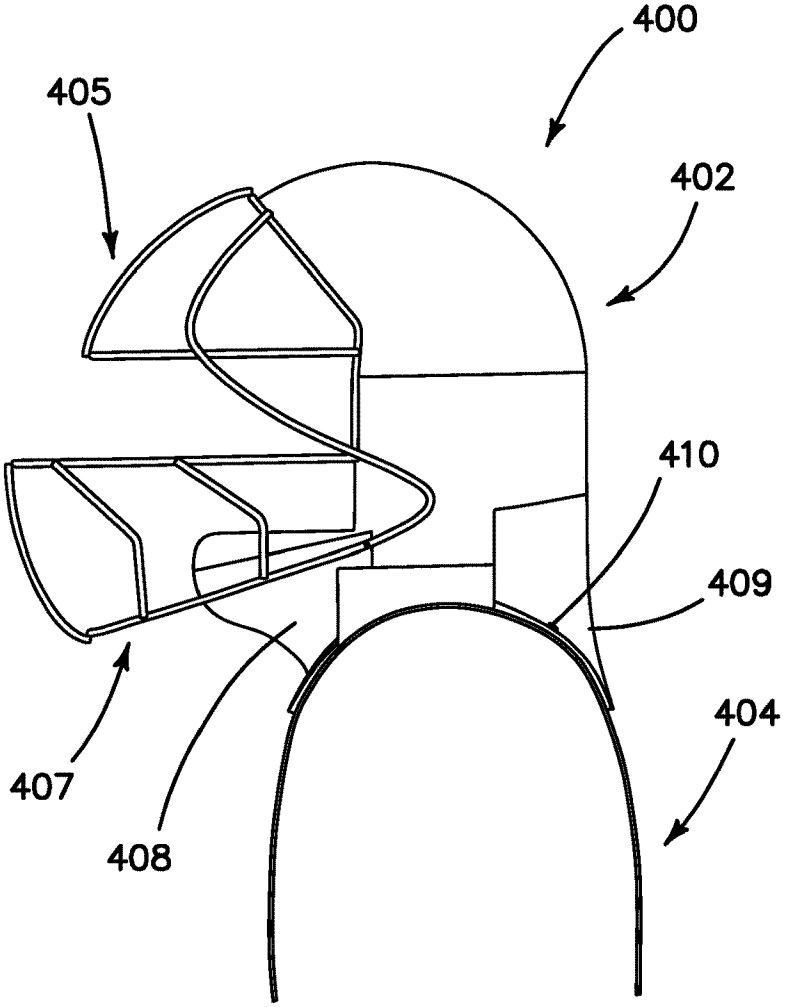
FIGS. 11A-11D are, respectively, front perspective, side, rear perspective, and rear views of an impact diffusing system in accordance with yet another embodiment of the present invention.
Figure 11A:
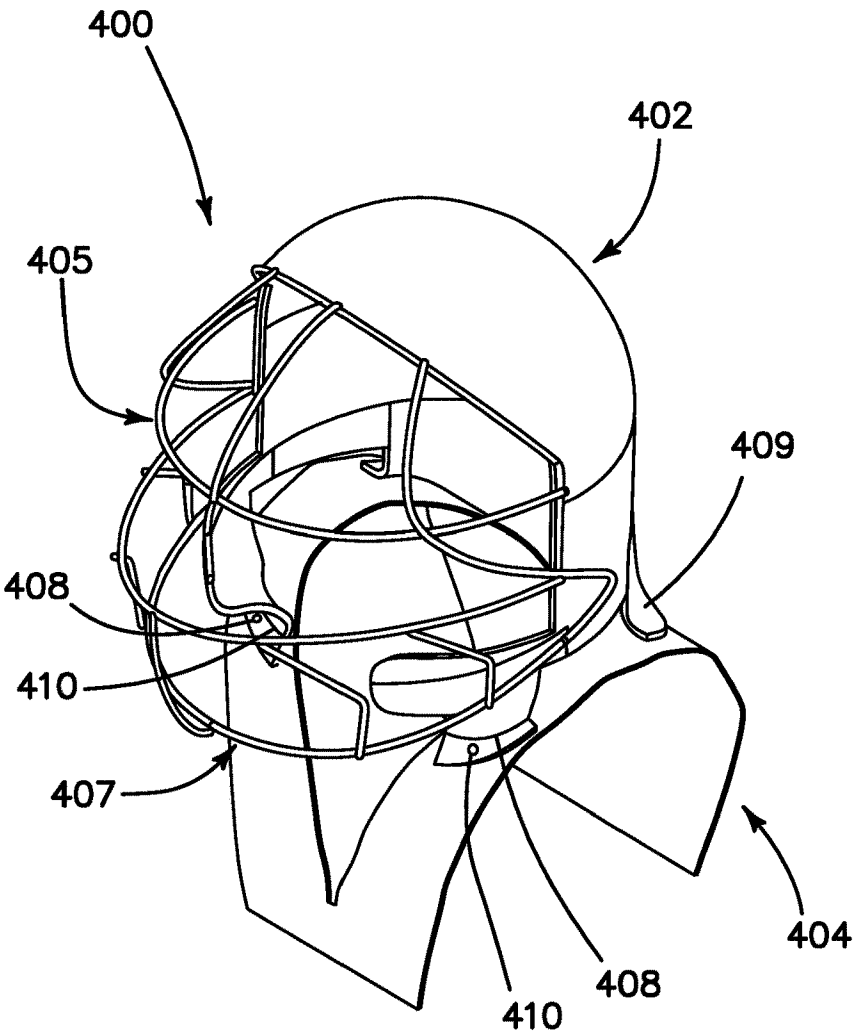
Figure 11D:
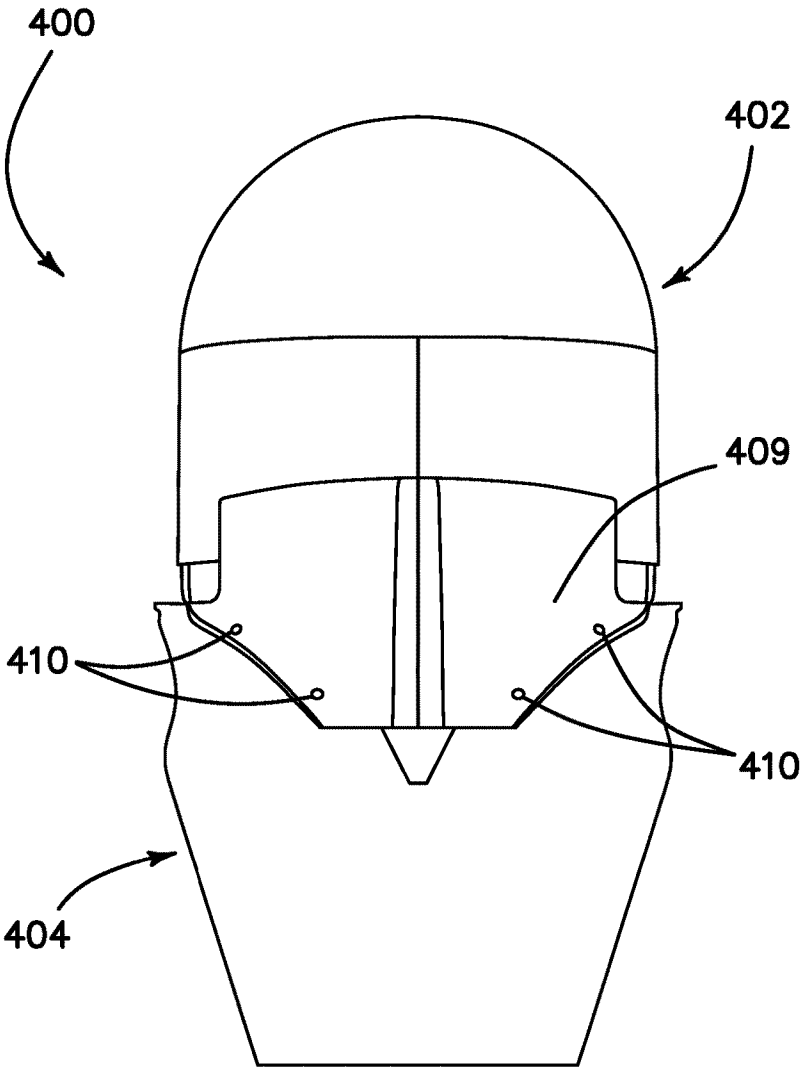
Figure 11C:
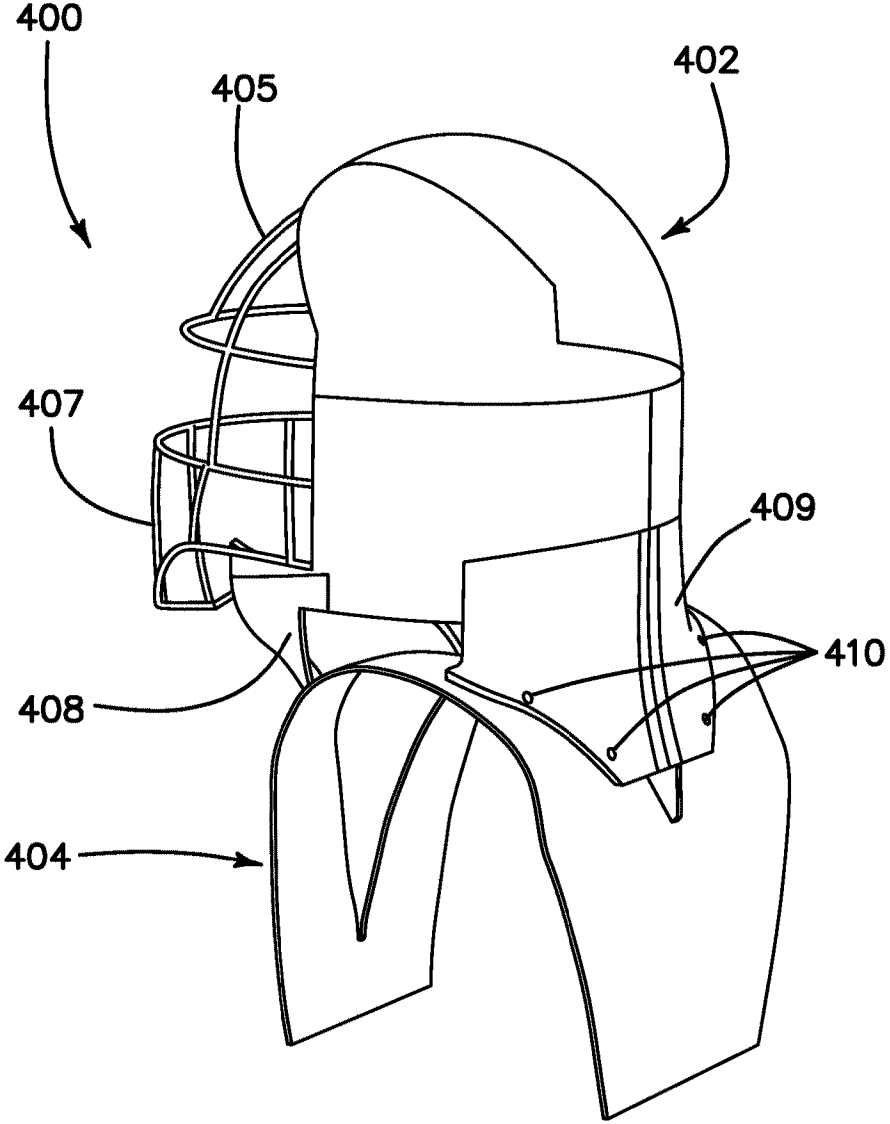

In another embodiment, shown in FIGS. 10A and 10B, an impact diffusing system 200 includes a helmet portion 202 and a thoracic portion 204, both of which are formed of a rigid, lightweight material, such as carbon fiber. The helmet portion 202 comprises a unitary shell 206 that surrounds the back, sides, and top of the user's head. The helmet portion 202 further includes pillars 208 that protrude from the bottom of the helmet portion 202 and that include connectors 210 for connecting the helmet portion 202 to the thoracic portion 204. The pillars 208 in this embodiment are wider than the pillars 140 in the previous embodiments. The shell 206 and the pillars 208 may be formed separately and then affixed to each other, or the shell 206 and the pillars 208 may be fabricated as a continuous, unitary piece. The thoracic portion 204 includes thoracic framework 212 that fits over and around the user's shoulders, back and chest. The thoracic framework 212 includes connector receptacles for coupling to the connectors 210 on the helmet portion 202. In the embodiment shown in FIGS. 10A and 10B, there are four connectors 210 that connect the helmet portion 202 to the thoracic portion 204. Two of the connectors 210 are anterior to the coronal plane 132 and positioned at the front of the user's body. The other two connectors 210 are posterior to the coronal plane 132 and positioned at the back of the user's body. However, those of ordinary skill in the art will recognize that the system 200 may include more than four connectors or fewer than four connectors and that the connectors may be positioned anywhere between the helmet portion 202 and the thoracic portion 204. The connectors 210 are below eye level, and are preferably below the jaw line of the user. Similar to the above embodiments, the connectors 210 are preferably quick-release connectors. Alternatively, the thoracic framework 212, the helmet shell 206, and the helmet pillars 208 may be manufactured as a single, unitary piece, thereby eliminating the connectors and connector receptacles. Similar to the above embodiments, the thoracic framework 212 is disposed between inner padding and an outer shell (not shown). Alternatively, the thoracic framework 212 may be sized and structured to be attached to a conventional shoulder pad apparatus, such as the shoulder pads worn by football players. Also similar to the above embodiments, the system 200 includes inner headgear that is affixed to the user's head and configured to move relative to the helmet portion 202. For example, the inner headgear 190 depicted in FIGS. 4A-4D, or the inner headgear 290 depicted in FIGS. 9A-9E may be used in the system 200. The system 200 may further include a face mask, similar to the face mask 107 in the above embodiments. The face mask for the system 200 may be attached to the helmet shell 206 and/or the pillars 208 with a hinge or pivot mount such that the face mask may be opened to provide access to the user's face during use. Alternatively, such a face mask may be permanently attached to the shell 206 and/or the pillars 208. The system 200 may further include a visor or other eye protection (not shown).

In FIGS. 11A-11D, another embodiment of an impact diffusing system 400 is depicted. This system 400 is similar to the system 200 shown in FIGS. 10A and 10B, except that the pillars 408, 409 in the system 400 are in a different configuration than the pillars 208 in the system 200. The system 400 comprises a helmet portion 402, a thoracic portion 404, and three pillars that extend between, and are coupled to, the helmet portion 402 and the thoracic portion 404. In particular, the system 400 comprises two front pillars 408 that are anterior to the coronal plane 132 and a wide rear pillar 409 that is posterior to the coronal plane 132. The front pillars 408 each include one connection point 410. The rear pillar 409 includes four connection points 410. The system 400 is depicted including a face mask 407 and a plurality of rigid bars 405 for surrounding the user's forehead area, and one of ordinary skill in the art would recognize that a face mask and plurality of rigid bars may similarly be incorporated into the system 200 depicted in FIGS. 10A and 10B. One of ordinary skill in the art would also recognize that any number and configuration of pillars and connectors may be used to couple the helmet portion to the thoracic portion in a manner that prevents movement of the helmet portion relative to the thoracic portion.

Another embodiment of an impact diffusing system 500 is depicted in FIGS. 12A-12D. This system 500 is similar to the systems 200 and 400 in FIGS. 10A and 10B and 11A-11D, respectively, but the system 500 depicts another alternative for the configuration of the pillars, and the face mask is larger than other embodiments. The impact diffusing system 500 includes a helmet portion 502, a thoracic portion 504, and pillars 506, 508 that extend between, and are coupled to, the helmet portion 502 and the thoracic portion 504. The helmet portion 502 of the system 500 includes a hard exterior shell 512 in the back of the helmet portion 502, a face mask 507, and a plurality of rigid bars 505 for surrounding the user's forehead area. The face mask 507 and rigid bars 505 are attached to the hard shell 512 using a conventional attachment mechanism, such as screws, nuts and bolts, or the like. The face mask 507 is larger than in previous embodiments. The enlarged face mask 507 may improve the visibility of the user 130. In other words, the face mask 507 is large enough that the hard shell 512 on the back of the helmet portion 502 does not obscure the user's view when the user 130 turns their head relative to the helmet portion 502. The hard exterior shell 512 may be made of a rigid, lightweight, impact-resistant material, such as hard plastic, polymer, polycarbonate, carbon fiber, or the like. Similar to previous embodiments, the face mask 507 and rigid bars 505 may be made of metal, polymer-coated metal (e.g., powder-coated titanium, or the like), hard plastic, or another sufficiently rigid material that is able to withstand several impacts.

The connecting pillars include two front pillars 506 that are anterior to the coronal plane 132 (shown in FIG. 4B) and have a connection point near the front of the shoulder of the user 130. The two front pillars 506 may be formed of metal, polymer-coated metal (e.g., powder-coated titanium, or the like), or another sufficiently rigid material. The connecting pillars further include two rear pillars 508 that are posterior to the coronal plane 132 and connect to the thoracic portion 504 in an area near the upper back and rear shoulder of the user 130. The rear pillars 508 may be formed of metal, or a rigid, lightweight material, such as plastic, carbon fiber, or the like. The rear pillars 508 and the exterior shell 512 of the helmet portion 502 may be manufactured as a unitary piece, and thus formed of the same material. Alternatively, the rear pillars 508 may be made separately and then attached to the hard exterior shell 512 of the helmet portion 502. The pillars 506, 508 are disposed between the coronal plane 132 and sagittal plane 134 (shown in FIGS. 4A and 4D). The pillars 506, 508, face mask 507, and rigid bars 505 may all be made of the same material, or may all be made of different materials. Similar to the above-disclosed embodiments, the pillars 506, 508, face mask 507, and rigid bars 505 comprise a suitably strong and lightweight material, such as, without limitation, one or more of titanium, a titanium alloy, a non-titanium metal, a nanostructured ceramic, a nanostructured metal or metal alloy, a thermopolymer, or a carbon polymer.

The pillars 506, 508 may connect to the thoracic portion 504 using any type of connection mechanism. The connection mechanism is preferably a quick-release mechanism so that the helmet portion 502 can be quickly released and removed from the thoracic portion 504 in case of emergency. In this embodiment, as depicted more clearly in FIGS. 13A and 13B, the connection mechanism includes a cotter pin 542 that passes through a hole in a pin 544 that protrudes through the pillars 506, 508. A damper 546 is disposed between the pillars 506, 508 and the thoracic portion 504 in order to absorb some of the impact that may be sustained by the system 500. The upper surface of the damper 546 is in direct contact with the lower surface of the pillar 506, and the lower surface of the damper 546 is in direct contact with the hard outer shell 514 of the thoracic portion 504. Such a damper may also be disposed between the face mask and the hard outer shell of the helmet portion of any of the embodiments described herein. The pin 544 is permanently coupled to the hard outer shell 514 of the thoracic portion 504 and extends through a hole in the damper 546 and a hole in the lower surface of the pillar 506. The damper 546 may be made of rubber, foam, or other such impact-absorbing materials.

Similar to the above embodiments, the system 500 further includes inner headgear 590 (shown in FIGS. 12A and 12B) that is attached directly to the head of the user 130, and is configured to move relative to the helmet portion 502. The inner headgear 590 may be substantially similar to the inner headgear 190 depicted in FIGS. 4A-4D, or the inner headgear 290 depicted in FIGS. 9A-9E.

The thoracic portion 504 includes a hard outer shell 514 disposed over a padded vest 516. The hard outer shell 514 may be made of a rigid, lightweight material that is capable of sustaining repeated impact without breaking, such as plastic, carbon fiber, or the like. The hard outer shell 514 may alternatively or additionally be made of metal, or other such suitably rigid materials. The padded vest 516 is in direct contact with the user 130 and is positioned between the user 130 and the hard outer shell 514. In this manner, the padded vest 516 absorbs some of the force when an impact occurs, thereby preventing or reducing injury to the user 130. The padded vest 516, depicted in more detail in FIGS. 14A-14C, covers the upper torso of the user 130, including the upper back, chest, and tops of the user's shoulders. The padded vest 516 may be permanently or removably attached to the hard outer shell 514. For example, the padded vest 516 may include hook and loop fasteners 550 (e.g., Velcro®) for securing the vest 516 to the outer shell 514 in various discrete places around the vest 516. Similar to previous embodiments, the padding in the vest 516 may include polymeric foam, memory foam, smart material padding, fluid, or the like. The thoracic portion 504 may alternatively include other styles of padding that are not in a vest configuration and that may be positioned between the user 130 and the hard outer shell 514.

Figure 12A:
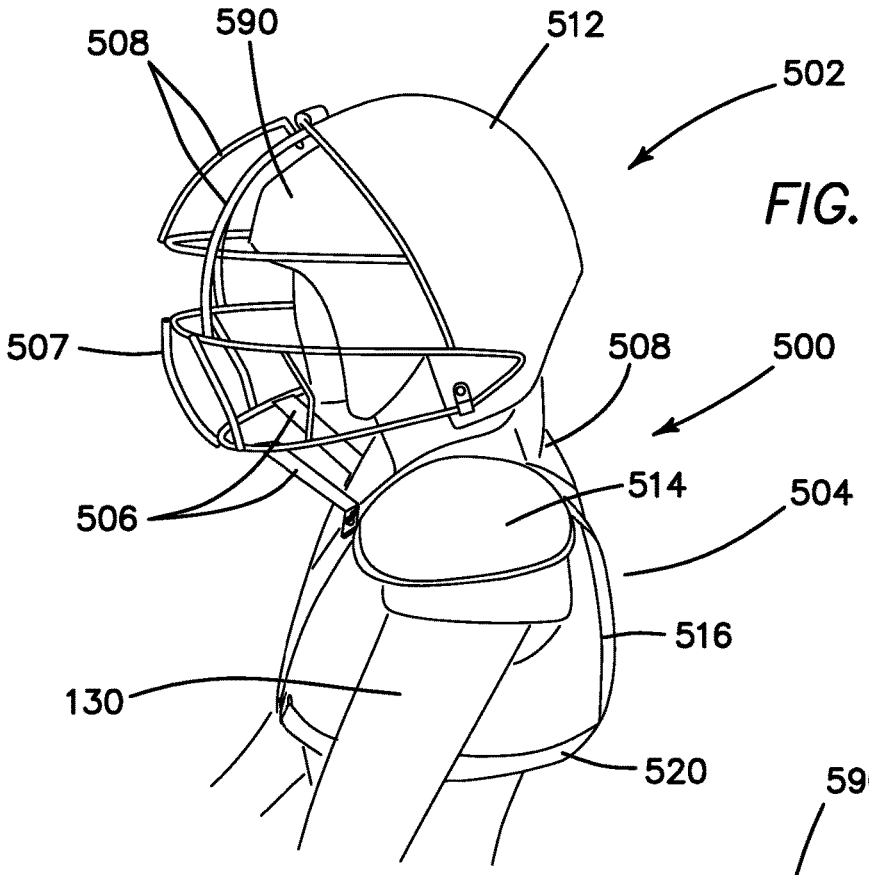
FIGS. 12A and 12B are, respectively, side and front views of an impact diffusing system in accordance with still another embodiment of the present invention.
Figure 12B:
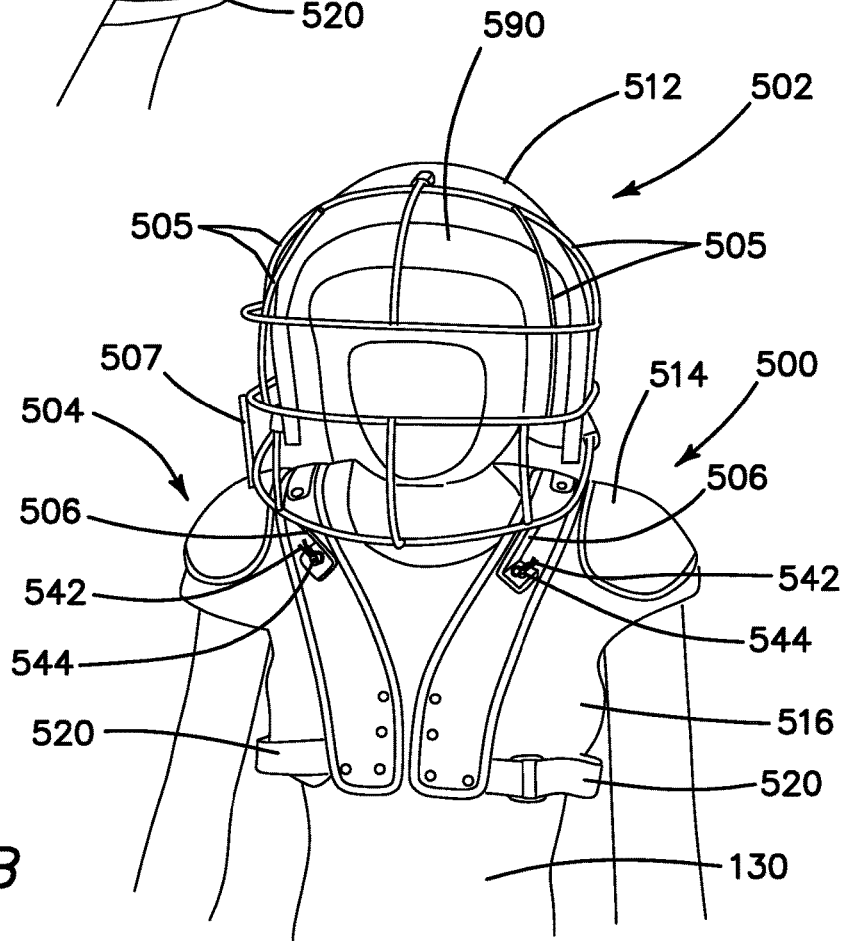
Figure 12C:
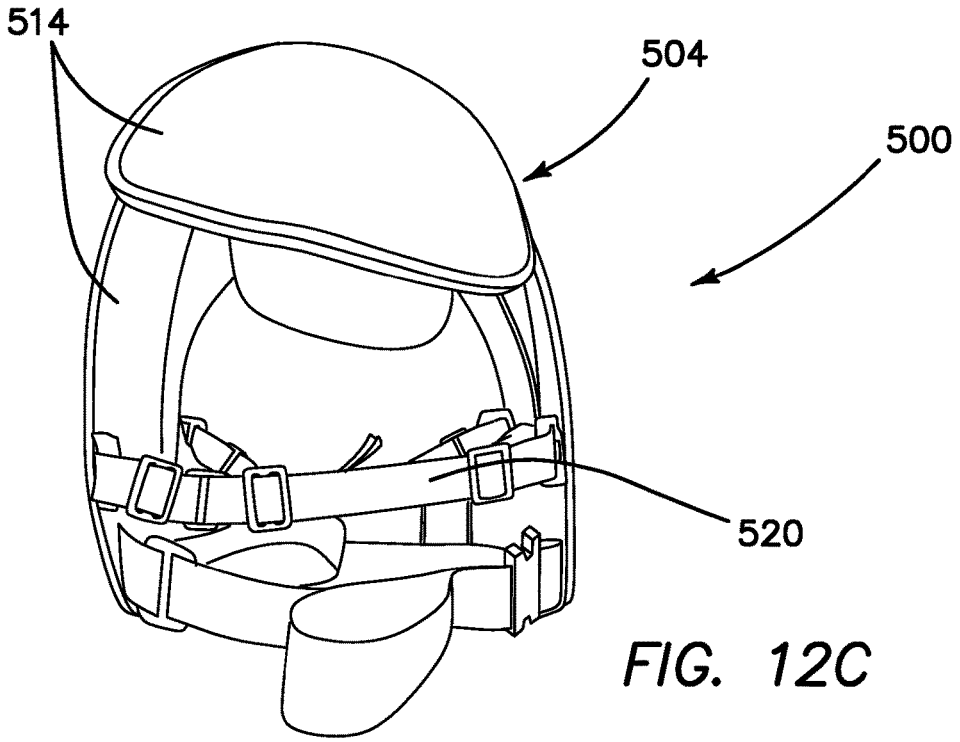
FIG. 12C is a side view of an attachment mechanism of a thoracic portion of an impact diffusing system.
Figure 12D:
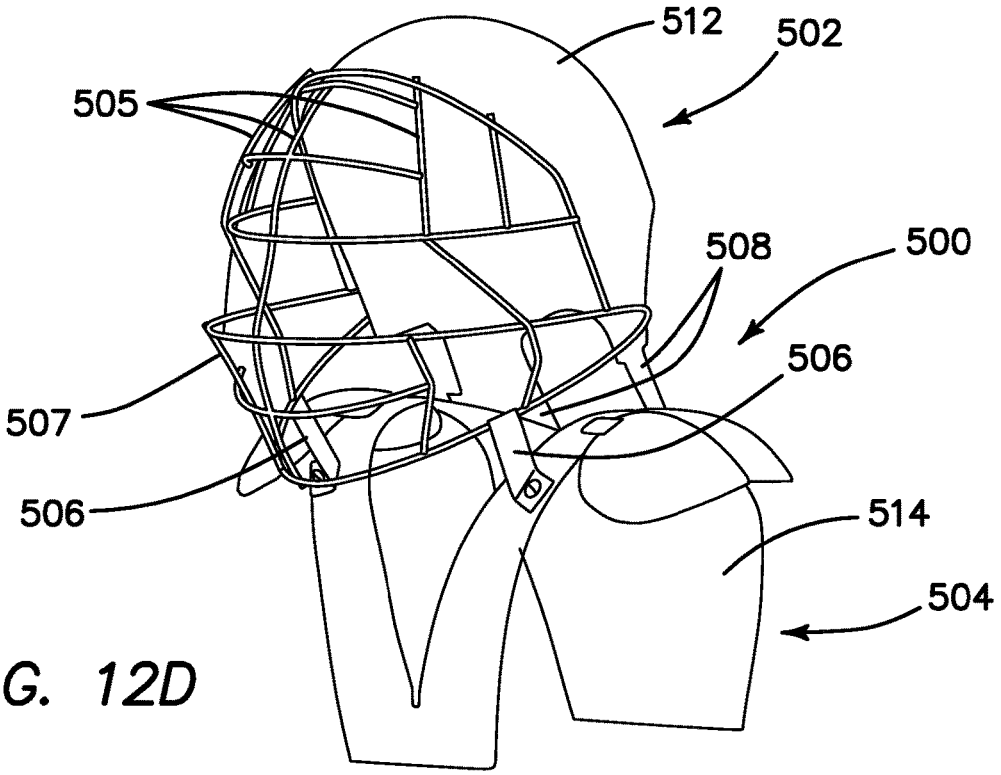
FIG. 12D is a perspective view of the impact diffusing system of FIGS. 12A and 12B.

The thoracic portion 504 further includes side straps 520 (shown in FIGS. 12A-12C) for securing the thoracic portion 504 to the user 130. Although two side straps 520 are depicted in FIGS. 12A-12C, the thoracic portion 504 may alternatively include only one side strap that goes all the way around the outer shell 514. The side straps 520 may include nylon webbing and a buckle, similar to a seat belt. However, one of ordinary skill in the art will recognize that any other means of securing the thoracic portion 504 to the torso of the user 130 may be employed. The securing meaning is preferably adjustable and includes a mechanism for tightening or cinching down the thoracic portion 504 after it is positioned on the user 130 in order to secure the thoracic portion 504 to the user 130 in a manner that prevents or minimizes movement of the thoracic portion 504 relative to the thoracic region of the user's body.

Figure 15:
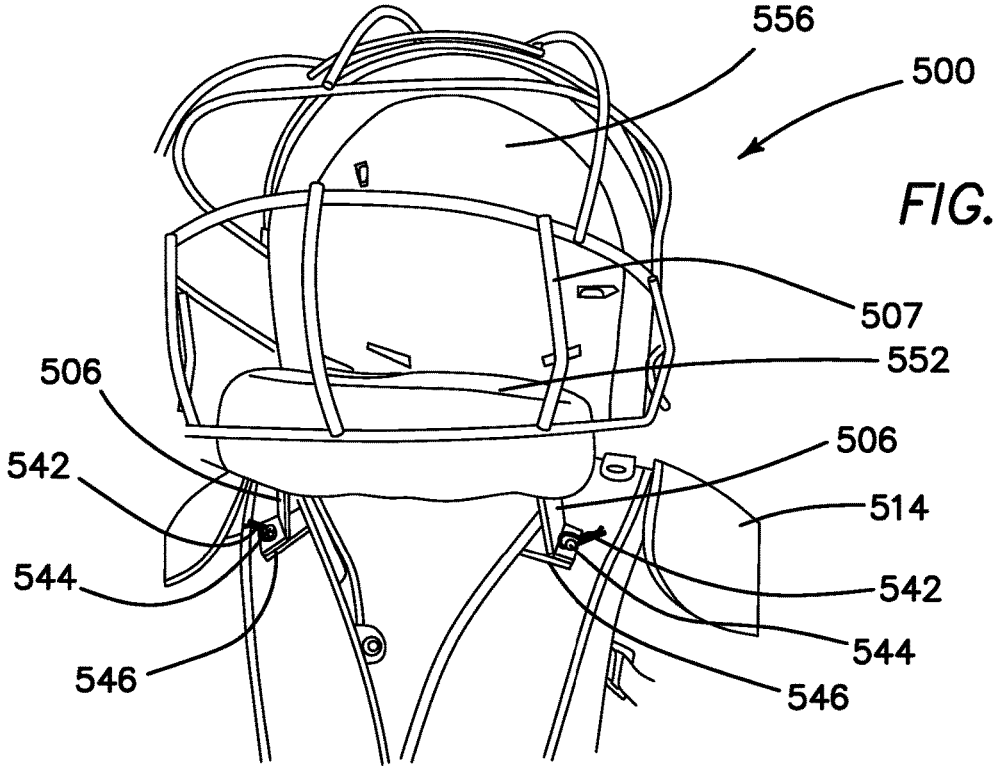
FIG. 15 is a front perspective view of a helmet portion of an impact diffusing system that includes padding on the lower portion of the face mask.
Figure 16:
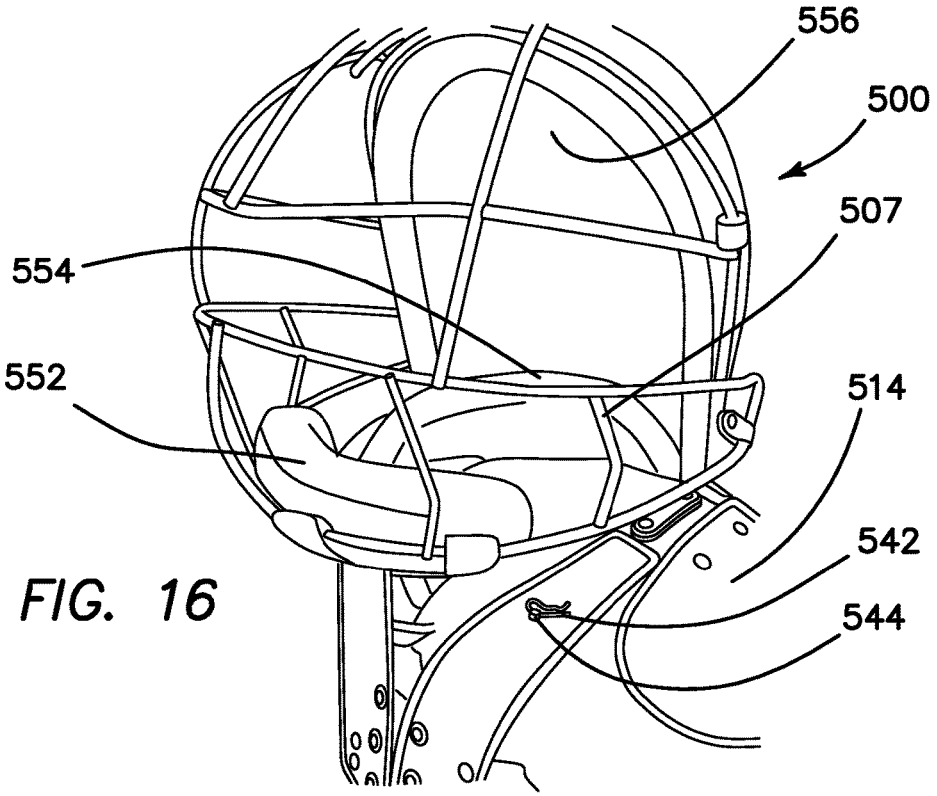
FIG. 16 is a front perspective view of a helmet portion of an impact diffusing system that includes a padded neck collar.

As shown in FIG. 15, the system 500 may further include padding 552 along the lower bars of the face mask 507 and the front pillars 506. This umpire mask-style padding 552 protects the user's chin. As shown in FIG. 16, the system 500 may further include a neck collar 554 for padding the user's neck and preventing drastic head movement when the system 500 sustains an impact. FIGS. 15 and 16 further depict padding 556 on the interior surface of the helmet portion 502. This interior padding 556 protects the user's head from impact with the hard outer shell 512. One of ordinary skill in the art would readily recognize that the padding 552, 554, 556 depicted in FIGS. 15 and 16 may also be employed in the other embodiments depicted herein.

Figure 17A:
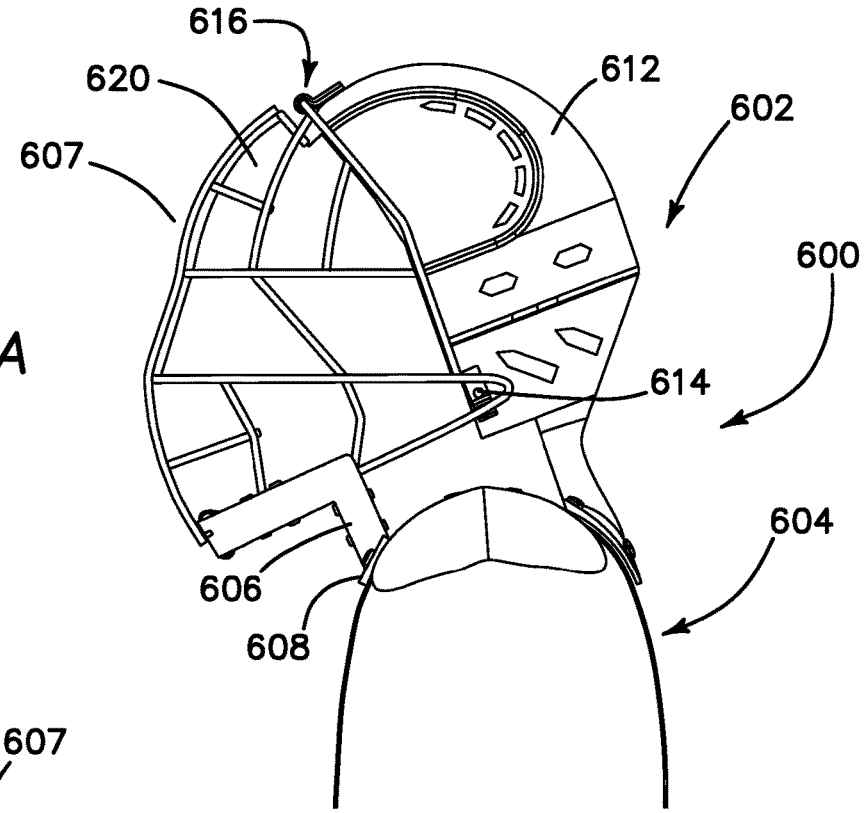
FIG. 17A is a side view of an impact diffusing system in which the helmet portion includes a face mask rotatably attached to the helmet portion.
Figure 17B:
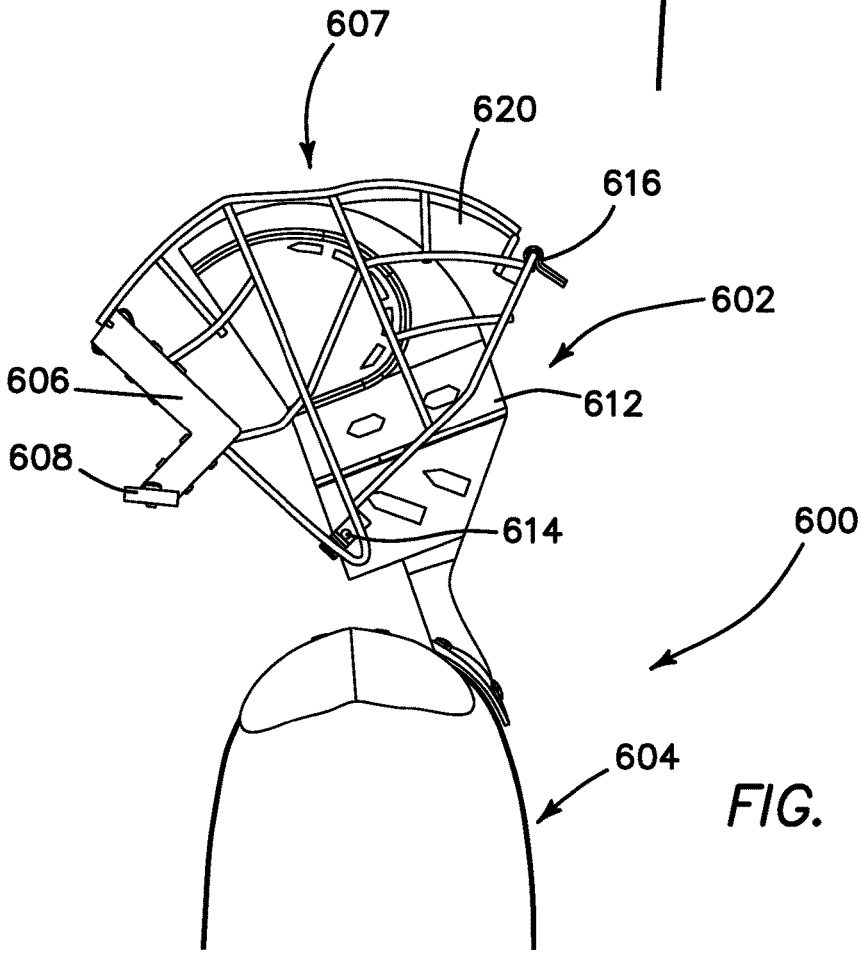
FIG. 17B is a side view of the impact diffusing system of FIG. 17A in which the face mask is rotated upward.

The face mask in any of the above embodiments may be configured to rotate up relative to the outer shell of the helmet portion. For example, as shown in FIGS. 17A and 17B, the face mask 607 is rotatably attached to the hard outer shell 612 of the helmet portion 602 of the system 600. This system is similar to those shown in FIGS. 12A-16, but it will be readily understood by one of ordinary skill in the art that a rotatable face mask could be incorporated into any of the embodiments disclosed herein. The face mask 607 is attached to the hard outer shell 612 at rotatable attachment points 614 on the sides of the shell 612 and a releasable attachment 616 at the top of the shell 612. The face mask 607 is attached to the thoracic portion 604 of the system 600 through connecting pillars 606 and attachment mechanism 608. The connectors 608, 616 on the thoracic portion and top of the hard outer shell 612 may be released, allowing the face mask 607 to swivel upwards relative to the shell 612, as shown in FIG. 17B. The face mask 607 rotates about the attachment points 614. The embodiment shown in FIGS. 17A and 17B further includes a visor 620 for shielding the user's eyes and upper face. The visor 620 may be polycarbonate or another similar light-weight, durable material. The visor 620 is transparent and may be clear or tinted.

Figure 18A:
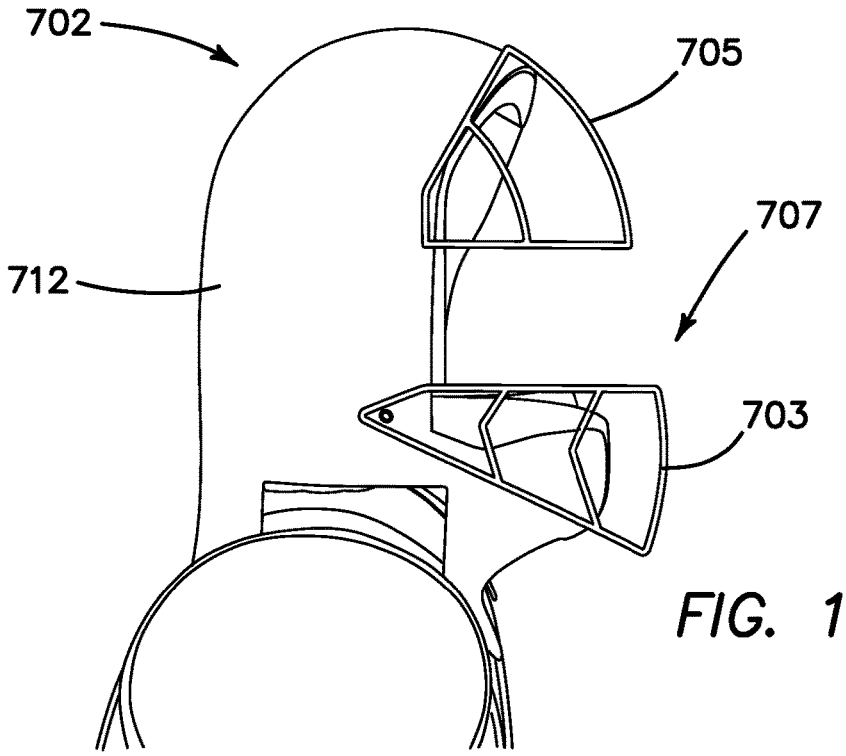
FIG. 18A is a side view of an impact diffusing system in which the helmet portion includes a two-part face mask having an upper portion and a lower portion.
Figure 18B:
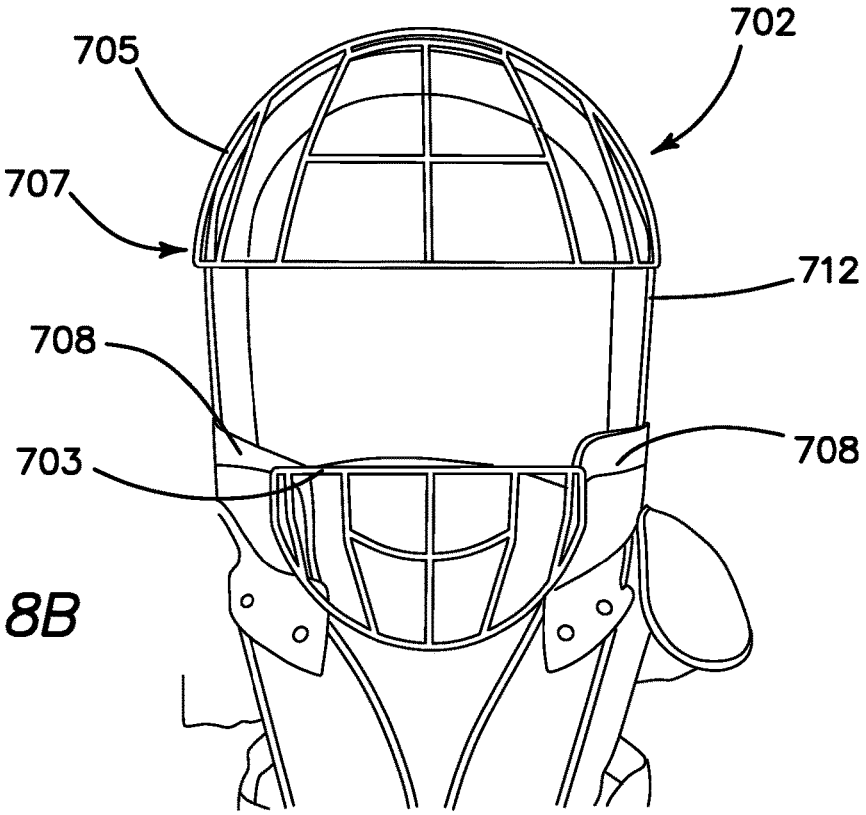
FIG. 18B is a front view of an impact diffusing system in which the helmet portion includes a two-part face mask having an upper portion and a lower portion.

In yet another embodiment, shown in FIGS. 18A and 18B, rather than being a single piece, the face mask 707 is a two-part face mask having an upper portion 705 and a lower portion 703. The lower portion 703 of the face mask 707 is attached to the hard outer shell 712 on the sides of the hard outer shell 712. The upper portion 705 of the face mask is attached to the upper portion of the hard outer shell 712. The upper portion 705 and lower portion 703 of the face mask 707 are not attached to each other, and thus are able to move independently of each other. For example, one or both of the lower portion 703 and the upper portion 705 may be rotatable relative to the hard outer shell 712 of the helmet portion 702. In another example of a two-piece face mask, shown in FIG. 18B, the lower portion 703 of the face mask 707 is connected to the pillars 708 rather than to the sides of the hard outer shell 712. In this manner, the lower portion 703 covers the gap between the pillars 708. While the two-part face mask 707 is depicted as being connected to a helmet portion similar to those in FIGS. 10A-11D, it will be readily understood by one of ordinary skill in the art that any of the embodiments disclosed herein may be made with a two-piece face mask. It will further be understood that the lower portion 703 of the face mask 707 may have one or more pillars attached thereto that extend downward and connect to the thoracic portion of the system.

Figure 19A:
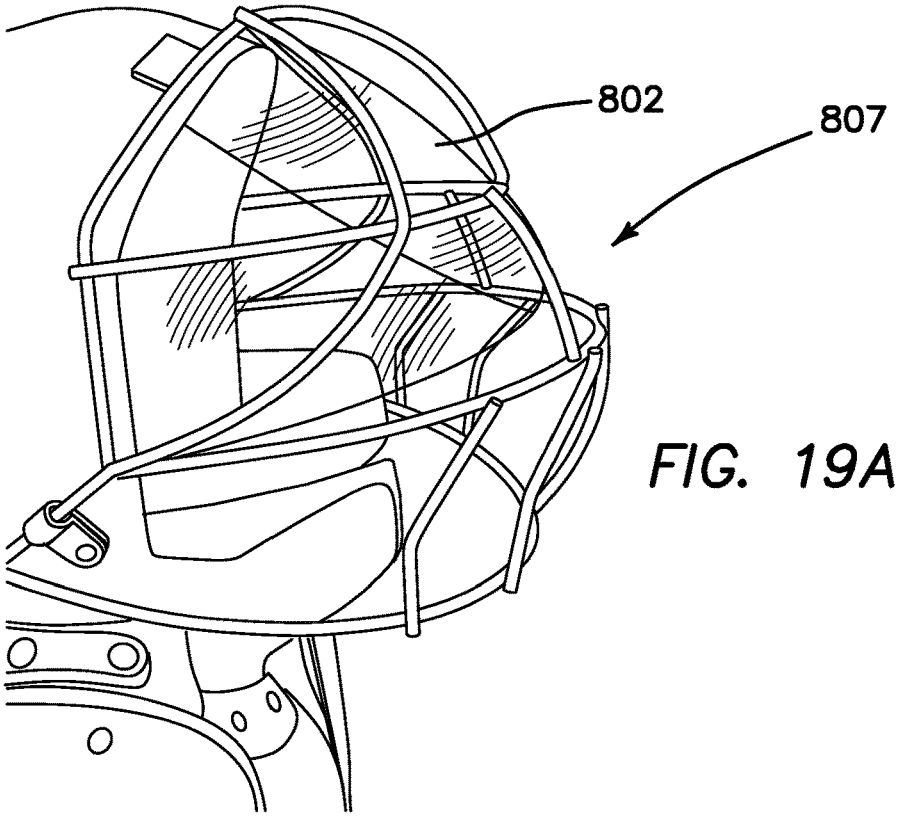
FIG. 19A is a side perspective view of the anterior part of a helmet portion is similar to the embodiment of FIG. 10A in which the face mask includes a transparent visor.
Figure 19B:
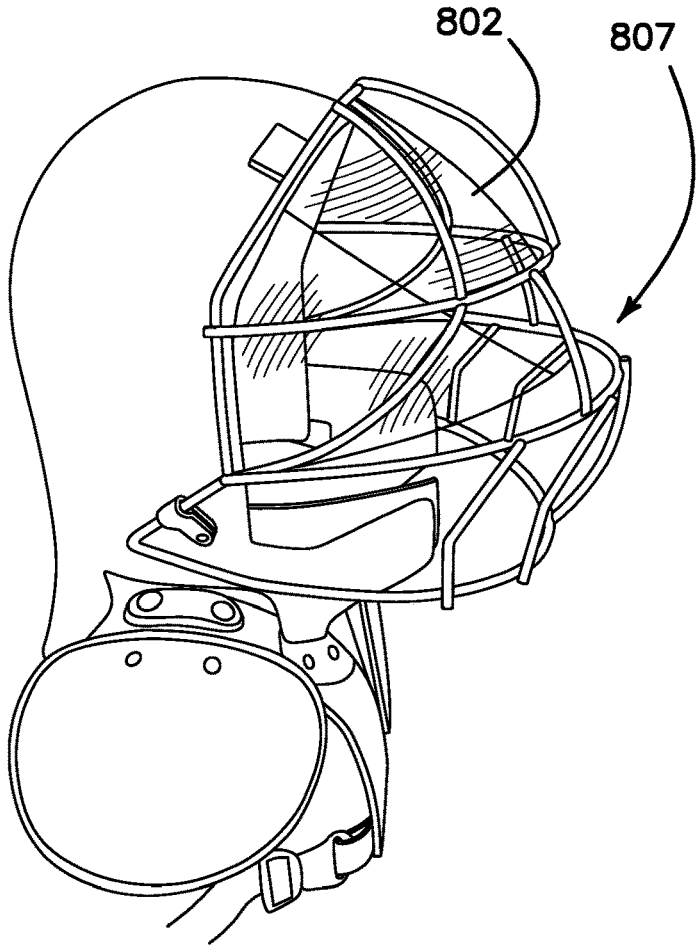
FIG. 19B is a side perspective view of the helmet portion and a part of the thoracic portion of the embodiment of FIG. 19A.

Any of the embodiments discussed herein may further include a visor for shielding the user's eyes, forehead, and upper face. For example, the embodiment shown in FIGS. 19A and 19B is similar to the embodiments shown in FIGS. 10A-11D, and includes a visor 802 lining the upper portion of the face mask 807. The visor 802 may be made of any lightweight, durable, transparent material. In one example, the visor 802 is made of clear polycarbonate. The visor 802 may alternatively be tinted to protect the user's eyes from the sun. By incorporating the visor 802, some of the rigid bars in the face masks disclosed herein can be eliminated, thereby reducing the weight of the system and improving visibility for the user.

Figure 20:
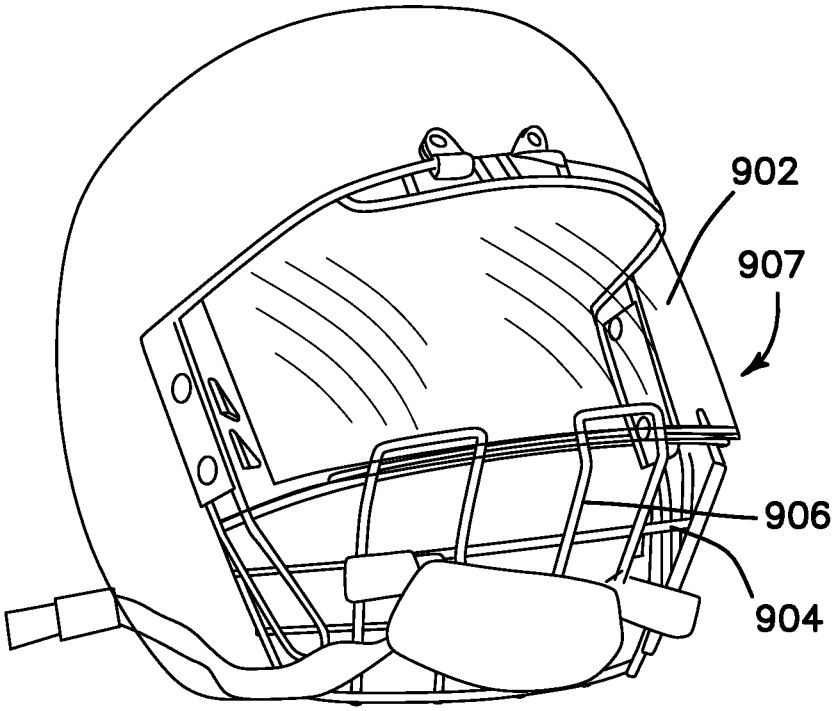
FIG. 20 is a front perspective view of a helmet portion of an impact diffusing system in which the face mask includes an upper portion including a transparent visor and a lower portion comprised of rigid bars.

In another embodiment, as shown in FIG. 20, the face mask 907 includes an upper portion formed of a clear or tinted transparent visor 902, and a lower portion 904 formed of rigid bars 906. In one example, the visor 902 is made of polycarbonate, or any other lightweight material that is transparent and able to withstand impact without breaking. The bars 906 may be made of titanium, stainless steel, or any other rigid material that is able to withstand impact. Any of the face masks disclosed herein may be replaced with a face mask 907 of the style shown in FIG. 20. The face mask 907 may be attached to any of the hard outer shells of the helmet portions disclosed herein in a manner that allows the face mask 907 to rotate or pivot relative to the outer shell. For example, the face mask 907 may be attached to the outer shell with hinges that allow the face mask 907 to open relative to the outer shell. Alternatively, the face mask 907 may be attached to the outer shell with pins that allow the face mask 907 to rotate up relative to the outer shell. Further, the face mask 907 may have one or more pillars attached thereto that extend downward and connect to the thoracic portion of the system, thereby providing a connection between the helmet portion and the thoracic portion.

Figure 21:
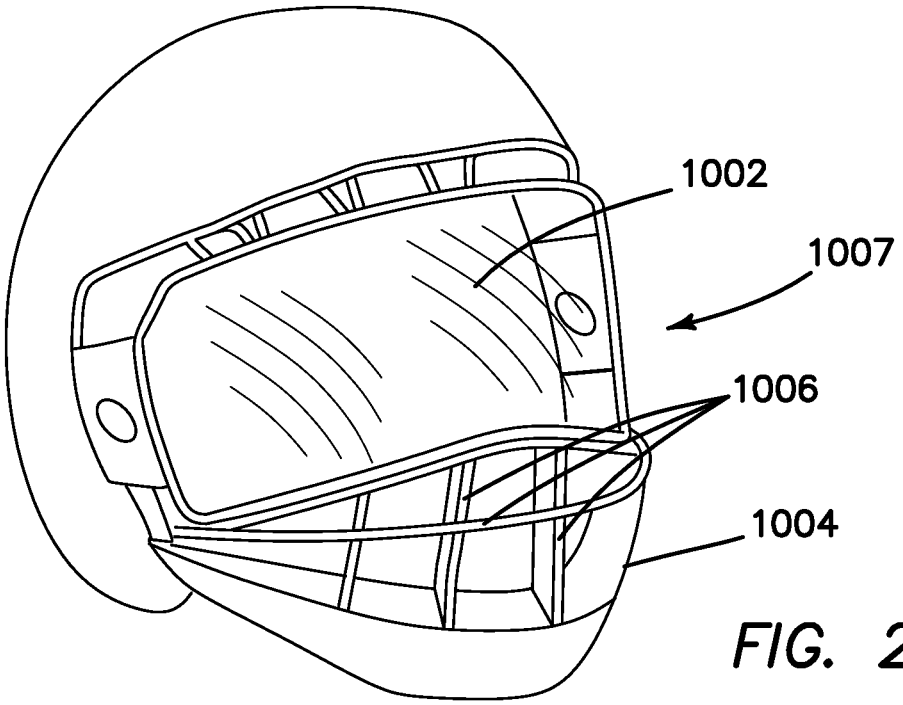
FIG. 21 is a front perspective view of a helmet portion of another impact diffusing system in which the face mask includes an upper portion including a transparent visor and a lower portion comprised of rigid bars.

In yet another embodiment, as shown in FIG. 21, the face mask 1007 is a unitary piece having a visor portion 1002 and a lower portion 1004 made of rigid bars 1006. This face mask 1007 may be made of any rigid, lightweight material that is able to withstand impact. For example, the face mask 1007 may be made of polycarbonate. Any of the face masks in the embodiments disclosed herein may be replaced with a face mask 1007 of the style shown in FIG. 21. The face mask 1007 may be fixedly, removably, or rotatably attached to the outer shell of the helmet portion of any of the systems disclosed herein. With rotatable attachment, the face mask 1007 may be attached to the helmet portion so that it is configured to rotate up relative to the helmet portion (similar to the embodiment shown in FIGS. 17A and 17B), or to rotate out relative to the helmet portion (similar to a bird cage door). Further, the face mask 1007 may have one or more pillars attached thereto that extend downward and connect to the thoracic portion of the system, thereby providing a connection between the helmet portion and the thoracic portion.

Figure 22A:
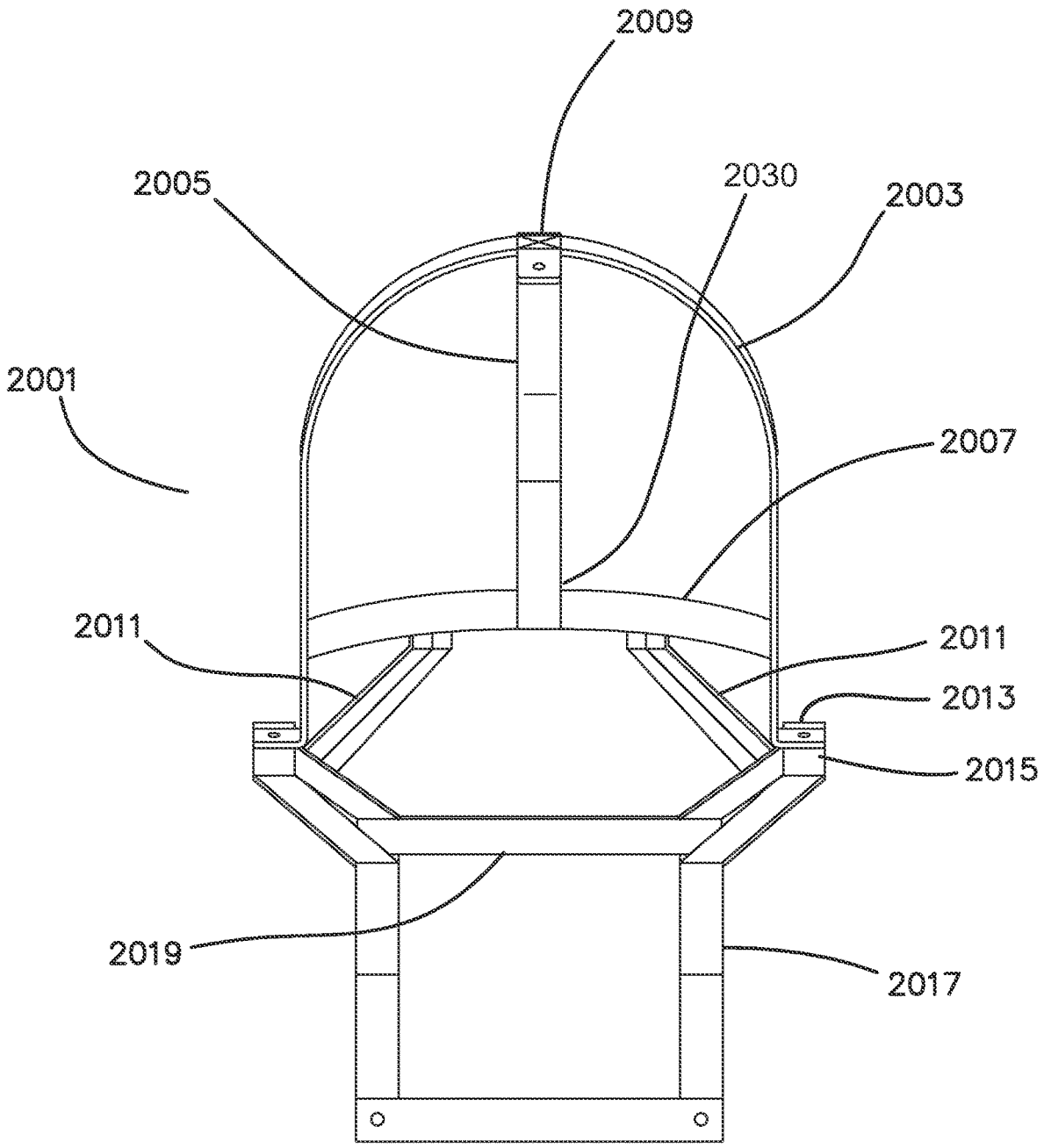
FIG. 22A is a front view of the framework skeleton of yet another embodiment of the impact diffusion system.
Figure 22B:
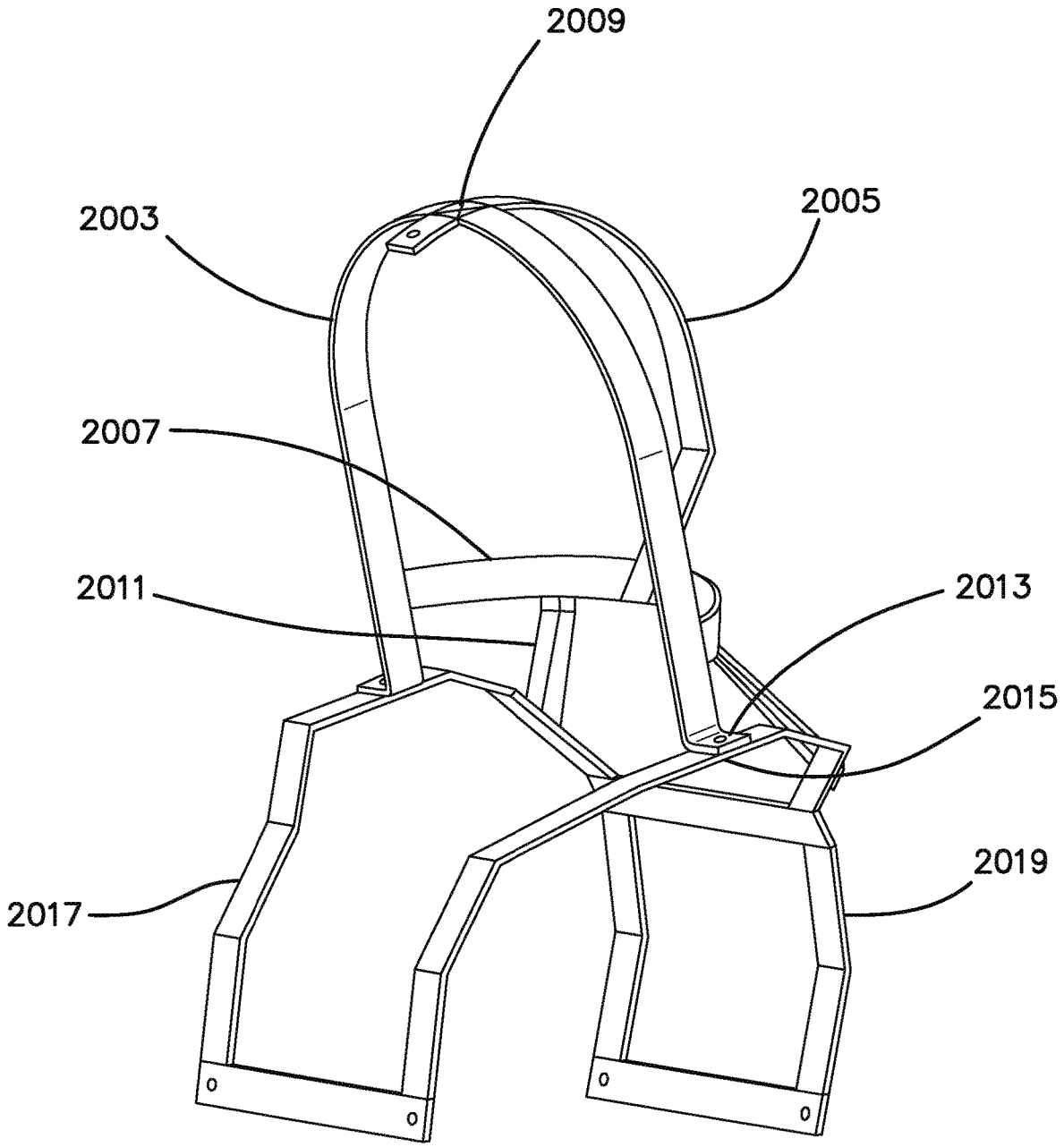
FIG. 22B is a front perspective view of the framework skeleton of the impact diffusion system shown in FIG. 22A.
Figure 22C:
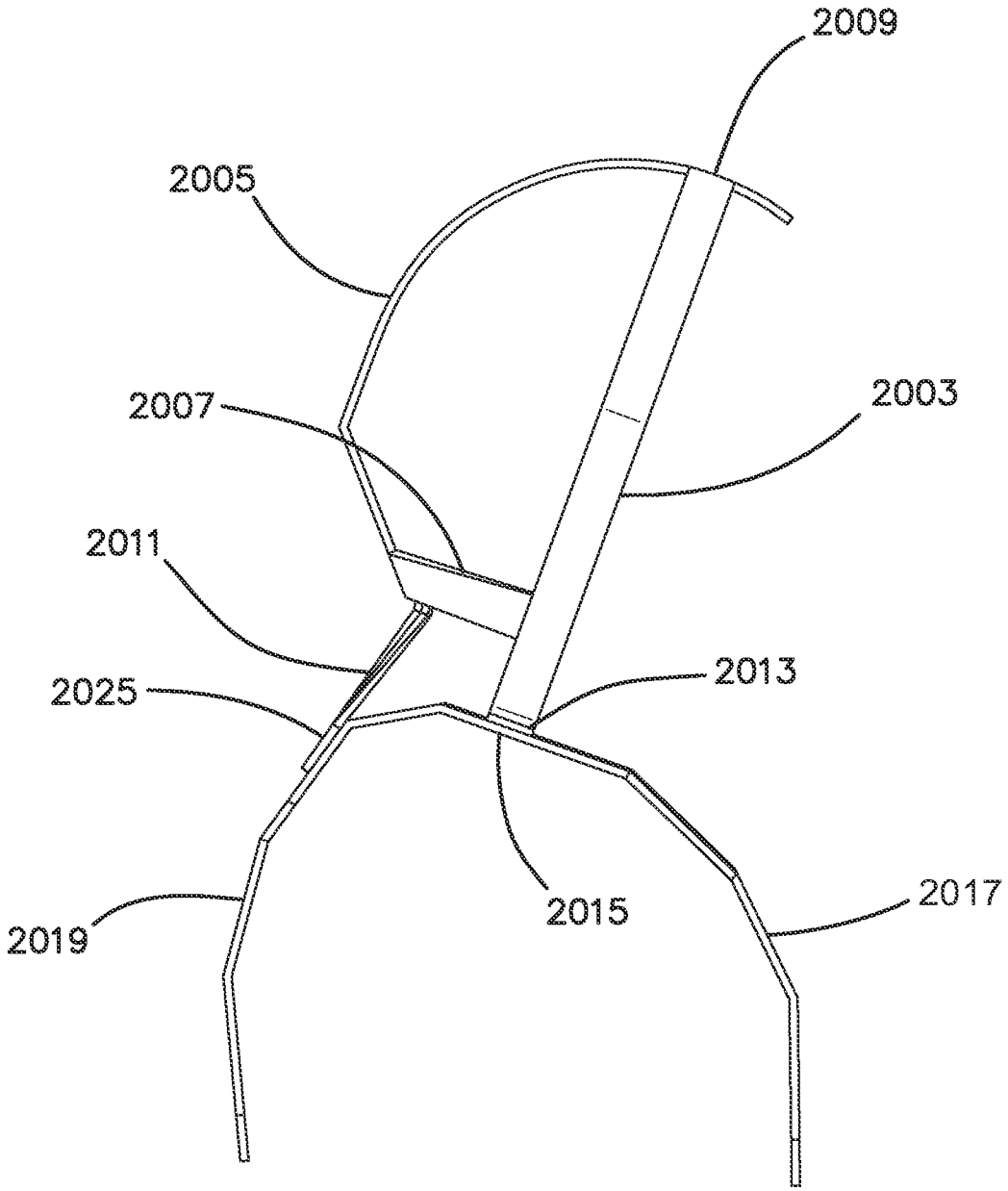
FIG. 22C is a side view of the framework skeleton of the impact diffusion system shown in FIG. 22A.

FIGS. 22A, 22B, and 22C are, respectively, a front view, front perspective view, and side view illustrating yet another embodiment of the impact diffusion system of the present invention. The framework skeleton of the impact diffusion system 2001 comprises a first support bar 2003 extending along the coronal plane from one side of the head, around the top of the head, to the other side of the head. A second support bar 2005 along the sagittal plane posterior to the head, connects to the first support bar 2003 at a position 2009 approximately at the crown of the head when the impact diffusion system is in use. A third support bar 2007 extends laterally around the back of the head and connects at each end to the first support bar 2003 at a position approximately below the ears of the wearer, and at its midpoint 2030 to the lower end of the second support bar 2005.

Each of two posterior pillars 2011 connect to the third support bar 2007 at a position to the right and to the left, respectively, of the midpoint 2030 of the third support bar 2007, and extend to a connection point 2025 at the upper part of the back framework 2019 of the thoracic portion. Connectors 2013, 2025 at each end of the first support bar 2003 and the posterior pillars 2011 are detachably connected to connector receptacles 2015 of the front and back framework 2017, 2019 of the thoracic portion, and may be of any suitable type, such as the "pin-type" quick release mechanism shown in FIGS. 7A and 7B. In FIGS. 22A-22C the skeleton of the thoracic portion is shown without padding or outer hard shell covering. In a currently less preferred embodiment of the invention, the headpiece portion and the thoracic portion may be non-detachably joined; that is, without connectors or connection receptacles.

Figure 23:
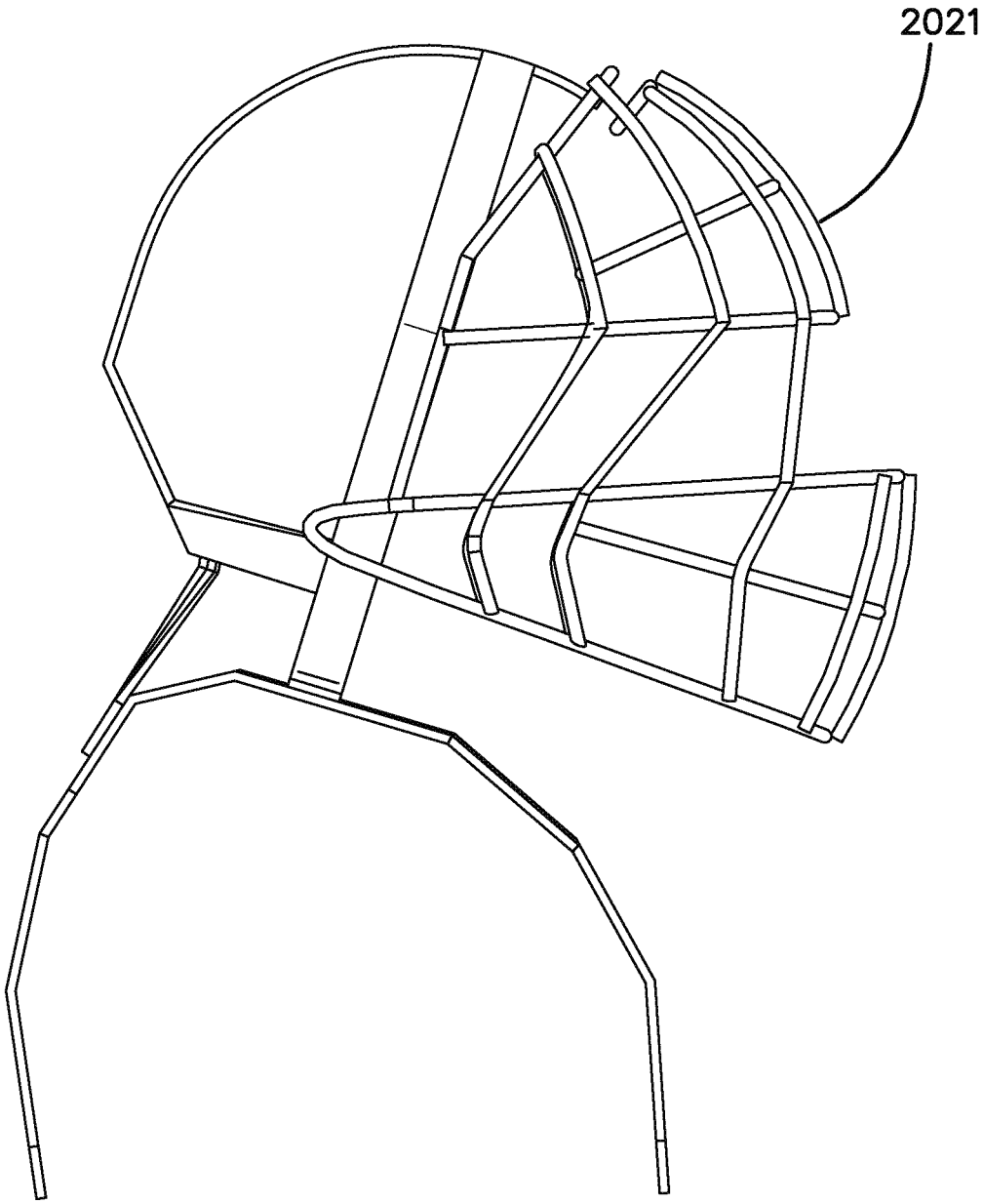
FIG. 23 is a side view of the framework skeleton of the impact diffusion system of FIG. 22C, to which a face mask is attached.
Figure 24A:
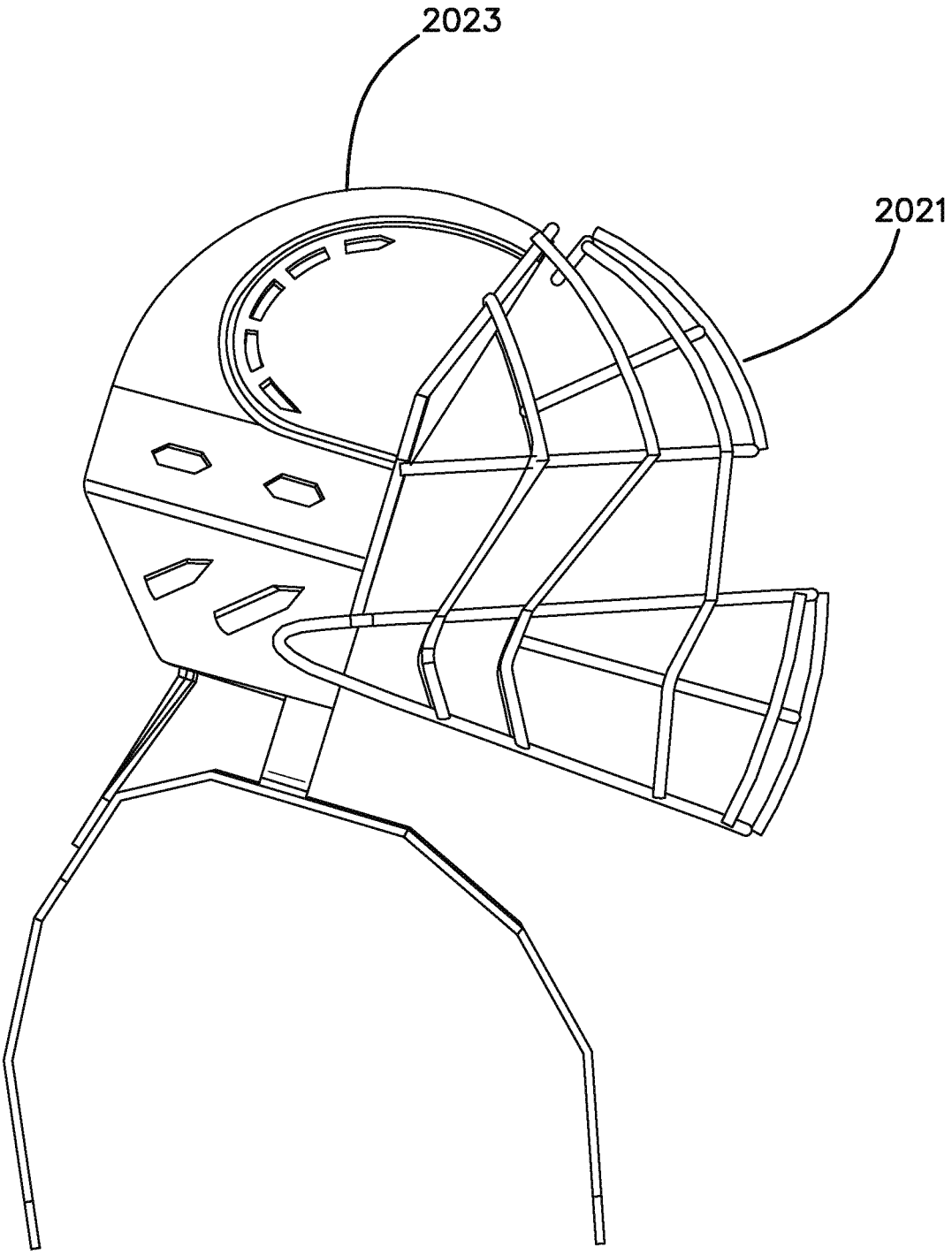
FIG. 24A is a side view of the framework skeleton of the impact diffusion system of FIG. 23, to which a protective helmet shell is attached.
Figure 24B:
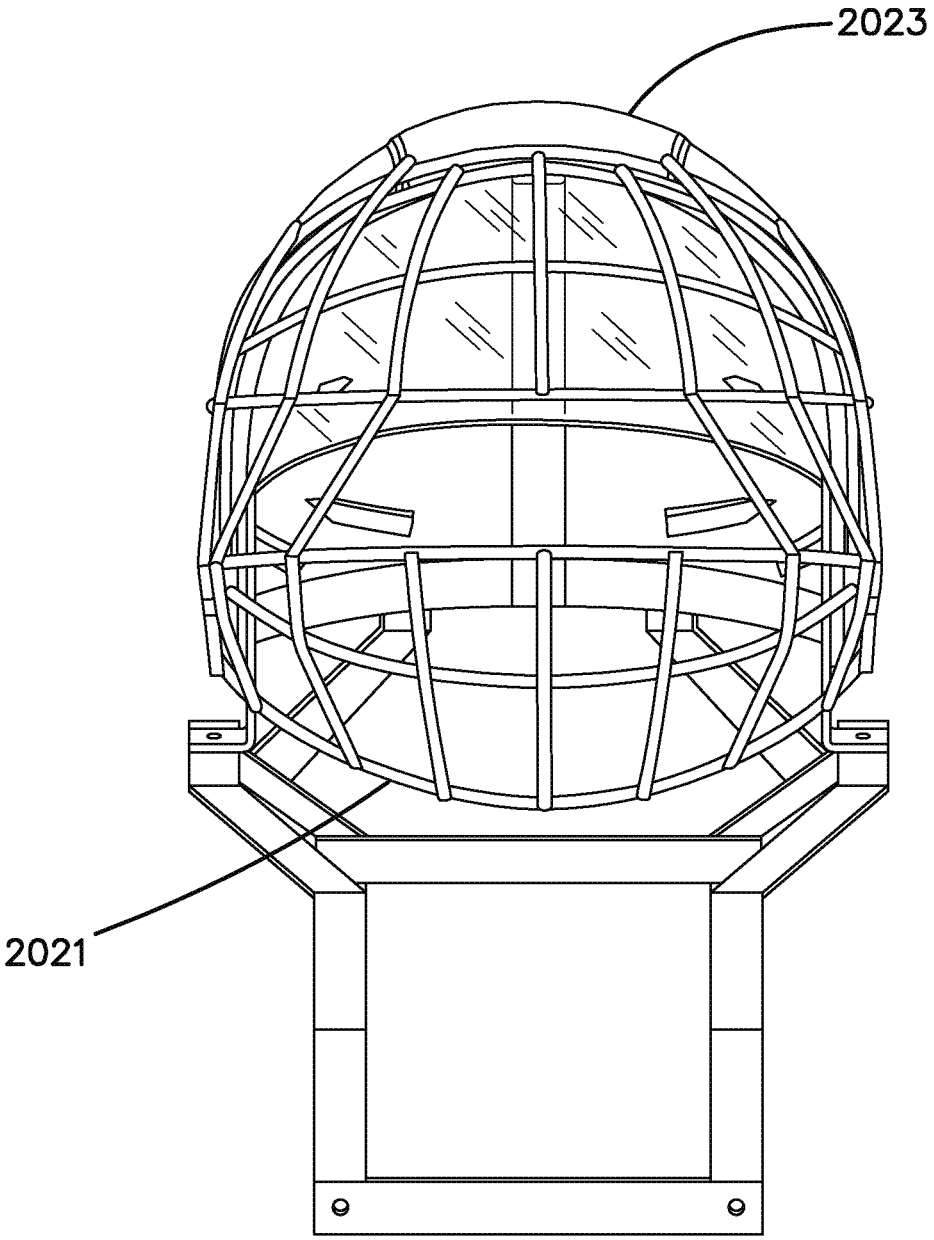
FIG. 24B is a front view of the framework skeleton of the impact diffusion system of FIG. 24A.

FIG. 23 shows a side view of the framework skeleton of the impact diffusion system of FIGS. 22A-22C with a face mask 2021 attached. FIG. 24A show the same side view with the outer protective helmet shell 2023 attached to the headpiece cage, while FIG. 24B shows the same system in front view.

An advantage of the embodiment of the impact diffusions system of FIGS. 22A-24B (and similar embodiments) may be found in the fact that this design provides strong impact diffusion from all angles, but does not include or require a post or pillar extending downward from the face mask to a connection point on the thoracic portion of the system. In some other embodiments, a post extending downward in this way could present a danger to another player, whose hands, arms or body may more easily become caught in such a post or pillar.

To the extent that a plurality of inventions may be disclosed herein, any such invention shall be understood to have been disclosed herein alone, in combination with other features or inventions disclosed herein, or lacking any feature or features not explicitly disclosed as essential for that invention. For example, the inventions described in this specification can be practiced within elements of, or in combination with, any other features, elements, methods or structures described herein. Additionally, Applicants intend that a feature illustrated herein as being present in a particular embodiment or example may, in other examples of the present invention, be explicitly lacking from the invention, or combinable with features described in other examples or embodiments in this patent application, in a manner not otherwise illustrated in this patent application or present in that particular example. The scope of the invention shall be determined solely by the language of the claims.

The present invention may, in certain examples, be drawn to a unitary helmet portion/pillar/thoracic portion assembly, with and without the inner headgear. In other examples, the invention may be drawn to the helmet portion comprising integrated pillars. In other examples, the invention may be drawn to the thoracic portion comprising the rigid framework. In other examples, the invention may be drawn to the helmet portion and inner headgear. In other examples, the invention may be drawn to methods for protecting the head from experiencing the full impact of a blow thereto, using any, all, or any combination of the elements of the impact diffusing system described herein.

Thus, the various descriptions of the invention provided herein illustrate presently preferred examples of the invention; however, it will be understood that the invention is not limited to the examples provided, or to the specific configurations, shapes, and relation of elements unless the claims specifically indicate otherwise. Based upon the present disclosure a person of ordinary skill in the art will immediately conceive of other alternatives to the specific examples given, such that the present disclosure will be understood to provide a full written description of each of such alternatives as if each had been specifically described.

Each and every patent, published patent application and/or other non-patent publication referred to in this patent application is individually incorporated by reference herein as part of this specification in its entirety.

What is claimed is:

1. An impact diffusing system for protecting a head of a user of the system, comprising:

a helmet portion containing:

a) a headpiece cage comprising i) a first support bar that extends from a top of the cage to a bottom of the cage, such that the first support bar extends from a position corresponding, when in use, to one side of the head adjacent to one shoulder, around the top of the head, to the other side of the head adjacent to the other shoulder, ii) a second support bar that extends along the sagittal plane posterior to the head, connecting to the first support bar at a position approximately at the crown of the head when the headpiece cage is worn, iii) a third support bar that extends laterally around the back of the head and connects at each end to the first support bar at a position approximately below the ears of the wearer when the headpiece cage is worn, and at its midpoint to the lower end of the second support bar, iv) two posterior pillars that extend from the third support bar in a direction simultaneously downward, laterally and posteriorly thereto, to connection points on rear shoulders of a thoracic framework; and iii) a face mask structured to enclose at least a front portion of a face of the user when the headpiece cage is worn, wherein the face mask is coupled to at least one of the support bars; and a thoracic framework structured to cover at least a portion of a chest, upper back, and shoulders of the user when the headpiece cage is worn, wherein the thoracic framework is attached to said first support bar and said second support bar of the headpiece cage in a manner that prevents movement of the headpiece cage relative to the thoracic framework.

2. The impact diffusing system of claim 1, wherein the first support bar extends along a coronal plane of the user when the headpiece cage is worn.

3. The impact diffusing system of claim 1, wherein the headpiece cage is structured to attach to a conventional helmet.

4. The impact diffusing system of claim 1, further comprising an outer shell covering at least a portion of an outer surface of the headpiece cage and fixedly attached thereto.

5. The impact diffusing system of claim 1, further comprising inner headgear structured and sized to conform to the user's head and to fit inside the headpiece cage when the headpiece cage is worn.

6. The impact diffusing system of claim 5, wherein the inner headgear is sized and structured to be moveable relative to the headpiece cage.

7. The impact diffusing system of claim 6, wherein the inner headgear comprises a friction-reducing outer coating that reduces friction when the inner headgear moves relative to the headpiece cage.

8. The impact diffusing system of claim 7, wherein the headpiece cage comprises a friction-reducing inner coating that reduces friction when the inner headgear moves relative to the headpiece cage.

9. The impact diffusing system of claim 5, wherein the inner headgear comprises impact absorbing padding.

10. The impact diffusing system of claim 9, wherein the padding comprises at least one member of the group consisting of: inflatable padding, and smart material padding.

11. The impact diffusing system of claim 1, further comprising inner thoracic padding and an outer thoracic shell, wherein the thoracic framework is disposed between the inner thoracic padding and the outer thoracic shell.

12. The impact diffusing system of claim 1, wherein the thoracic framework is structured to attach to conventional shoulder pads.

13. The impact diffusing system of claim 1, wherein the thoracic framework is permanently attached to the headpiece cage.

14. The impact diffusing system of claim 13, wherein the thoracic framework and the headpiece cage are manufactured as a unitary piece.

15. The impact diffusing system of claim 13, further comprising at least four connection points between the thoracic framework and the headpiece cage.

16. The impact diffusing system of claim 1, wherein the thoracic framework comprises bars forming polygonal shapes that surround the portion of the chest, upper back, and shoulders of the user when the headpiece cage is worn.

17. The impact diffusing system of claim 1, wherein the thoracic framework is removably attached to the headpiece cage.

18. The impact diffusing system of claim 17, wherein the thoracic framework comprises at least four connector receptacles and the headpiece cage comprises at least four connectors each configured to removably attach to a respective one of the thoracic framework connector receptacles.

19. The impact diffusing system of claim 18, wherein the headpiece cage comprises a first connector at a first end of the first support bar, a second connector at a second end of the first support bar, a third connector at an end of a first posterior pillars, and a fourth connector at an end of a second posterior pillar.

20. The impact diffusing system of claim 1, wherein the first support bar and the second support bar of the headpiece cage are connected to each other at the top of the headpiece cage, above the top of the user's head when the headpiece cage is worn.

21. The impact diffusing system of claim 1, wherein the headpiece cage and the thoracic framework are made of at least one of: stainless steel, titanium, carbon fiber, or a polymer.

22. The impact diffusing system of claim 1, wherein the thoracic framework is formed of a rigid, inflexible material.

23. The impact diffusing system of claim 1, wherein the thoracic framework comprises rigid portions and flexible portions.

24. The impact diffusing system of claim 23, wherein the flexible portions are formed by hinges, reduced thickness portions, or slots or openings formed within selected regions of the framework.

* * * * *